US010105968B2

(12) United States Patent
Iwata et al.

(10) Patent No.: US 10,105,968 B2
(45) Date of Patent: Oct. 23, 2018

(54) SHEET PROCESSING DEVICE AND IMAGE FORMING SYSTEM

(71) Applicants: Akikazu Iwata, Kanagawa (JP); Hiroshi Nishino, Kanagawa (JP); Yu Yamaya, Kanagawa (JP); Ryohei Morisaki, Kanagawa (JP); Norihiko Murakami, Kanagawa (JP); Maki Nishide, Kanagawa (JP)

(72) Inventors: Akikazu Iwata, Kanagawa (JP); Hiroshi Nishino, Kanagawa (JP); Yu Yamaya, Kanagawa (JP); Ryohei Morisaki, Kanagawa (JP); Norihiko Murakami, Kanagawa (JP); Maki Nishide, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/742,149

(22) Filed: Jun. 17, 2015

(65) Prior Publication Data

US 2015/0329308 A1 Nov. 19, 2015

Related U.S. Application Data

(63) Continuation of application No. 14/705,396, filed on May 6, 2015.

(30) Foreign Application Priority Data

May 13, 2014 (JP) ..... 2014-099952
Jan. 21, 2015 (JP) ..... 2015-009714

(51) Int. Cl.
*B65H 45/30* (2006.01)
*B41J 11/04* (2006.01)
(Continued)

(52) U.S. Cl.
CPC ..... *B41J 11/04* (2013.01); *B41J 11/0045* (2013.01); *B65H 29/58* (2013.01); *B65H 29/60* (2013.01);
(Continued)

(58) Field of Classification Search
CPC ..... B65H 2404/6942; B65H 37/06; B65H 2404/632; B65H 2701/3212;
(Continued)

(56) References Cited

U.S. PATENT DOCUMENTS 7,798,950 B2 * 9/2010 Kobayashi ..... B65H 45/18 270/20.1
2003/0151187 A1 8/2003 Suzuki et al.
(Continued)

FOREIGN PATENT DOCUMENTS

JP S4738312 * 12/1972
JP 2007-045531 2/2007
(Continued)

OTHER PUBLICATIONS

Office Action dated Apr. 17, 2017 in co-pending U.S. Appl. No. 14/705,396.
Office Action dated Jun. 25, 2018, in U.S. Appl. No. 14/705,396.

*Primary Examiner* — Jennifer Simmons
(74) *Attorney, Agent, or Firm* — Oblon, McClelland, Maier & Neustadt, L.L.P.

(57) ABSTRACT

A sheet processing device for pressing a fold line formed in a sheet, the sheet processing device comprises a pressing portion configured to press a sheet while rotating about a rotation axis. The pressing portion includes a pressing unit having a projecting shape, disposed over a predetermined range in a direction of the rotation axis to have a position in a rotation direction about the rotation axis changed according to the direction of the rotation axis, and an impact
(Continued)

absorbing member provided at a part of the pressing unit of the pressing portion, abutting on the sheet at first in the rotation direction of the pressing portion, the impact absorbing member configured to reduce impact upon abutting on the sheet.

21 Claims, 41 Drawing Sheets

(51) Int. Cl.

| | |
|---|---|
| ***B65H 45/16*** | (2006.01) |
| ***B41J 11/00*** | (2006.01) |
| ***B65H 37/06*** | (2006.01) |
| ***B65H 29/70*** | (2006.01) |
| ***B65H 29/58*** | (2006.01) |
| ***B65H 29/60*** | (2006.01) |
| ***B65H 45/14*** | (2006.01) |

(52) U.S. Cl.
CPC ..... *B65H 29/70* (2013.01); *B65H 37/06* (2013.01); *B65H 45/14* (2013.01); *B65H 45/16* (2013.01); *B65H 45/30* (2013.01); *B65H 2301/4493* (2013.01); *B65H 2403/72* (2013.01); *B65H 2403/942* (2013.01); *B65H 2404/1118* (2013.01); *B65H 2404/121* (2013.01); *B65H 2404/632* (2013.01); *B65H 2404/693* (2013.01); *B65H 2404/6942* (2013.01); *B65H 2511/11* (2013.01); *B65H 2511/212* (2013.01); *B65H 2513/10* (2013.01); *B65H 2513/11* (2013.01); *B65H 2513/512* (2013.01); *B65H 2557/242* (2013.01); *B65H 2701/1123* (2013.01); *B65H 2701/11231* (2013.01); *B65H 2701/11232* (2013.01); *B65H 2701/11234* (2013.01); *B65H 2701/13212* (2013.01); *B65H 2801/27* (2013.01)

(58) Field of Classification Search
CPC ..... B65H 2404/1118; B65H 45/30; B65H 2701/13212; B65H 45/16
See application file for complete search history.

(56) References Cited

U.S. PATENT DOCUMENTS

| | | | | |
|---|---|---|---|---|
| 2010/0221052 | A1* | 9/2010 | Mizuno ..... | B65H 29/125 399/406 |
| 2013/0012370 | A1 | 1/2013 | Naraoka et al. | |
| 2014/0062004 | A1 | 3/2014 | Sugitani et al. | |
| 2014/0141956 | A1 | 5/2014 | Suzuki et al. | |
| 2014/0147184 | A1 | 5/2014 | Kunieda et al. | |
| 2014/0171283 | A1 | 6/2014 | Furuhashi et al. | |
| 2014/0179504 | A1 | 6/2014 | Nakada et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0183612 | A1* | 7/2015 | Awano ..... | B65H 45/18 493/454 |
| 2015/0321872 | A1* | 11/2015 | Hari ..... | B65H 45/30 493/405 |

FOREIGN PATENT DOCUMENTS

| | | |
|---|---|---|
| JP | 2009-149435 | 7/2009 |
| JP | 2011-246221 | 12/2011 |
| JP | 2013-060246 | 4/2013 |

* cited by examiner

SHEET PROCESSING DEVICE AND IMAGE FORMING SYSTEM

CROSS-REFERENCE TO RELATED APPLICATIONS

The present application is a continuation of U.S. application Ser. No. 14/705,396, filed May 6, 2015, and claims priority to and incorporates by reference the entire contents of Japanese Patent Application No. 2014-099952 filed in Japan on May 13, 2014 and Japanese Patent Application No. 2015-009714 filed in Japan on Jan. 21, 2015.

BACKGROUND OF THE INVENTION

1. Field of the Invention

The present invention relates to a sheet processing device and an image forming system, more particularly to sheet folding.

2. Description of the Related Art

In recent years, digitalization of information has been promoted, and image processing apparatuses, such as printers or facsimile machines used for output of digitalized information, or scanners used for digitalization of documents, are essential to the digitalization of information. Such image processing apparatuses each include an imaging function, an image forming function, a communication function, and the like, and are often provided as multifunction peripherals each used as a printer, a facsimile machine, a scanner, and a copying machine.

Among such multifunction peripherals, a multifunction peripheral is known which is mounted with a folding device for forming an image on a fed sheet to draw an image, and then folding the sheet on which the image has been formed. When such a folding device folds a sheet to make a fold line, the fold line is not so firm and incomplete, and the fold line has a high folded height.

Therefore, among such multifunction peripherals, a multifunction peripheral is known which is mounted with an additional folding device performing additional folding for securing a fold line, by pressing the fold line formed by folding a sheet to secure a fold line, and reducing the height of the fold line, in addition to the folding device.

When such a folding device as described above folds a sheet, the fold line is generally formed in a direction (hereinafter, also referred to as a "direction perpendicular to a sheet conveying direction") perpendicular to a direction in which the sheet is conveyed (hereinafter, also referred to as a "sheet conveying direction").

Therefore, an additional folding method for such an additional folding device as described above includes, for example, a method in which an additional folding roller is laterally bridged in a direction parallel to a fold line formed by folding a sheet (in a direction perpendicular to a sheet conveying direction), the additional folding roller is rotated about a rotation axis extending in the direction perpendicular to the sheet conveying direction, and pressing a fold line formed in a sheet while conveying the sheet (e.g., see Japanese Laid-open Patent Publication No. 2007-045531).

Further, another additional folding method for such an additional folding device as described above includes, for example, a method in which conveyance of a sheet is once stopped at a position where additional folding is performed, an additional folding roller rotated about a rotation axis extending in a direction (sheet conveying direction) perpendicular to a fold line formed by folding a sheet is moved in a direction perpendicular to the sheet conveying direction while being pressed against the stopped sheet, and sequentially presses the fold line formed in the sheet in the direction perpendicular to the sheet conveying direction (e.g., see Japanese Laid-open Patent Publication No. 2009-149435).

The additional folding method of Japanese Laid-open Patent Publication No. 2007-045531 requires a plurality of additional folding rollers in the sheet conveying direction. It is because one additional folding roller presses the whole area of the fold line simultaneously, a pressing force of the one additional folding roller is dispersed over the whole area of the fold line, a pressing force per unit area is reduced, and only the one additional folding roller cannot bring about sufficient effect of additional folding. Accordingly, when such a method is used to perform the additional folding, a space for disposition of the plurality of additional folding rollers is required, a multifunction peripheral is increased in size, a drive system or a control system needs to be added to drive the additional folding rollers, and an initial cost and a running cost are disadvantageously increased.

Meanwhile, in the additional folding method of Japanese Laid-open Patent Publication No. 2009-149435, the whole area of the fold line is sequentially pressed by one additional folding roller in the direction perpendicular to the sheet conveying direction, so that a concentrated pressing force can be applied to the whole area of the fold line portion, and the pressing force is prevented from being dispersed, but, during additional folding, the additional folding roller needs to be moved from one end to the other end in a sheet width direction while the sheet is stopped. Accordingly, when such a method is used to perform the additional folding, a time is required for movement of the additional folding roller from one end to the other end in the sheet width direction, and productivity is disadvantageously reduced.

Therefore, a method may be provided in which an additional folding roller is laterally bridged in a direction perpendicular to the sheet conveying direction, having a surface formed with a pressing member having a helical shape about the rotation axis, and rotated about a rotation axis extending in a direction perpendicular to the sheet conveying direction, and when the additional folding roller is rotated, a fold line formed in a sheet in a direction perpendicular to the sheet conveying direction is sequentially pressed. According to such an additional folding device, only part of the helical pressing member formed on the surface of the additional folding roller makes contact with the sheet, so that the additional folding roller is rotated to sequentially press the fold line formed in the sheet in a direction perpendicular to the sheet conveying direction.

Accordingly, such an additional folding device allows one additional folding roller to apply a concentrated pressing force to the whole area of the fold line for a short time, and a sufficient pressing force can be applied to the fold line at low cost without reducing productivity.

However, in such an additional folding device, when the pressing member formed on the surface of the additional folding roller abuts on the sheet, the concentrated pressing force is rapidly applied to the abutment part, impact sound is generated, and a noise disadvantageously occurs outside the device.

In view of the above-described conventional problem, there is a need to efficiently press a fold line formed in a sheet at low cost, and to reduce a noise generated upon pressing the fold line.

SUMMARY OF THE INVENTION

It is an object of the present invention to at least partially solve the problems in the conventional technology.

According to the present invention, there is provided a sheet processing device for pressing a fold line formed in a sheet, the sheet processing device comprising: a pressing portion configured to press a sheet while rotating about a rotation axis. In the sheet processing device, the pressing portion includes; a pressing unit having a projecting shape, disposed over a predetermined range in a direction of the rotation axis to have a position in a rotation direction about the rotation axis changed according to the direction of the rotation axis, and an impact absorbing member provided at a part of the pressing unit of the pressing portion, abutting on the sheet at first in the rotation direction of the pressing portion, the impact absorbing member configured to reduce impact upon abutting on the sheet.

The present invention also provides an image forming system comprising: an image forming apparatus configured to form and output an image on a sheet; a folding device configured to fold the sheet on which the image has been formed by the image forming apparatus, and form a fold line in the sheet; and a sheet processing device configured to press the fold line formed by the folding device. In the image forming system, the sheet processing device comprises a pressing portion configured to press a sheet while rotating about a rotation axis. And, the pressing portion includes a pressing unit having a projecting shape, disposed over a predetermined range in a direction of the rotation axis to have a position in a rotation direction about the rotation axis changed according to the direction of the rotation axis, and an impact absorbing member provided at a part of the pressing unit of the pressing portion, abutting on the sheet at first in the rotation direction of the pressing portion, the impact absorbing member configured to reduce impact upon abutting on the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

An embodiment of the present invention will be described below with reference to the drawings. In the present embodiment, an image forming apparatus will be exemplified which forms an image on a fed sheet, folds the sheet on which the image has been formed, to form a fold line in a direction perpendicular to a sheet conveying direction, and performs additional folding by pressing the fold line, for securing the fold line and reducing the height of the fold line.

Further, the image forming apparatus according to the present embodiment includes an additional folding roller laterally bridged in a direction perpendicular to the sheet conveying direction, rotated about a rotation axis extending in a direction perpendicular to the sheet conveying direction, and having a surface formed with a projection portion projecting to have a helical shape about the rotation axis, with a fixed angular difference θ between the projection portion and the rotation axis. The additional folding roller is rotated, and the fold line formed in the sheet is sequentially pressed in a direction perpendicular to the sheet conveying direction. According to such an image forming apparatus, only the projection portion formed on the surface of the additional folding roller partially makes contact with the sheet. Therefore, when the additional folding roller is rotated, the fold line formed in the sheet can be sequentially pressed in a direction perpendicular to the sheet conveying direction.

Therefore, the image forming apparatus according to the present embodiment allows one additional folding roller to apply a concentrated pressing force to the whole area of the fold line for a short time, and a sufficient pressing force can be applied to the fold line at low cost without reducing productivity.

According to one aspect of the present embodiment, in an image forming apparatus configured as described above, the projection portion formed on the surface of the additional folding roller has an distal end abutting on the sheet at first, and the distal end is provided with an impact absorbing member for reducing impact upon collision with the sheet. Therefore, the image forming apparatus according to the present embodiment can reduce impact sound generated upon abutment on the sheet of the projection portion formed on the surface of the additional folding roller.

As described above, in the image forming apparatus according to the present embodiment, the fold line formed in the sheet can be efficiently pressed at low cost, and the noise generated upon pressing the fold line can be reduced.

Figure 1:
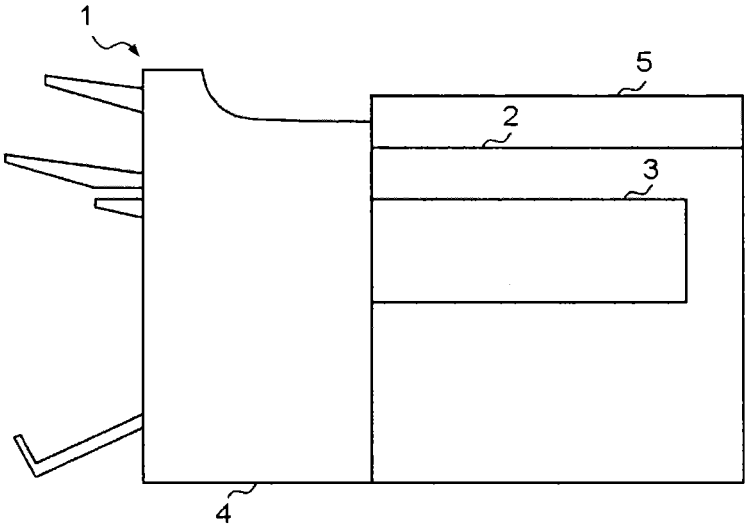
FIG. 1 is a simplified schematic diagram illustrating an overall configuration of an image forming apparatus according to an embodiment of the present invention.

First, an overall configuration of an image forming apparatus 1 according to the present embodiment will be described with reference to FIG. 1. FIG. 1 is a simplified schematic diagram illustrating an overall configuration of the image forming apparatus 1 according to the present embodiment. As illustrated in FIG. 1, the image forming apparatus 1 according to the present embodiment includes an image forming unit 2, a folding unit 3, an additional folding unit 4, and a scanner unit 5.

The image forming unit 2 generates drawing information about cyan magenta yellow key plate (CMYK) based on input image data, and forms and outputs an image on a fed sheet based on the generated drawing information. The folding unit 3 folds the sheet on which the image has been formed, when the sheet is conveyed from the image forming unit 2. The additional folding unit 4 additionally presses a fold line formed in the sheet having been folded, when the sheet is conveyed from the folding unit 3. That is, in the present embodiment, the additional folding unit 4 functions as a sheet processing device.

In the scanner unit 5 has a linear image sensor having a plurality of photodiodes aligned in line, and disposed with a light receiving element, such as a charge coupled device (CCD) or a complementary metal oxide semiconductor (CMOS) image sensor, in parallel with the plurality of photodiodes, and a document is read by the linear image sensor and digitalized. It is noted that the image forming apparatus 1 according to the present embodiment is a multifunction peripheral (MFP) including an imaging function, an image forming function, a communication function, and the like, and used as a printer, a facsimile machine, a scanner, and a copying machine.

Figure 2:
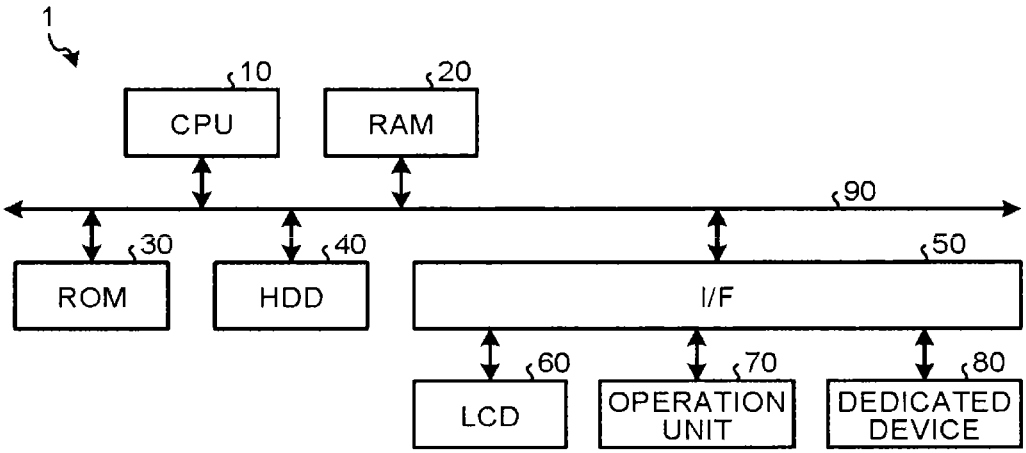
FIG. 2 is a schematic block diagram illustrating a hardware configuration of an image forming apparatus according to an embodiment of the present invention.

Next, a hardware configuration of the image forming apparatus 1 according to the present embodiment will be described with reference to FIG. 2. FIG. 2 is a schematic block diagram illustrating the hardware configuration of the image forming apparatus 1 according to the present embodiment. It is noted that the image forming apparatus 1 includes engines for achieving the scanner, the printer, folding, additional folding, and the like, in addition to the hardware configuration of FIG. 2.

As illustrated in FIG. 2, the image forming apparatus 1 according to the present embodiment includes a configuration similar to a general server, personal computer (PC), or the like. That is, in the image forming apparatus 1 according to the present embodiment, a central processing unit (CPU) 10, a random access memory (RAM) 20, a read only memory (ROM) 30, a hard disk drive (HDD) 40, and an I/F 50 are connected through a bus 90. Further, the I/F 50 is connected with a liquid crystal display (LCD) 60, an operation unit 70, and a dedicated device 80.

The CPU 10 is a calculation unit, and controls the whole operation of the image forming apparatus 1. The RAM 20 is a volatile storage medium for fast reading and writing of information, and the CPU 10 is used as a work area for processing the information. The ROM 30 is a non-volatile storage medium only allowing reading information therein, and stores programs such as firmware. The HDD 40 is a non-volatile storage medium allowing reading and writing information, and stores therein an operating system (OS), various control programs, application programs, or the like.

The I/F 50 connects between the bus 90 and various hardware, networks, or the like for control. The LCD 60 is a visual user interface allowing a user to confirm a status of the image forming apparatus 1. The operation unit 70 is a user interface, such as a keyboard or a mouse, allowing the user to input information to the image forming apparatus 1.

The dedicated device 80 is hardware for achieving a dedicated function in the image forming unit 2, the folding unit 3, the additional folding unit 4, or the scanner unit 5, and represents a plotter device for forming and outputting an image on a sheet surface, in the image forming unit 2. Further, in the folding unit 3, the dedicated device 80 represents a conveying mechanism for conveying the sheet or a folding mechanism for folding the sheet conveyed.

Further, in the additional folding unit 4, the dedicated device 80 is an additional folding mechanism for securing the fold line in the sheet conveyed after being folded by the folding unit 3. In the scanner unit 5, the dedicated device 80 represents a reading device for reading the image displayed on the sheet surface. According to one aspect of the present embodiment, the additional folding unit 4 includes a configuration of the additional folding mechanism.

In such a hardware configuration, a software control unit is configured so that a program stored in the storage medium such as the ROM 30, the HDD 40, or an optical disk is read into the RAM 20, and the CPU 10 performs calculation according to the program loaded in the RAM 20. The software control unit configured as described above and the hardware are combined to configure a function block for achieving a function of the image forming apparatus 1 according to the present embodiment.

Figure 3:
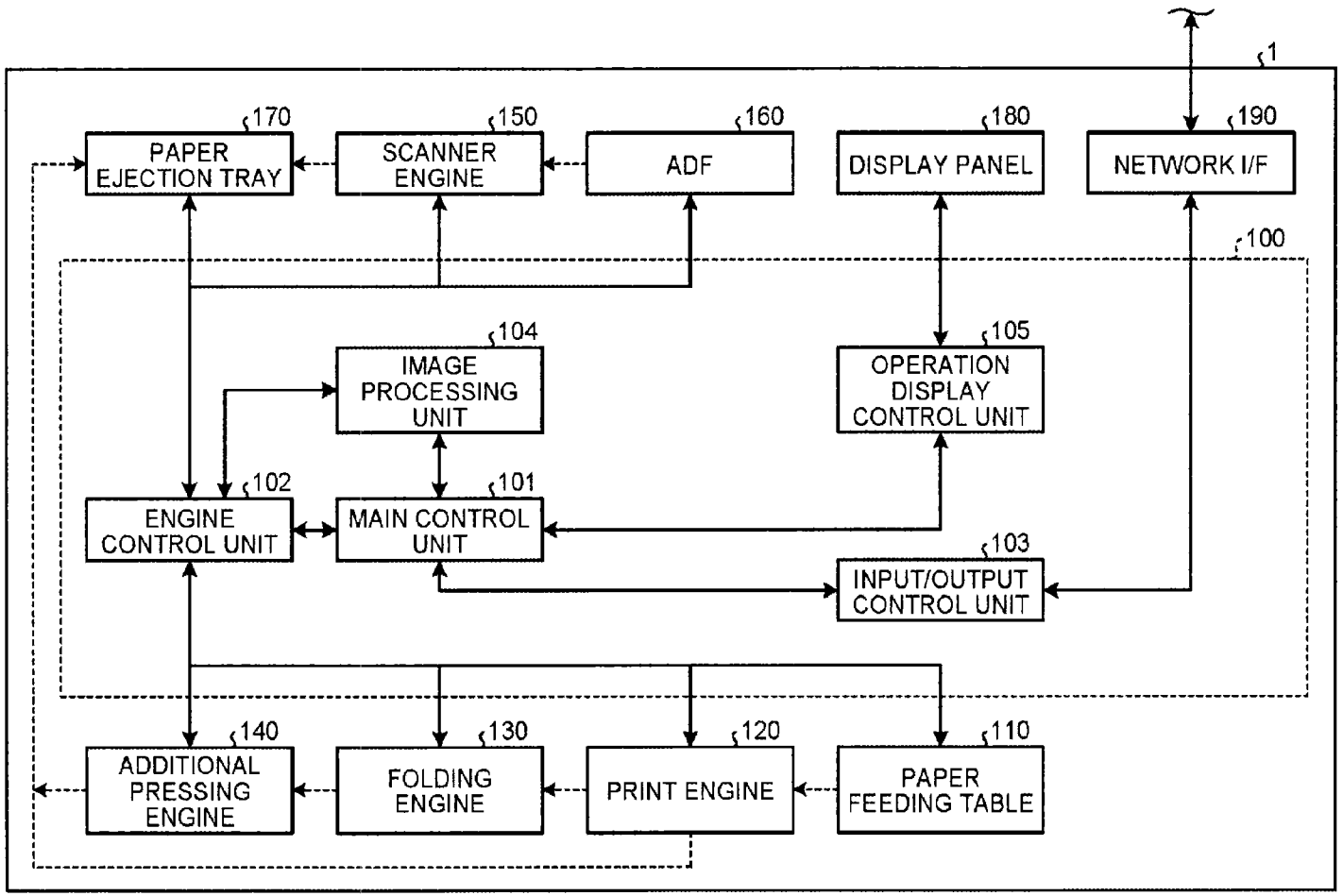
FIG. 3 is a schematic block diagram illustrating a functional configuration of an image forming apparatus according to an embodiment of the present invention.

Next, a functional configuration of the image forming apparatus 1 according to the present embodiment will be described with reference to FIG. 3. FIG. 3 is a schematic block diagram illustrating the functional configuration of the image forming apparatus 1 according to the present embodiment. It is noted that, in FIG. 3, electrical connection is indicated by solid arrows, and a flow of a sheet or a document bundle is indicated by dashed arrows.

As illustrated in FIG. 3, the image forming apparatus 1 according to the present embodiment includes a controller 100, a paper feeding table 110, a print engine 120, a folding engine 130, an additional folding engine 140, a scanner engine 150, an auto document feeder (ADF) 160, a paper ejection tray 170, a display panel 180, and a network I/F 190. Further, the controller 100 includes a main control unit 101, an engine control unit 102, an input/output control unit 103, an image processing unit 104, and an operation display control unit 105.

The paper feeding table 110 feeds the sheet to the print engine 120 as an image forming portion. The print engine 120 is an image forming portion provided in the image forming unit 2, and forms and outputs the image on the sheet conveyed from the paper feeding table 110 for drawing the image. As a specific mode of the print engine 120, an inkjet image forming mechanism, an electrophotographic image forming mechanism, or the like can be employed. The sheet on which the image has been formed has thereon the image drawn by the print engine 120, and is conveyed to the folding unit 3 or ejected into the paper ejection tray 170.

The folding engine 130 is provided in the folding unit 3, and the folding engine 130 folds the sheet on which the image has been formed, when the sheet is conveyed from the image forming unit 2. The sheet having been folded by the folding engine 130 is conveyed to the additional folding unit 4. The additional folding engine 140 is provided in the additional folding unit 4, and the additional folding engine 140 additionally presses the fold line formed in the sheet having been folded, when the sheet is conveyed from the folding engine 130. The sheet having been additionally pressed by the additional folding engine 140 is ejected into the paper ejection tray 170 or conveyed to a post-processing unit for post-processing such as stapling, punching, or bookbinding.

The ADF 160 is provided in the scanner unit 5, and the document is automatically conveyed to the scanner engine 150 as a document reading unit. The scanner engine 150 is provided in the scanner unit 5, the scanner engine 150 is the document reading unit including a photoelectric conversion element for converting optical information to electric signals, the document automatically conveyed by the ADF 160 or the document set on a document glass is optically scanned and read by the scanner engine 150, and image information is generated. The document automatically conveyed by the ADF 160 and read by the scanner engine 150 is ejected into the paper ejection tray 170.

The display panel 180 is an output interface used for visual display of a status of the image forming apparatus 1, and is also an input interface used as a touch panel for direct operation of the image forming apparatus 1 or for information input to the image forming apparatus 1 by the user. That is, the display panel 180 includes a function of displaying an image for receiving user's operation. The display panel 180 includes the LCD 60 and the operation unit 70 illustrated in FIG. 2.

The network I/F 190 is an interface allowing the image forming apparatus 1 to communicate with another device such as an administrator terminal through a network, and employs an interface, such as Ethernet (registered trademark), universal serial bus (USB) interface, Bluetooth (registered trademark), wireless fidelity (Wi-Fi), or FeliCa (registered trademark). The network I/F 190 includes the I/F 50 illustrated in FIG. 2.

The controller 100 includes a combination of software and hardware. Specifically, the controller 100 includes the hardware such as an integrated circuit, and the software control unit configured so that the CPU 10 performs calculation according to control programs such as firmware stored in the non-volatile storage medium such as the ROM 30 or the HDD 40, and loaded in the RAM 20. The controller 100 functions as a control unit for wholly controlling the image forming apparatus 1.

The main control unit 101 controls each unit of the controller 100, and gives an instruction to each unit of the controller 100. Further, the main control unit 101 controls the input/output control unit 103, and accesses another device through the network I/F 190 and the network. The engine control unit 102 controls or drives a drive unit, such as the print engine 120, the folding engine 130, the additional folding engine 140, or the scanner engine 150. The input/output control unit 103 inputs signals or instructions input through the network I/F 190 and the network to the main control unit 101.

The image processing unit 104 generates the drawing information based on document data or image data included in an input print job, according to the control of the main control unit 101. This drawing information is data such as CMYK bitmap data, and is used to draw an image to be formed in image forming operation by the print engine 120 as the image forming portion. Further, the image processing unit 104 processes imaging data input from the scanner engine 150, and generates the image data. This image data represents information, as a resultant of scanner operation, stored in the image forming apparatus 1 or transmitted to another device through the network I/F 190 and the network. The operation display control unit 105 displays information on the display panel 180 or reports information input through the display panel 180 to the main control unit 101.

Next, exemplary operations of the folding unit 3 and the additional folding unit 4 according to the present embodiment during folding and additional folding will be described with reference to FIGS. 4 to 6. FIGS. 4A to 4C, 5A to 5C, and 6A to 6C are cross-sectional views of the folding unit 3 and the additional folding unit 4 according to the present embodiment, viewed in a direction perpendicular to the sheet conveying direction, illustrating the folding unit 3 and the additional folding unit 4 performing folding and additional folding, respectively. It is noted that operation of each operation unit described below is controlled by the main control unit 101 and the engine control unit 102.

Figure 4A:
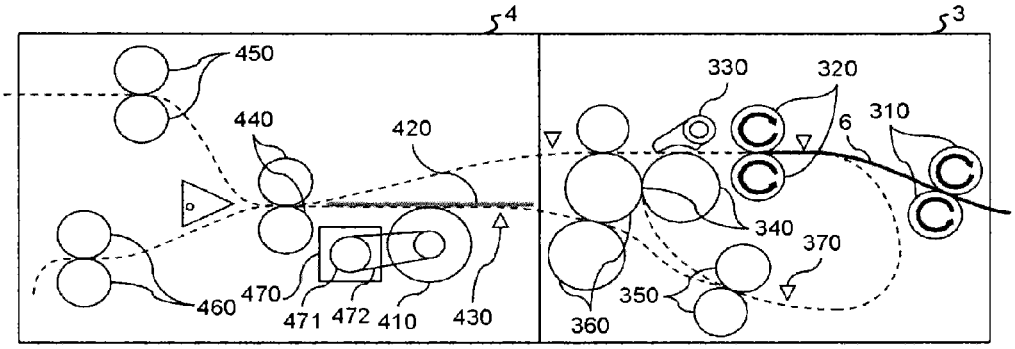
FIGS. 4A to 4C are cross-sectional views of a folding unit and an additional folding unit according to an embodiment of the present invention, viewed in a direction perpendicular to a sheet conveying direction, illustrating the folding unit and the additional folding unit performing folding and additional folding, respectively.

In folding operation of the folding unit 3 in the image forming apparatus 1 according to the present embodiment, first, as illustrated in FIG. 4A, when the sheet 6 is conveyed from the image forming unit 2 to the folding unit 3 by an inlet roller pair 310, the folding unit 3 conveys the sheet 6 on which the image has been formed to a conveying path-switching clawclaw 330, while calculating timing of the conveyance by correcting registration in a direction perpendicular to the sheet conveying direction by a registration roller pair 320.

Figure 4B:
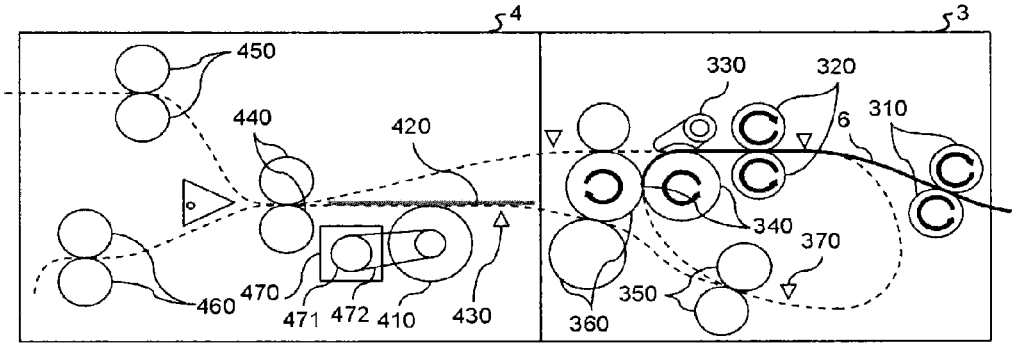
Figure 4C:
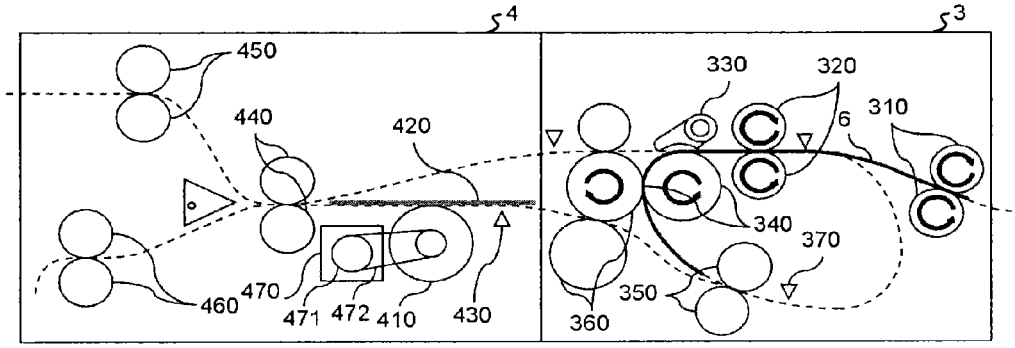

As illustrated in FIG. 4B, in the folding unit 3, the sheet 6 conveyed to the conveying path-switching clawclaw 330 by the registration roller pair 320 is guided to a first folding and conveying roller pair 340 by the conveying path-switching clawclaw 330. As illustrated in FIG. 4C, in the folding unit 3, the sheet 6 guided to the first folding and conveying roller pair 340 by the conveying path-switching clawclaw 330 is conveyed to a second folding and conveying roller pair 350 by the first folding and conveying roller pair 340.

Figure 5A:
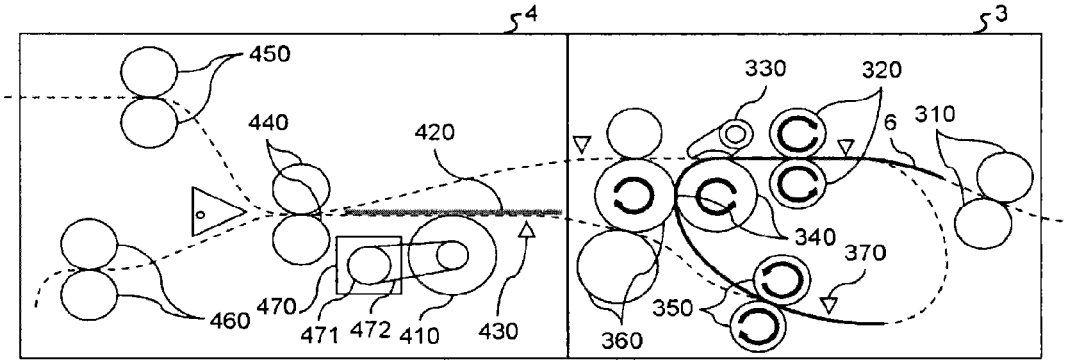
FIGS. 5A to 5C are cross-sectional views of a folding unit and an additional folding unit according to an embodiment of the present invention, viewed in a direction perpendicular to a sheet conveying direction, illustrating the folding unit and the additional folding unit performing folding and additional folding, respectively.
Figure 5B:
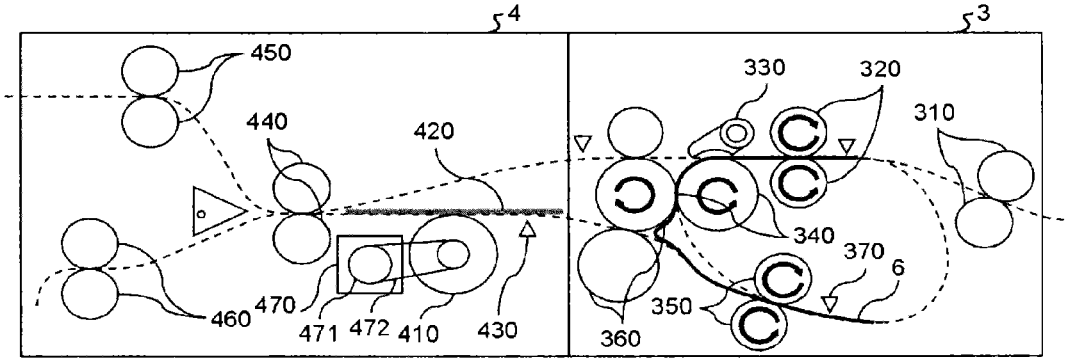

As illustrated in FIG. 5A, in the folding unit 3, the sheet 6 conveyed to the second folding and conveying roller pair 350 by the first folding and conveying roller pair 340 is further conveyed by the first folding and conveying roller pair 340 and the second folding and conveying roller pair 350. As illustrated in FIG. 5B, in the folding unit 3, the second folding and conveying roller pair 350 is reversely rotated, calculating timing for folding the sheet 6 at a predetermined position to make a slack in the sheet 6 at the predetermined position, and while maintaining the slack, the sheet 6 is conveyed to a creasing and conveying roller pair 360 by the first folding and conveying roller pair 340 and the second folding and conveying roller pair 350 so that the slack is not changed in position.

At this time, in the folding unit 3, each unit is controlled by the main control unit 101 and the engine control unit 102 based on a conveying speed of the sheet 6 and sensor information input from the sensor 370, and the timing for folding the sheet 6 is calculated.

Figure 5C:
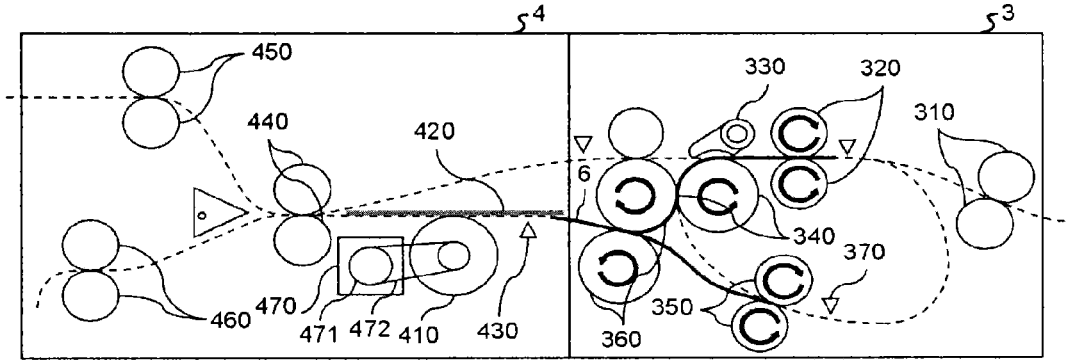

As illustrated in FIG. 5C, in the folding unit 3, the sheet 6 conveyed to the creasing and conveying roller pair 360 by the second folding and conveying roller pair 350 is held at the slack of the sheet 6 by rotating the creasing and conveying roller pair 360 in the conveying direction, therefore, the fold line is made at the predetermined position, and the sheet 6 is conveyed toward a gap between the additional folding roller 410 and a sheet supporting plate 420 of the additional folding unit 4. It is noted that, as illustrated in FIGS. 4A to 4C and 5A to 5C, one of the first folding and conveying roller pair 340 also functions as one of the creasing and conveying roller pair 360, in the present embodiment.

Figure 7:
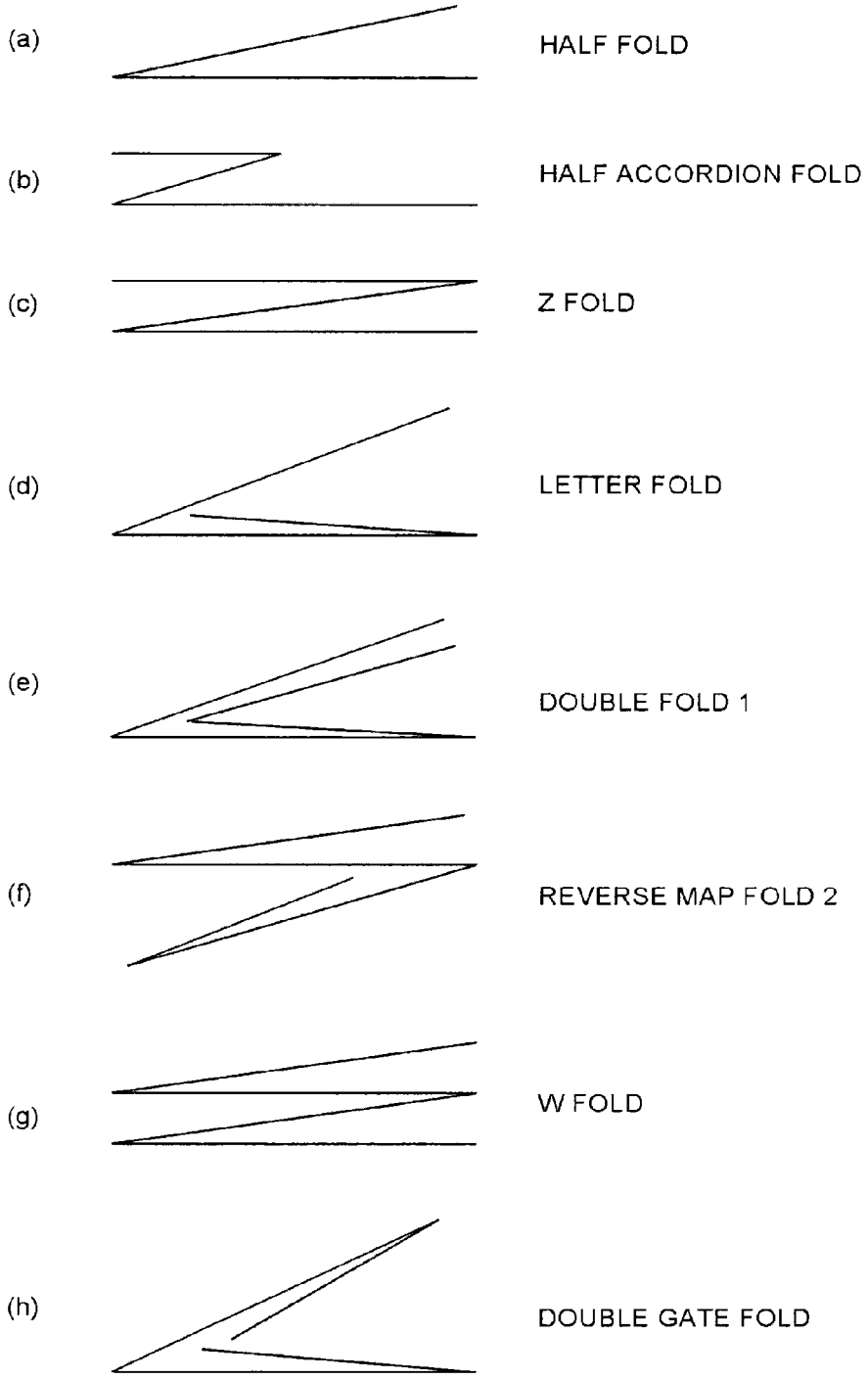
FIG. 7 is a diagram illustrating exemplary shapes (a) to (h) of sheets having been folded by an additional folding unit according to an embodiment of the present invention.

Exemplary folded shapes of the sheets 6 will be illustrated in FIG. 7. FIG. 7 is a diagram illustrating exemplary shapes (a) to (h) of the sheets 6 having been folded by a folding unit 3 according to the present embodiment.

Figure 6A:
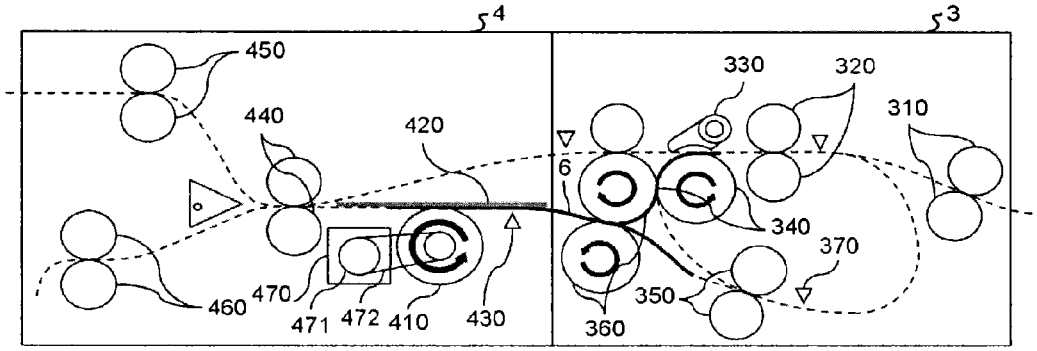
FIGS. 6A to 6C are cross-sectional views of a folding unit and an additional folding unit according to an embodiment of the present invention, viewed in a direction perpendicular to a sheet conveying direction, illustrating the folding unit and the additional folding unit performing folding and additional folding, respectively.

As illustrated in FIG. 6A, in the additional folding unit 4, the sheet 6 conveyed to the gap between the additional folding roller 410 and the sheet supporting plate 420 by the creasing and conveying roller pair 360 is supported by the sheet supporting plate 420 in a pressing direction, the fold line formed in the sheet 6 is pressed while rotating the additional folding roller 410 in the conveying direction, for additional folding. That is, in the present embodiment, the sheet supporting plate 420 functions as a sheet supporting portion.

At this time, in the additional folding unit 4, the main control unit 101 and the engine control unit 102 control each unit based on folding information about a folding method of the folding unit 3, sheet information about the size of the sheet 6, the conveying speed of the sheet 6, and the rotation speed of the additional folding roller 410, and timing for pressing the sheet 6 is calculated. Alternatively, at this time, in the additional folding unit 4, the main control unit 101 and the engine control unit 102 control each unit based on the conveying speed of the sheet 6, the rotation speed of the additional folding roller 410, and sensor information input from a sensor 430, and the timing for pressing the sheet 6 is calculated.

It is note that, as illustrated in FIGS. 4A to 4C, 5A to 5C, and 6A to 6C, the additional folding roller 410 is driven by a driving force of an additional folding roller-driving motor 471, transmitted from an additional folding roller-driving device 470 through a timing belt 472, and the creasing and conveying roller pair 360 is driven by a creasing and conveying roller-driving motor. The driving of the additional folding roller-driving motor 471 and the driving of the creasing and conveying roller-driving motor are controlled by the engine control unit 102.

As described above, in the additional folding unit 4, when the fold line formed in the sheet 6 is pressed by the additional folding roller 410 for additional folding, the sheet 6 having been additionally pressed is conveyed to an additional folding and conveying roller pair 440.

Figure 6B:
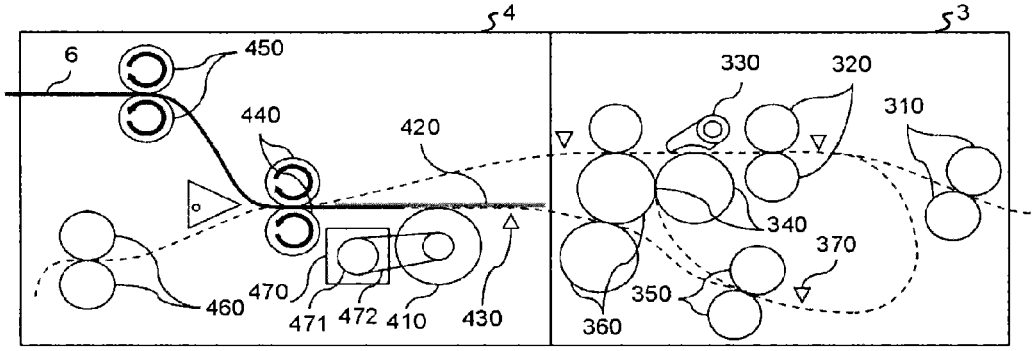

As illustrated in FIG. 6B, in the additional folding unit 4, in order to directly eject the sheet 6 having been additionally pressed when the sheet 6 is conveyed from the gap between the additional folding roller 410 and the sheet supporting plate 420, the sheet 6 is conveyed to a paper ejection roller pair 450 by the additional folding and conveying roller pair 440. In additional folding unit 4, the sheet 6 having been additionally pressed is ejected into the paper ejection tray 170 by the paper ejection roller pair 450, when the sheet 6 is conveyed to the paper ejection roller pair 450 by the additional folding and conveying roller pair 440. Thus, in the folded image forming apparatus 1 according to the present embodiment, the folding operation and the additional folding operation are finished.

Figure 6C:
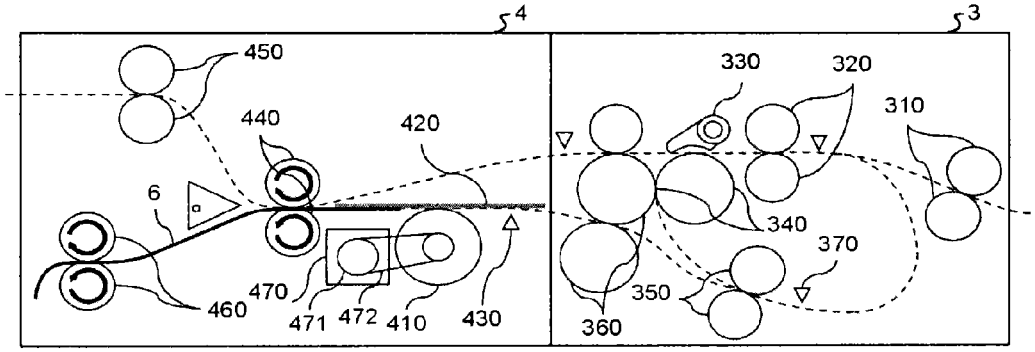

Meanwhile, as illustrated in FIG. 6C, in the additional folding unit 4, in order to subject the sheet 6 having been additionally pressed to the post-processing such as stapling, punching, or bookbinding when the sheet 6 is conveyed from the gap between the additional folding roller 410 and the sheet supporting plate 420, the sheet 6 is conveyed to a post-processing conveying roller pair 460 by the additional folding and conveying roller pair 440. In the additional folding unit 4, the sheet 6 having been additionally pressed is conveyed to the post-processing unit by the post-processing conveying roller pair 460, when the sheet 6 is conveyed to the post-processing conveying roller pair 460 by the additional folding and conveying roller pair 440. Thus, in the folded image forming apparatus 1 according to the present embodiment, the folding operation and the additional folding operation are finished.

Next, exemplary structures of the additional folding roller 410 according to the present embodiment will be described with reference to FIGS. 8 to 11 and 12 to 15.

Figure 8:
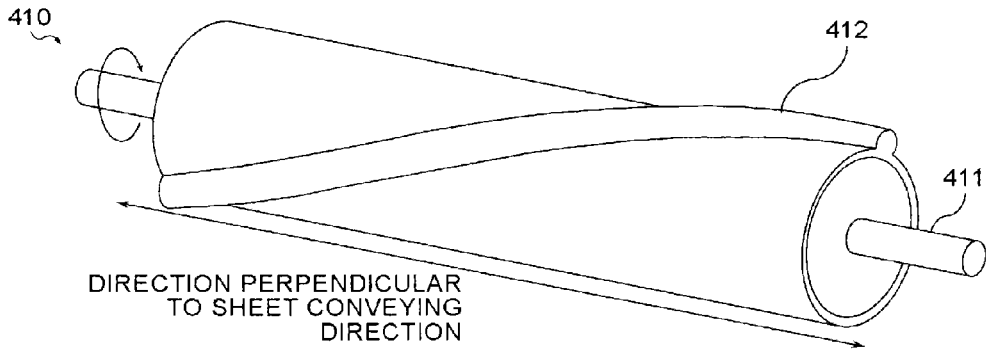
FIG. 8 is a perspective view illustrating an additional folding roller according to an embodiment of the present invention, viewed obliquely downward from a side in a direction perpendicular to a sheet conveying direction.
Figure 9:
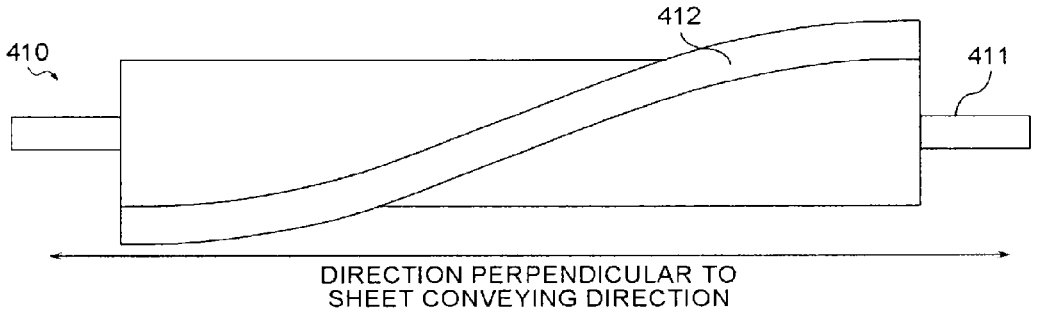
FIG. 9 is a front view illustrating an additional folding roller according to an embodiment of the present invention, viewed in a sheet conveying direction.
Figure 10:
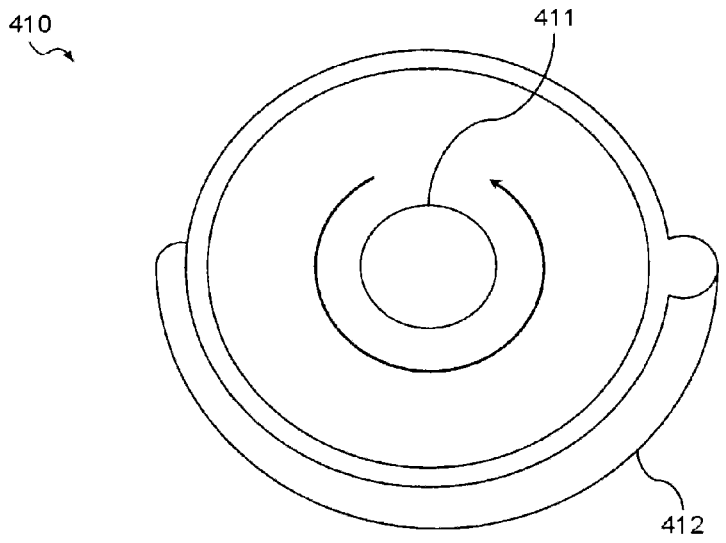
FIG. 10 is a side view illustrating an additional folding roller according to an embodiment of the present invention, viewed in a direction perpendicular to a sheet conveying direction.
Figure 11:
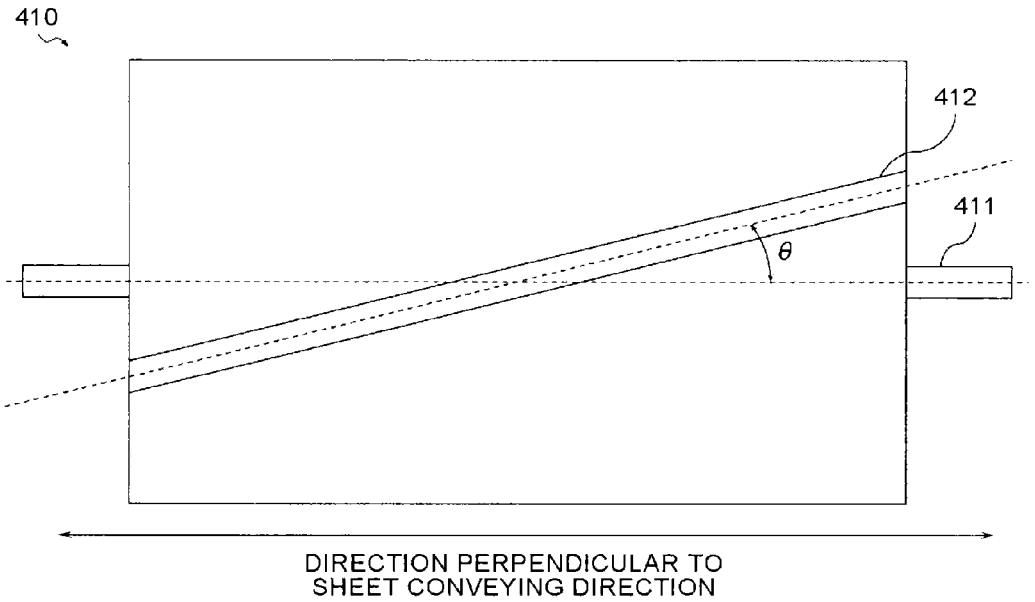
FIG. 11 is a development view illustrating an additional folding roller according to an embodiment of the present invention.

First, a first exemplary structure of the additional folding roller 410 according to the present embodiment will be described with reference to FIGS. 8 to 11. FIG. 8 is a perspective view illustrating the additional folding roller 410 according to the present embodiment, viewed obliquely downward from a side in a direction perpendicular to the sheet conveying direction. FIG. 9 is a front view illustrating the additional folding roller 410 according to the present embodiment, viewed in the sheet conveying direction. FIG. 10 is a side view illustrating the additional folding roller 410 according to the present embodiment, viewed in a direction perpendicular to the sheet conveying direction. FIG. 11 is a development view illustrating the additional folding roller 410 according to the present embodiment.

As illustrated in FIGS. 8 to 11, in the first exemplary structure, the additional folding roller 410 according to the present embodiment is configured so that an additional folding roller rotation shaft 411 rotates about an axis penetrating in a direction perpendicular to the sheet conveying direction, the additional folding roller rotation shaft 411 is defined as the rotation axis, the additional folding roller 410 has a surface on which the projection portion 412 having a projecting shape is disposed to have a helical shape about the rotation axis with a fixed angular difference θ between the projection portion 412 and the additional folding roller rotation shaft 411. The additional folding roller 410 according to the present embodiment is configured as described above, so that only part of the projection portion 412 makes contact with the fold line formed in the sheet 6.

Therefore, the additional folding roller 410 according to the present embodiment sequentially presses the fold line formed in the sheet 6 in a direction perpendicular to the sheet conveying direction by rotating about the additional folding roller rotation shaft 411 as the rotation axis. That is, in the present embodiment, the additional folding roller 410 functions as a pressing portion, and the projection portion 412 functions as a pressing unit.

Accordingly, the additional folding unit 4 according to the present embodiment can apply the concentrated pressing force to the whole area of the fold line for a short time. Therefore, the image forming apparatus according to the present embodiment can apply the sufficient pressing force to the fold line, with a reduced load on the additional folding roller rotation shaft 411, without reducing productivity. Therefore, the additional folding unit 4 according to the present embodiment can provide a small and low-cost additional folding device having high productivity.

Figure 12:
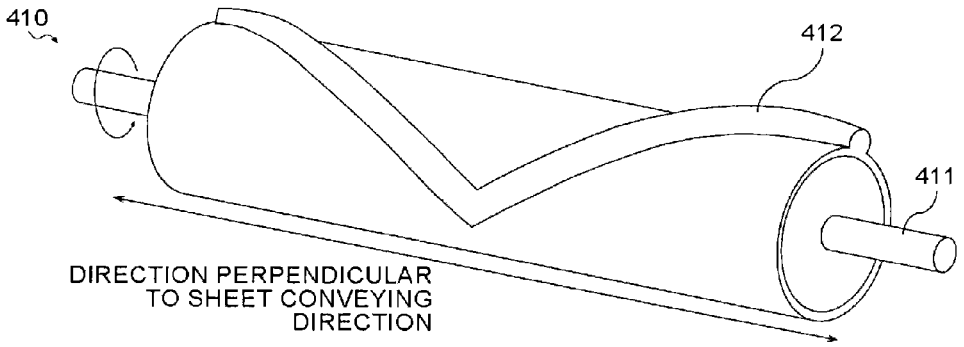
FIG. 12 is a perspective view illustrating an additional folding roller according to an embodiment of the present invention, viewed obliquely downward from a side in a direction perpendicular to a sheet conveying direction.
Figure 13:
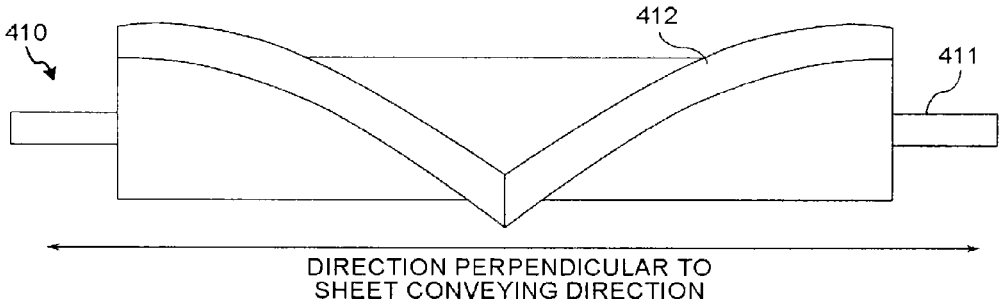
FIG. 13 is a front view illustrating an additional folding roller according to an embodiment of the present invention, viewed in a sheet conveying direction.
Figure 14:
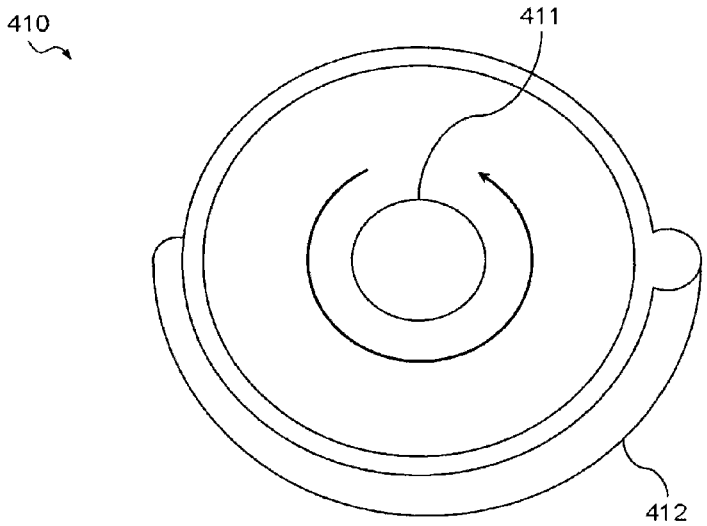
FIG. 14 is a side view illustrating an additional folding roller according to an embodiment of the present invention, viewed in a direction perpendicular to a sheet conveying direction.
Figure 15:
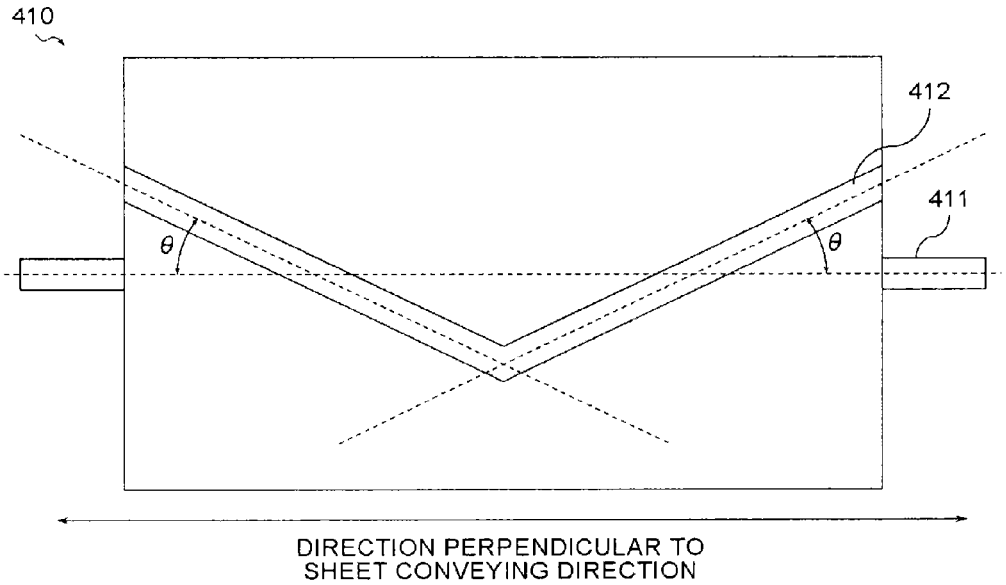
FIG. 15 is a development view illustrating an additional folding roller according to an embodiment of the present invention.
Figure 16:
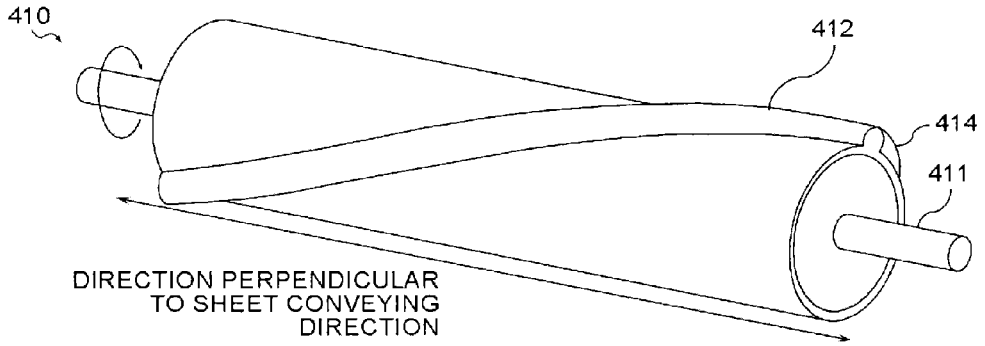
FIG. 16 is a perspective view illustrating an additional folding roller according to an embodiment of the present invention, viewed obliquely downward from a side in a direction perpendicular to a sheet conveying direction.
Figure 17:
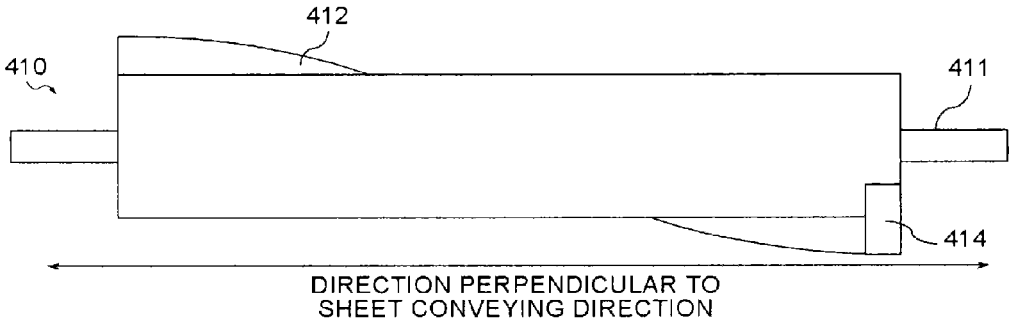
FIG. 17 is a front view illustrating an additional folding roller according to an embodiment of the present invention, viewed in a sheet conveying direction.
Figure 18:
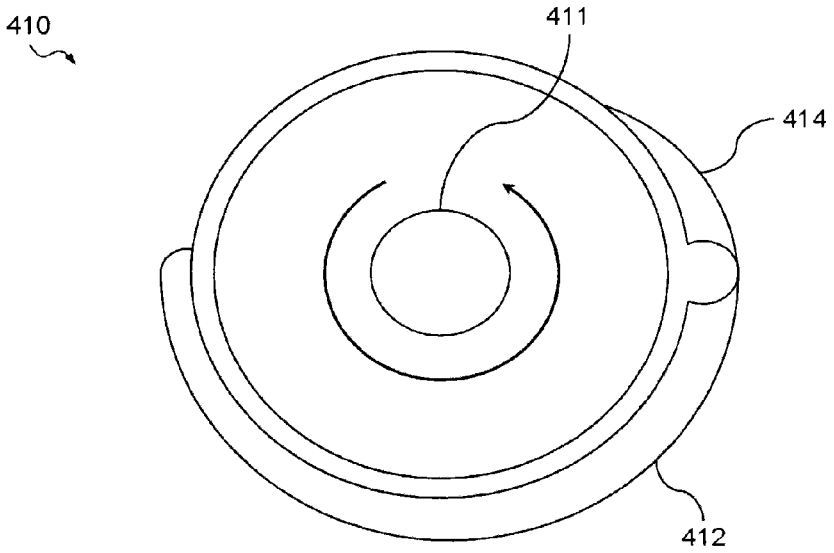
FIG. 18 is a side view illustrating an additional folding roller according to an embodiment of the present invention, viewed in a direction perpendicular to a sheet conveying direction.
Figure 19:
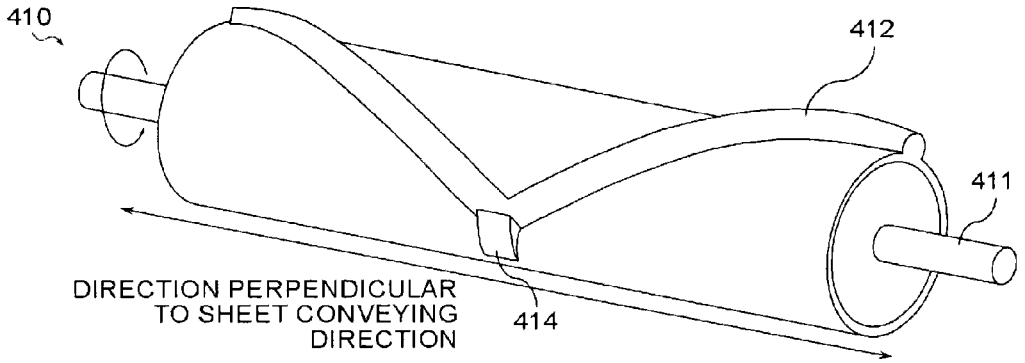
FIG. 19 is a perspective view illustrating an additional folding roller according to an embodiment of the present invention, viewed obliquely downward from a side in a direction perpendicular to a sheet conveying direction.
Figure 20:
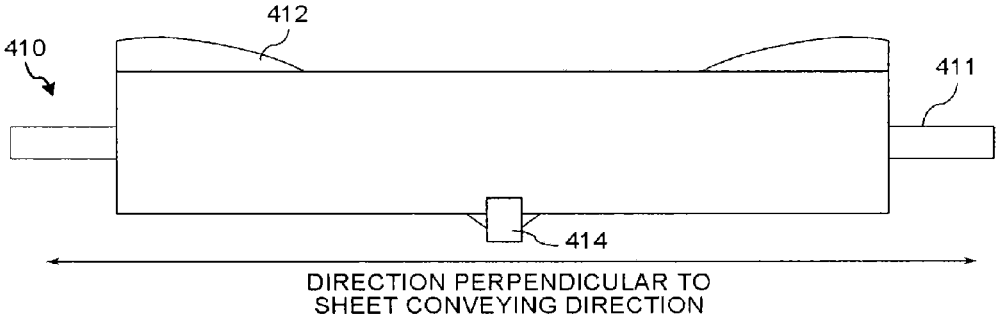
FIG. 20 is a front view illustrating an additional folding roller according to an embodiment of the present invention, viewed in a sheet conveying direction.
Figure 21:
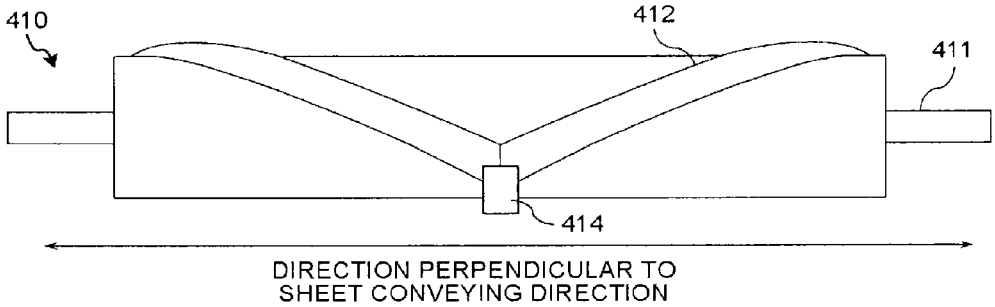
FIG. 21 is a front view illustrating an additional folding roller according to an embodiment of the present invention, viewed in a sheet conveying direction.
Figure 22:
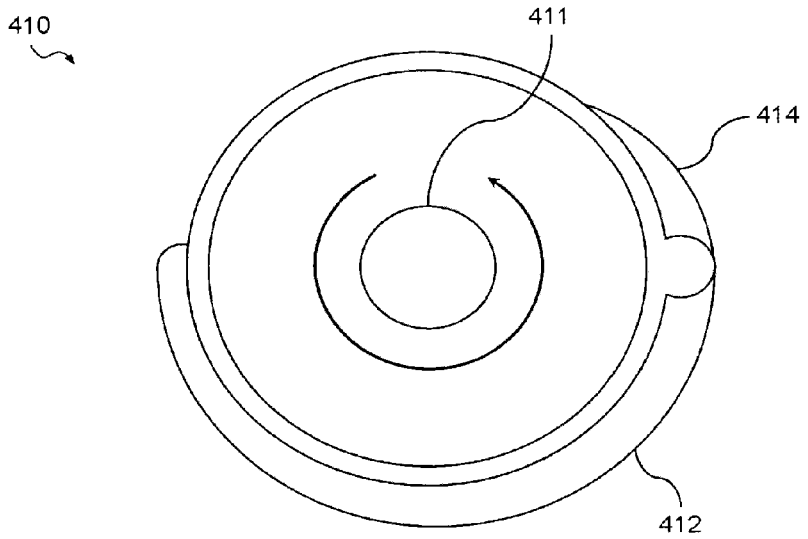
FIG. 22 is a side view illustrating an additional folding roller according to an embodiment of the present invention, viewed in a direction perpendicular to a sheet conveying direction.

Next, a second exemplary structure of the additional folding roller 410 according to the present embodiment will be described with reference to FIGS. 12 to 15. FIG. 12 is a perspective view illustrating an additional folding roller 410 according to the present embodiment, viewed obliquely downward from a side in a direction perpendicular to the sheet conveying direction. FIG. 13 is a front view illustrating an additional folding roller 410 according to the present embodiment, viewed in the sheet conveying direction. FIG. 14 is a side view illustrating an additional folding roller 410 according to the present embodiment, viewed in a direction perpendicular to the sheet conveying direction. FIG. 15 is a development view illustrating an additional folding roller 410 according to the present embodiment.

As illustrated in FIGS. 12 to 15, in the second exemplary structure, the additional folding roller 410 according to the present embodiment is configured so that the additional folding roller 410 has a surface on which the projection portion 412 having a projecting shape is disposed to have a helical shape about the rotation axis with a fixed angular difference θ between the projection portion 412 and the additional folding roller rotation shaft 411, and to have a V-shape symmetrical with respect to a center of the additional folding roller 410 in a direction perpendicular to the sheet conveying direction. The additional folding roller 410 according to the present embodiment is configured as described above, so that two parts of the projection portion 412 simultaneously make contact with the fold line formed in the sheet 6.

Therefore, the additional folding roller 410 according to the present embodiment sequentially presses the fold line formed in the sheet 6 in the sheet conveying direction and a direction perpendicular to the sheet conveying direction, by rotating about the additional folding roller rotation shaft 411 as the rotation axis.

Accordingly, the additional folding unit 4 according to the present embodiment can apply the concentrated pressing force to the whole area of the fold line for a short time, although the pressing force is reduced as compared with the structure as illustrated in FIGS. 8 to 11. Therefore, the image forming apparatus according to the present embodiment can apply the sufficient pressing force to the fold line, with improved productivity and the reduced load on the additional folding roller rotation shaft 411. Therefore, the additional folding unit 4 according to the present embodiment can provide a small and low-cost additional folding device having higher productivity.

However, in the additional folding unit 4 according to the present embodiment, when the additional folding roller 410 is configured as described above, the projection portion 412 formed on the surface abuts on the sheet 6, a concentrated pressing force is rapidly applied to an abutment part, the impact sound is generated, and a noise may be generated outside the device.

As illustrated in FIGS. 16 to 18 or 19 to 22, the additional folding roller 410 according to the present embodiment is configured so that the projection portion 412 formed on the surface of the additional folding roller 410 has an distal end abutting on the sheet 6 at first, and the distal end is provided with an impact absorbing member 414 for reducing impact upon collision with the sheet 6. As illustrated in FIGS. 16 to 18 or 19 to 22, the impact absorbing member 414 is provided to have an inclination angle at the distal end of the projection portion 412, and the inclination angle is configured to be reduced, or gentle, relative to the surface of the additional folding roller 410.

Figure 23A:
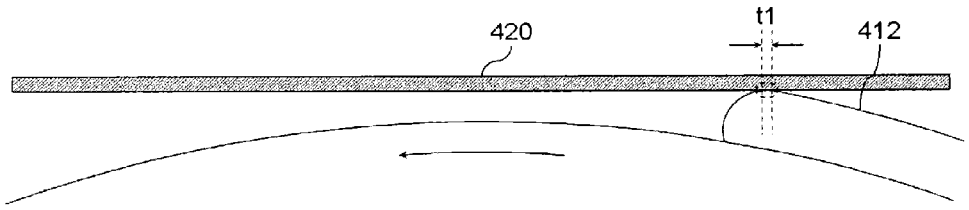
FIGS. 23A and 23B are side views of an additional folding roller according to an embodiment of the present invention, viewed in a direction perpendicular to a sheet conveying direction, illustrating the additional folding roller abutting on a sheet supporting plate.
Figure 23B:
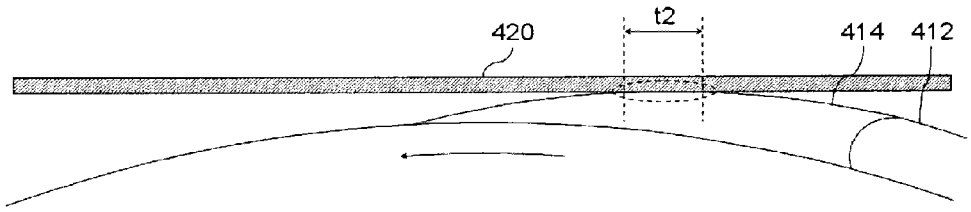
Figure 24:
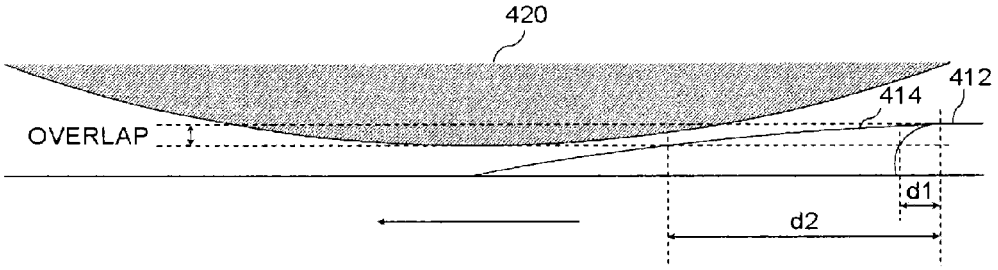
FIG. 24 is a side view of an additional folding roller according to an embodiment of the present invention, viewed in a direction perpendicular to a sheet conveying direction, illustrating the additional folding roller abutting on a sheet supporting plate, developed in a peripheral direction.

Here, effects of the impact absorbing member 414 provided at the additional folding roller 410 will be described with reference to FIGS. 23A, 23B, and 24. FIGS. 23A and 23B are side views of the additional folding roller 410 according to the present embodiment, viewed in a direction perpendicular to the sheet conveying direction, illustrating the additional folding roller 410 abutting on the sheet supporting plate 420. FIG. 24 is a side view of an additional folding roller 410 according to the present embodiment, viewed in a direction perpendicular to the sheet conveying direction, illustrating the additional folding roller 410 abutting on the sheet supporting plate 420, developed in a peripheral direction.

As illustrated in FIG. 23A, when the additional folding roller 410 is not provided with the impact absorbing member 414, a contact width upon collision of the distal end of the projection portion 412 with the sheet supporting plate 420 in the sheet conveying direction is defined as t1. On the other hand, as illustrated in FIG. 23B, when the distal end of the projection portion 412 is provided with the impact absorbing member 414, a contact width upon collision of an distal end of the impact absorbing member 414 with the sheet supporting plate 420 in the sheet conveying direction is defined as t2. In this case, the following relationship is satisfied: t2>t1.

Further, as illustrated in FIG. 24, when the additional folding roller 410 is not provided with the impact absorbing member 414, an overlapping width of the projection portion 412 with the sheet supporting plate 420 in the sheet conveying direction is defined as d1. On the other hand, as illustrated in FIG. 24, when the additional folding roller 410 is provided with the impact absorbing member 414, an overlapping width of the impact absorbing member 414 with the sheet supporting plate 420 in the sheet conveying direction is defined as d2. In this case, the following relationship is satisfied: d2>d1.

As described above, in the additional folding unit 4 according to the present embodiment, the impact absorbing member 414 provided on the additional folding roller 410 increases a contact area with the sheet supporting plate 420 upon collision with the sheet supporting plate 420, compared with the additional folding roller 410 not provided with the impact absorbing member 414, so that the impact upon collision is widely dispersed. Accordingly, the additional folding unit 4 according to the present embodiment can reduce the impact sound generated upon abutment of the additional folding roller 410 on the sheet 6.

Therefore, in the additional folding unit 4 according to the present embodiment, the fold line formed in the sheet 6 can be efficiently pressed at low cost, and the noise generated upon pressing the fold line can be reduced.

Next, an exemplary operation during additional folding by the additional folding unit 4 according to the present embodiment will be described in detail with reference to FIGS. 25A to 25F, 26A to 26F, and 27. FIGS. 25A to 25F and 26A to 26F are cross-sectional views of the additional folding roller 410 and the sheet supporting plate 420, viewed in a direction perpendicular to the sheet conveying direction, illustrating the additional folding roller 410 and the sheet supporting plate 420 during additional folding performed by the additional folding unit 4 according to the present embodiment. FIG. 27 is a graph illustrating chronological change of a conveying speed of the sheet 6 and a rotation speed of the additional folding roller 410 during additional folding performed by the additional folding unit 4 according to the present embodiment. It is noted that FIGS. 25A to 25F, 26A to 26F, and 27 illustrate an example of additional folding of the sheet 6 formed with a Z-fold having a first fold line 6*a* and a second fold line 6*b*. Further, operation of each operation unit described below is controlled by the main control unit 101 and the engine control unit 102.

Figure 25A:
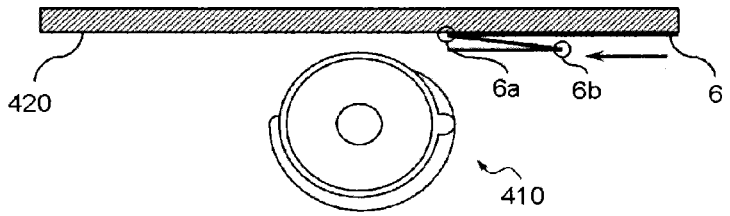
FIGS. 25A to 25F are cross-sectional views of an additional folding roller and a sheet supporting plate, viewed in a direction perpendicular to a sheet conveying direction, illustrating the additional folding roller and the sheet supporting plate during additional folding performed by an additional folding unit according to the present embodiment.
Figure 25B:
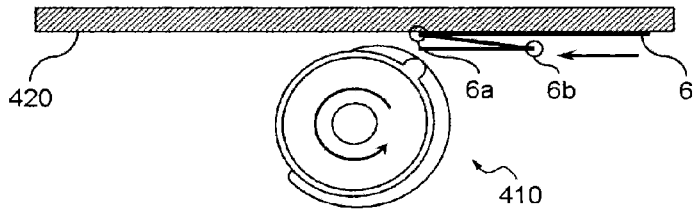

In the additional folding unit 4 according to the present embodiment, when conveyance of the sheet 6 is started, as illustrated in FIGS. 25A and 27, timing of abutment of the additional folding roller 410 on the first fold line 6*a* formed in the sheet 6 is calculated, and the rotation of the additional folding roller 410 is started before the sheet 6 is stopped, as illustrated in FIG. 25B and FIG. 27. It is because a time lag is reduced between the start of the rotation of the additional folding roller 410 and the abutment of the additional folding roller 410 on the sheet 6 that the additional folding unit 4 according to the present embodiment starts the rotation of the additional folding roller 410 before the sheet 6 is stopped, as described above. Therefore, the additional folding unit 4 according to the present embodiment has improved productivity.

At this time, the additional folding unit 4 is configured so that the main control unit 101 and the engine control unit 102 control each unit based on the folding information about the folding method in the folding unit 3, the sheet information about the size of the sheet 6, the conveying speed of the sheet 6, and the rotation speed of the additional folding roller 410, and timing of abutment of the additional folding roller 410 on the first fold line 6*a* formed in the sheet 6 is calculated. Alternatively, at this time, the additional folding unit 4 is configured so that the main control unit 101 and the engine control unit 102 control each unit based on the conveying speed of the sheet 6, the rotation speed of the additional folding roller 410, and the sensor information input from the sensor 430, and the timing of abutment of the additional folding roller 410 on the first fold line 6*a* formed in the sheet 6 is calculated.

Figure 25C:
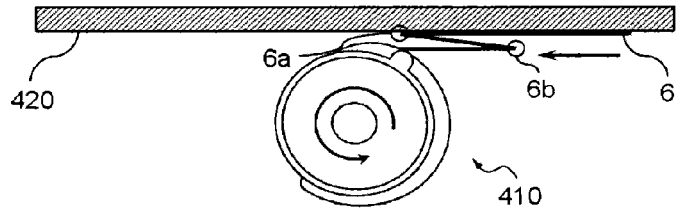
Figure 25D:
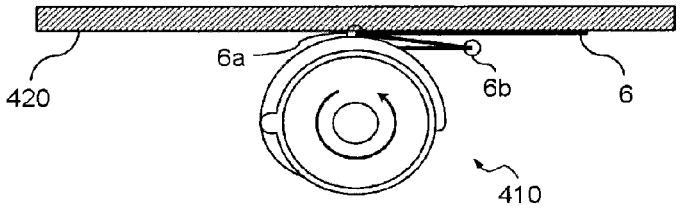

As illustrated in FIGS. 25C and 27, in the additional folding unit 4, when the additional folding roller 410 starts to abut on the first fold line 6*a* formed in the sheet 6, and pressing of the first fold line 6*a* is started. As illustrated in FIGS. 25D and 27, in the additional folding unit 4, when the sheet 6 is conveyed until the first fold line 6*a* is positioned immediately above the additional folding roller rotation shaft 411, the conveyance of the sheet 6 is completely stopped while the rotation of the additional folding roller 410 is continued, and pressing of the first fold line 6*a* formed in the sheet 6 is continued.

Figure 25E:
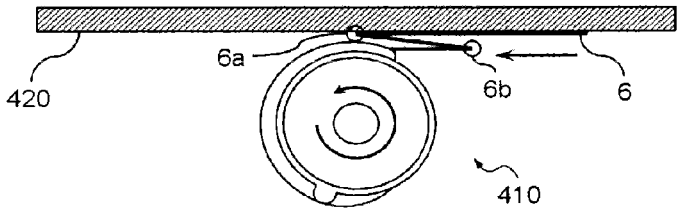

As illustrated in FIGS. 25E and 27, in the additional folding unit 4, timing of separation of the additional folding roller 410 from the sheet 6 is calculated, and the conveyance of the sheet 6 is started before the additional folding roller 410 is stopped. It is because a time lag is reduced between the separation of the additional folding roller 410 from the sheet 6 and complete stopping of the additional folding roller 410 that additional folding unit 4 according to the present embodiment starts the conveyance of the sheet 6 before the additional folding roller 410 is stopped, as described above. Therefore, the additional folding unit 4 according to the present embodiment has improved productivity.

At this time, the additional folding unit 4 is configured so that the main control unit 101 and the engine control unit 102 control each unit based on the rotation speed of the additional folding roller 410, and timing of separation of the additional folding roller 410 from the sheet 6 is calculated.

The conveyance of the sheet 6 can be started while pressing the sheet 6, as illustrated in FIGS. 25E and 27, only when the sheet 6 is conveyed by a conveying belt moving in the same direction as the rotation direction of the additional folding roller 410 in synchronization with the rotation of the additional folding roller 410. That is because when the additional folding roller 410 presses the sheet 6, the sheet 6 is pressed against the sheet supporting plate 420, and friction between the sheet 6 and the sheet supporting plate 420 may break the sheet 6 without the conveying belt moved in the same direction as the rotation direction of the additional folding roller 410.

Figure 25F:
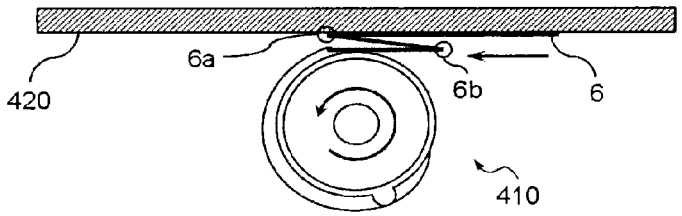
Figure 26A:
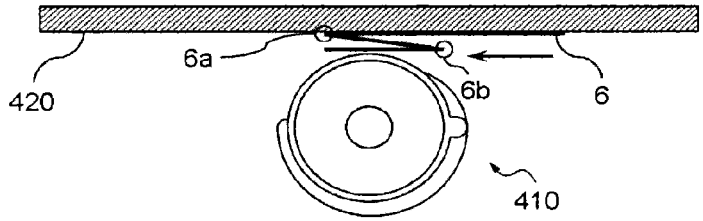
FIGS. 26A to 26F are cross-sectional views of an additional folding roller and a sheet supporting plate, viewed in a direction perpendicular to a sheet conveying direction, illustrating the additional folding roller and the sheet supporting plate during additional folding performed by an additional folding unit according to the present embodiment.
Figure 26B:
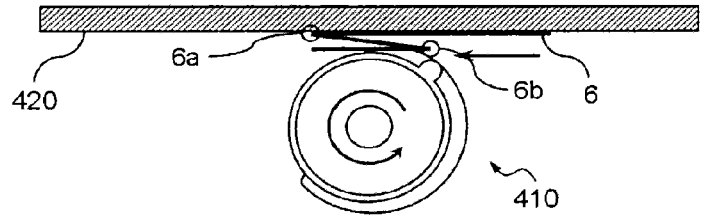
Figure 27:
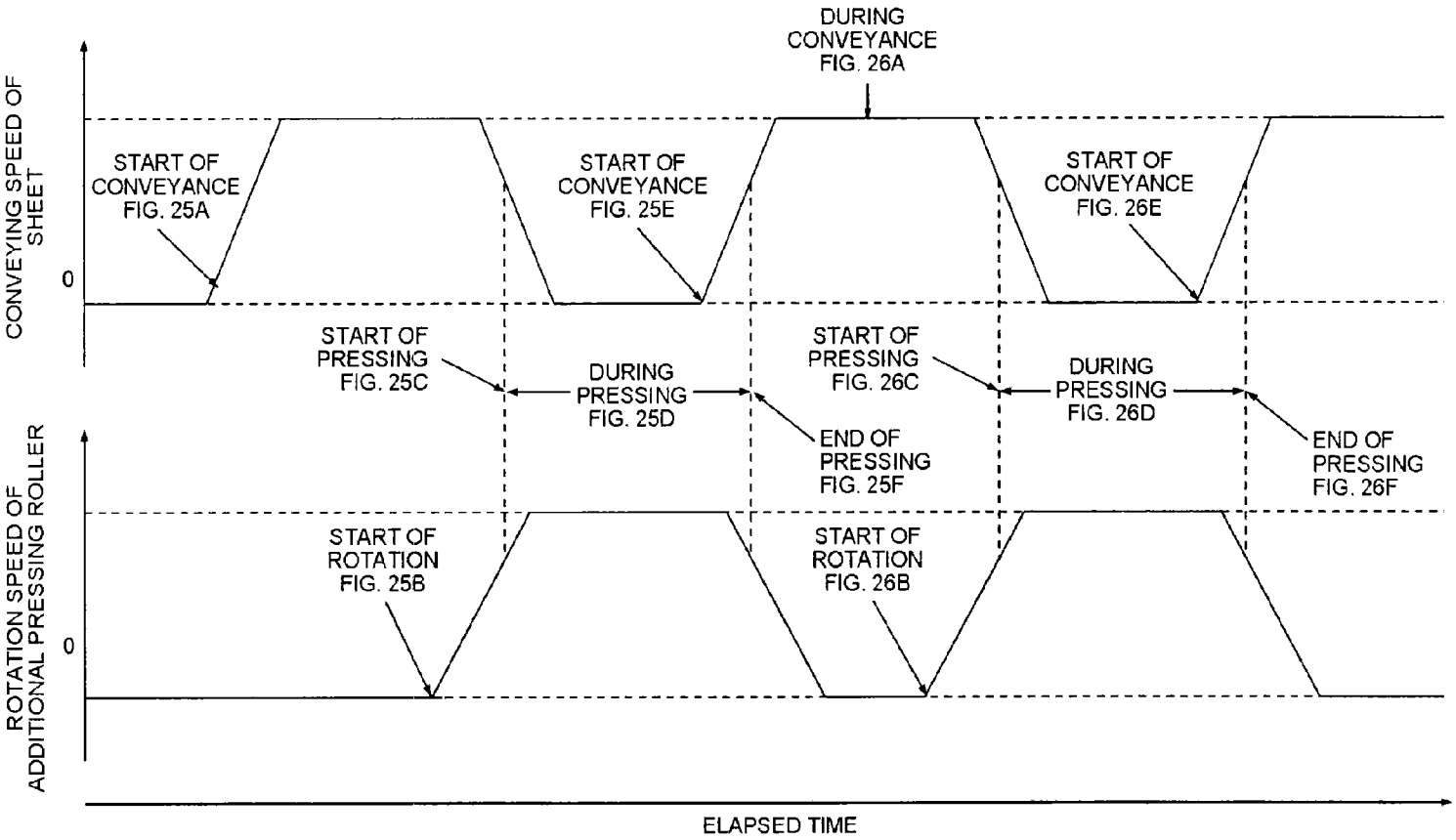
FIG. 27 is a graph illustrating chronological change of a conveying speed of a sheet and a rotation speed of an additional folding roller during additional folding performed by an additional folding unit according to the present embodiment.

In the additional folding unit 4, when the sheet 6 separated from the additional folding roller 410 is conveyed, as illustrated in FIGS. 25F and 27, the rotation of the additional folding roller 410 is stopped, as illustrated in FIGS. 26A and 27, and the timing of abutment of the additional folding roller 410 on the first fold line 6*a* formed in the sheet 6 is calculated, and then the rotation of the additional folding roller 410 is started before the sheet 6 is stopped, as illustrated in FIGS. 26B and 27. It is because a time lag is reduced between the start of the rotation of the additional folding roller 410 and the abutment of the additional folding roller 410 on the sheet 6 that the additional folding unit 4 according to the present embodiment starts the rotation of the additional folding roller 410 before the sheet 6 is stopped, as described above. Therefore, the additional folding unit 4 according to the present embodiment has improved productivity.

At this time, the additional folding unit 4 is configured so that the main control unit 101 and the engine control unit 102 control each unit based on the folding information about the folding method in the folding unit 3, the sheet information about the size of the sheet 6, the conveying speed of the sheet 6, and the rotation speed of the additional folding roller 410, and the timing of abutment of the additional folding roller 410 on the second fold line 6*b* formed in the sheet 6 is calculated. Alternatively, at this time, the additional folding unit 4 is configured so that the main control unit 101 and the engine control unit 102 control each unit based on the conveying speed of the sheet 6, the rotation speed of the additional folding roller 410, and the sensor information input from the sensor 430, and the timing of abutment of the additional folding roller 410 on the second fold line 6*b* formed in the sheet 6 is calculated.

Figure 26C:
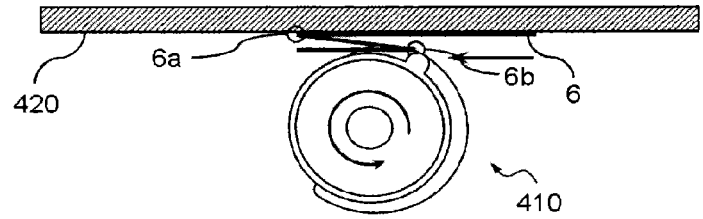
Figure 26D:
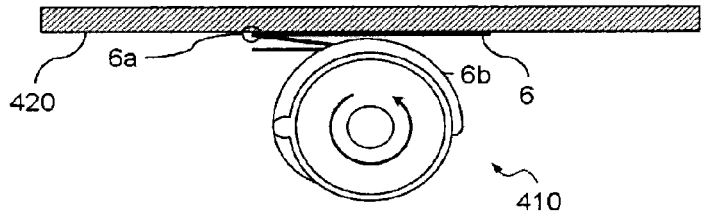

As illustrated in FIGS. 26C and 27, in the additional folding unit 4, when the additional folding roller 410 starts to abut on the first fold line 6*a* formed in the sheet 6, and pressing of the first fold line 6*a* is started. As illustrated in FIGS. 26D and 27, in the additional folding unit 4, when the sheet 6 is conveyed until the second fold line 6*b* is positioned immediately above the additional folding roller rotation shaft 411, the conveyance of the sheet 6 is completely stopped while the rotation of the additional folding roller 410 is continued, and pressing of the first fold line 6*a* formed in the sheet 6 is continued.

Figure 26E:
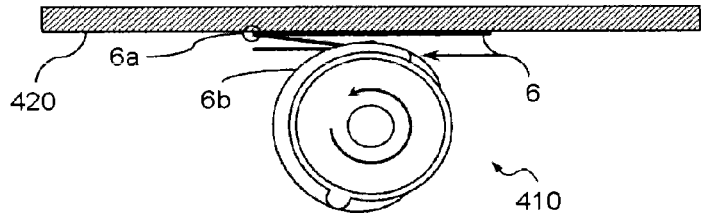

Then, as illustrated in FIGS. 26E and 27, in the additional folding unit 4, the timing of separation of the additional folding roller 410 from the sheet 6 is calculated, and the conveyance of the sheet 6 is started before the additional folding roller 410 is stopped. It is because a time lag is reduced between the separation of the additional folding roller 410 from the sheet 6 and complete stopping of the additional folding roller 410 that additional folding unit 4 according to the present embodiment starts the conveyance of the sheet 6 before the additional folding roller 410 is stopped, as described above. Therefore, the additional folding unit 4 according to the present embodiment has improved productivity.

At this time, the additional folding unit 4 is configured so that the main control unit 101 and the engine control unit 102 control each unit based on the rotation speed of the additional folding roller 410, and the timing of separation of the additional folding roller 410 from the sheet 6 is calculated.

The conveyance of the sheet 6 can be started while pressing the sheet 6, as illustrated in FIGS. 26E and 27, only when the sheet 6 is conveyed by a conveying belt moving in the same direction as the rotation direction of the additional folding roller 410 in synchronization with the rotation of the additional folding roller 410. That is because when the additional folding roller 410 presses the sheet 6, the sheet 6 is pressed against the sheet supporting plate 420, and friction between the sheet 6 and the sheet supporting plate 420 may break the sheet 6 without the conveying belt moved in the same direction as the rotation direction of the additional folding roller 410.

Figure 26F:
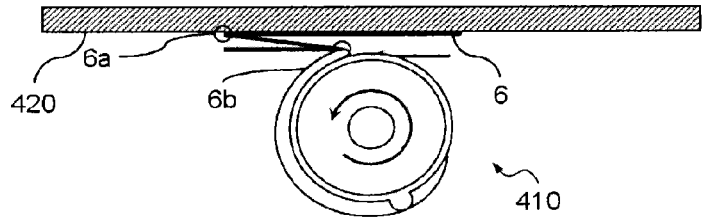

As illustrated in FIGS. 26F and 27, in the additional folding unit 4, the sheet 6 separated from the additional folding roller 410 is conveyed, and the additional folding is finished.

Figure 28A:
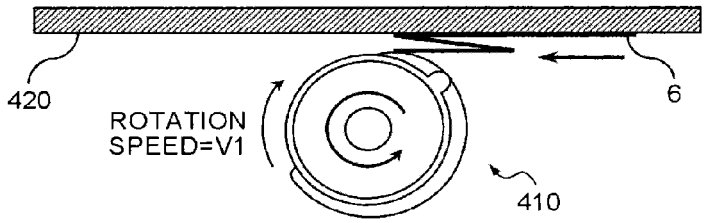
FIGS. 28A to 28C are diagrams illustrating a method of reducing impact sound between an additional folding roller and a sheet supporting plate, in an additional folding unit according to the present embodiment.
Figure 28B:
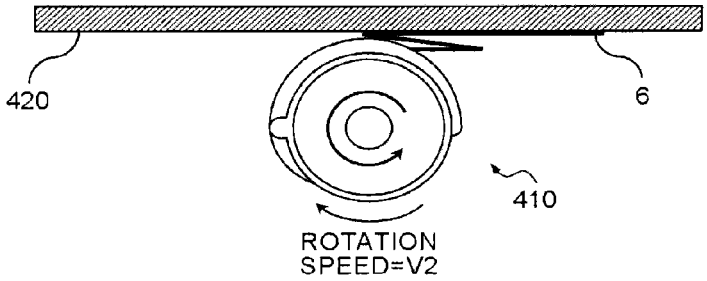
Figure 28C:
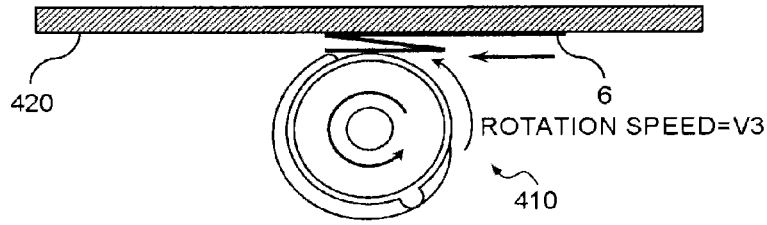

Next, another method of further reducing the impact sound between the additional folding roller 410 and the sheet supporting plate 420 will be described with reference to FIGS. 28A to 28C. FIGS. 28A to 28C are diagrams illustrating a method of reducing the impact sound between an additional folding roller 410 and a sheet supporting plate 420, in an additional folding unit 4 according to the present embodiment. It is noted that operation of each operation unit described below is controlled by the main control unit 101 and the engine control unit 102. That is, in the present embodiment, the main control unit 101 and the engine control unit 102 function as a rotation control unit.

The additional folding unit 4 according to the present embodiment is configured so that rotation speed of the additional folding roller 410 is controlled to be changed according to the circumstances to have the following relationships: V1<V2, and V1<V3, wherein, V1 is the rotation speed of the additional folding roller 410 upon abutment of the additional folding roller 410 on the sheet 6, as illustrated in FIG. 28A, V2 is the rotation speed of the additional folding roller 410 upon pressing of the additional folding roller 410 against the sheet 6, as illustrated in FIG. 28B, V3 is the rotation speed of the additional folding roller 410 not abutting on the sheet 6 or not pressing the sheet 6, as illustrated in FIG. 28C. It is noted that the additional folding unit 4 according to the present embodiment is configured so that a condition of the additional folding roller 410 can be determined based on a rotation angle of the additional folding roller rotation shaft 411.

As described above, the additional folding unit 4 according to the present embodiment is configured so that the rotation speed of the additional folding roller 410 upon abutment of the additional folding roller 410 on the sheet 6 is reduced relative to the rotation speed of the additional folding roller 410 in the other circumstances. Therefore, the impact sound between the additional folding roller 410 and the sheet supporting plate 420 can be reduced.

Further, in the additional folding unit 4 according to the present embodiment, the rotation speed of the additional folding roller 410 is changed according to the circumstances of the additional folding roller 410 to satisfy the following relationship: V1<V3<V2. Therefore, improvement of the productivity, reduction of the impact sound, and additional folding effect are simultaneously established.

That is, in the additional folding unit 4 according to the present embodiment, in order to reduce the impact sound between the additional folding roller 410 and the sheet supporting plate 420, the rotation speed V1 of the additional folding roller 410 upon abutment of the additional folding roller 410 on the sheet 6 is controlled to be minimized. Meanwhile in order to improve productivity, in the additional folding unit 4 according to the present embodiment, the rotation speed V3 of the additional folding roller 410 not abutting on the sheet 6 or not pressing the sheet 6 is controlled to be maximized.

Further, in the additional folding unit 4 according to the present embodiment, in order to firmly press the fold line to the extent that the productivity is not reduced, rotation speed V2 of the additional folding roller 410 upon pressing of the additional folding roller 410 against the sheet 6 is controlled to have a magnitude between V1 and V3. As described above, in the additional folding unit 4 according to the present embodiment, the rotation speed of the additional folding roller 410 is changed according to the circumstances of the additional folding roller 410 to satisfy the following relationship V1<V3<V2. Therefore, improvement of the productivity, reduction of the impact sound, and additional folding effect are simultaneously established.

Figure 29:
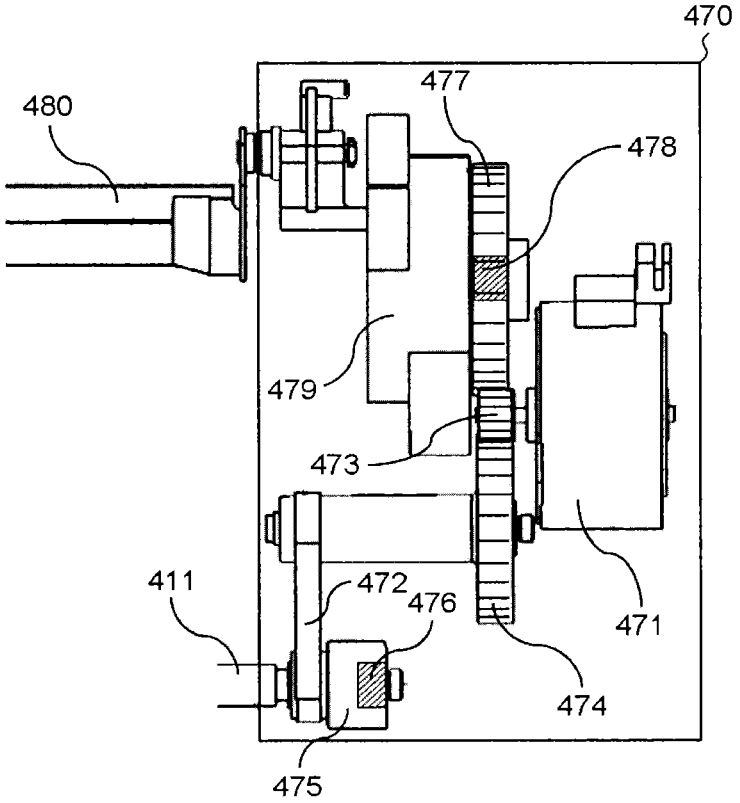
FIG. 29 is a diagram illustrating an additional folding roller-driving device according to the present embodiment, viewed in a direction perpendicular to a sheet conveying direction.
Figure 30:
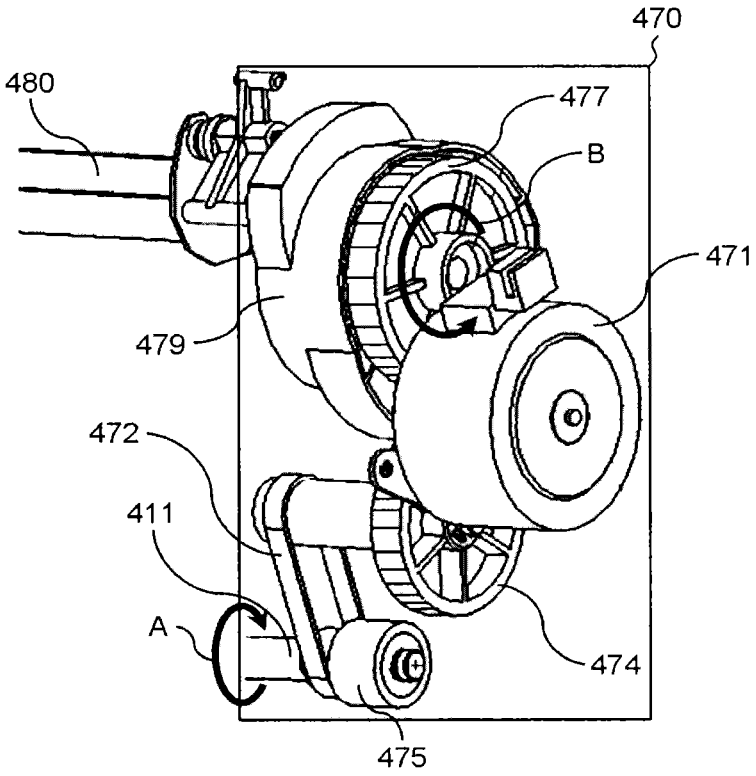
FIG. 30 is a perspective view illustrating an additional folding roller-driving device according to the present embodiment.

Next, a structure of the additional folding roller-driving device 470 according to the present embodiment will be described with reference to FIGS. 29 and 30. FIG. 29 is a diagram illustrating the additional folding roller-driving device 470 according to the present embodiment, viewed in a direction perpendicular to the sheet conveying direction. FIG. 30 is a perspective view illustrating the additional folding roller-driving device 470 according to the present embodiment.

As illustrated in FIGS. 29 and 30, the additional folding roller-driving device 470 according to the present embodiment is provided at one end of the additional folding roller 410 in a direction perpendicular to the sheet conveying direction, and includes the additional folding roller-driving motor 471, the timing belt 472, a reverse gear 473, an additional folding roller-rotating gear pulley 474, an additional folding roller-rotating pulley 475, a one-way clutch 476, a reverse rotation gear 477, a one-way clutch 478, and a reverse rotation cam 479.

The additional folding roller-driving motor 471 is a motor for rotating the reverse gear 473. The additional folding roller-rotating gear pulley 474 is a pulley including a gear meshing with the reverse gear 473, and when the reverse gear 473 is rotated, the additional folding roller-rotating gear pulley 474 rotates in a direction opposite to the rotation direction of the reverse gear 473. The timing belt 472 is an endless belt for transmitting the rotation of the additional folding roller-rotating gear pulley 474 to the additional folding roller-rotating pulley 475. The additional folding roller-rotating pulley 475 is coupled to the additional folding roller rotation shaft 411, and when the additional folding roller-rotating gear pulley 474 is rotated, the additional folding roller-rotating pulley 475 is rotated by the timing belt 472 in the same direction as the additional folding roller-rotating gear pulley 474, and the additional folding roller rotation shaft 411 is rotated in the rotation direction of the additional folding roller-rotating pulley 475.

In the additional folding roller-driving device 470 configured as described above, when the additional folding roller 410 is rotated in a direction indicated by an arrow of FIG. 30, first, the additional folding roller-driving motor 471 is rotated in a direction opposite to the direction indicated by the arrow of FIG. 30, according to the control of the engine control unit 102, and the reverse gear 473 is rotated in a direction opposite to the direction indicated by the arrow of FIG. 30. Accordingly, the additional folding roller-rotating gear pulley 474 is rotated in the same direction as the direction indicated by the arrow of FIG. 30, and the rotation of the additional folding roller-rotating gear pulley 474 is transmitted to the additional folding roller-rotating pulley 475 through the timing belt 472.

When the additional folding roller-rotating pulley 475 is rotated, the additional folding roller rotation shaft 411 is rotated in cooperation with the rotation of the additional folding roller-rotating pulley 475, and the additional folding roller 410 is rotated in the direction indicated by the arrow of FIG. 30. It is noted that, when the additional folding roller-driving device 470 rotates the additional folding roller 410 in a direction opposite to the direction indicated by the arrow of FIG. 30, they are rotated in a direction opposite to the direction as described above.

The one-way clutch 476 is provided in the additional folding roller-rotating pulley 475, and only when the additional folding roller-rotating pulley 475 is rotated in a specific direction, the one-way clutch 476 rotates the additional folding roller rotation shaft 411 in the same direction, and when the additional folding roller-rotating pulley 475 is rotated in a direction opposite to the specific direction, the one-way clutch 476 idles to prevent the rotation of the additional folding roller rotation shaft 411.

It is noted that the one-way clutch 476 according to the present embodiment is configured to rotate the additional folding roller rotation shaft 411 in the same direction, only when the additional folding roller-rotating pulley 475 is rotated in a direction indicated by an arrow A of FIG. 30, and to idle, when the additional folding roller-rotating pulley 475 is rotated in a direction opposite to the direction indicated by the arrow A of FIG. 30.

The reverse rotation gear 477 is a gear meshing with the reverse gear 473, and when the reverse gear 473 is rotated, the reverse rotation gear 477 rotates in a direction opposite to the rotation direction of the reverse gear 473, or in the same direction as the additional folding roller-rotating gear pulley 474. The one-way clutch 478 is provided in the reverse rotation gear 477, and, similar to the one-way clutch 476, only when the reverse rotation gear 477 is rotated in a specific direction, the one-way clutch 478 rotates the reverse rotation cam 479 in the same direction, and when the reverse rotation gear 477 is rotated in a direction opposite to the specific direction, the one-way clutch 478 idles to prevent the rotation of the reverse rotation cam 479.

It is noted that the one-way clutch 478 according to the present embodiment is configured to rotate the reverse rotation cam 479 in the same direction, only when the reverse rotation gear 477 is rotated in a direction indicated by an arrow B of FIG. 30, and to idle, when the reverse rotation gear 477 is rotated in a direction opposite to the direction indicated by the arrow B of FIG. 30.

Since the one-way clutch 476 and the one-way clutch 478 are configured as described above, even if the additional folding roller-driving motor 471 is rotated, only one of the additional folding roller-rotating pulley 475 and the reverse rotation cam 479 is rotated. Further, the additional folding roller-rotating pulley 475 and the reverse rotation cam 479 are rotated in the opposite directions.

The reverse rotation cam 479 includes a curved surface having a non-constant distance from a rotation axis of the reverse rotation gear 477, the curved surface has a part having a longer distance from the rotation axis of the reverse rotation gear 477, and the part is coupled to a reverse rotation drive-transmitting unit 480 for transmitting the rotation movement of the reverse rotation cam 479 to a drive system other than the additional folding roller 410.

In the additional folding roller-driving device 470 configured as described above, when the additional folding roller 410 is rotated in a direction indicated by the arrow A of FIG. 30, first, the additional folding roller-driving motor 471 is rotated in a direction opposite to the direction indicated by the arrow A of FIG. 30, according to the control of the engine control unit 102, and the reverse gear 473 is rotated in a direction opposite to the direction indicated by the arrow A of FIG. 30. Therefore, the additional folding roller-rotating gear pulley 474 is rotated in the same direction as the direction indicated by the arrow A of FIG. 30, and the rotation of the additional folding roller-rotating gear pulley 474 is transmitted to the additional folding roller-rotating pulley 475 through the timing belt 472.

When the additional folding roller-rotating pulley 475 is rotated, the additional folding roller rotation shaft 411 is rotated in cooperation with the rotation of the additional folding roller-rotating pulley 475, and the additional folding roller 410 is rotated in the direction indicated by the arrow A in FIG. 30. At this time, the one-way clutch 478 functions to prevent the rotation of the reverse rotation gear 477.

Meanwhile, when the additional folding roller-driving device 470 configured as described above uses the driving force of the additional folding roller-driving motor 471, for another drive system, first, the additional folding roller-driving motor 471 is rotated in a direction opposite to a direction indicated by the arrow B of FIG. 30 according to the control of the engine control unit 102, and the reverse rotation gear 477 is rotated in a direction opposite to the direction indicated by the arrow B of FIG. 30.

Therefore, the reverse rotation cam 479 is rotated in the same direction as the direction indicated by the arrow B of FIG. 30, and the rotation movement of the reverse rotation cam 479 is transmitted to the drive system other than the additional folding roller 410 through the reverse rotation drive-transmitting unit 480. At this time, the one-way clutch 476 functions to prevent the rotation of the additional folding roller-rotating pulley 475.

Owing to such a configuration, in the additional folding unit 4 according to the present embodiment, the driving force of the additional folding roller-driving motor 471 for rotating the additional folding roller 410 in a direction opposite to a rotatable direction can be used for another drive system.

It is noted that, when the additional folding roller-driving device 470 is configured as described above, in the additional folding unit 4, first, the rotation of the additional folding roller-driving motor 471 is stopped to stop the rotation of the additional folding roller 410, but, due to the function of the one-way clutch 476, the additional folding roller 410 keeps rotating in the same direction for a while by a rotational moment of its inertial force. It is because, even if the rotation of the additional folding roller-driving motor 471 is stopped, the rotational moment of the inertial force of the additional folding roller 410 cannot be canceled from a direction opposite to the rotation direction of the additional folding roller 410, due to the function of the one-way clutch 476.

Accordingly, in the additional folding unit 4 according to the present embodiment, the additional folding roller 410 is actually rotated beyond a predetermined rotation angle θ to be stopped, contrary to the expectation that the additional folding roller 410 is stopped at the rotation angle θ after rotating by the predetermined angle θ, missing the accurate rotation angle of the additional folding roller 410.

Therefore, when the additional folding roller-driving device 470 is configured as described above, a stop device is required for accurately stopping the additional folding roller 410 at the rotation angle θ after rotating by the predetermined angle θ. For that reason, the additional folding unit 4 according to the present embodiment includes a stop device 490 for stopping the additional folding roller 410 at a predetermined position.

Figure 31:
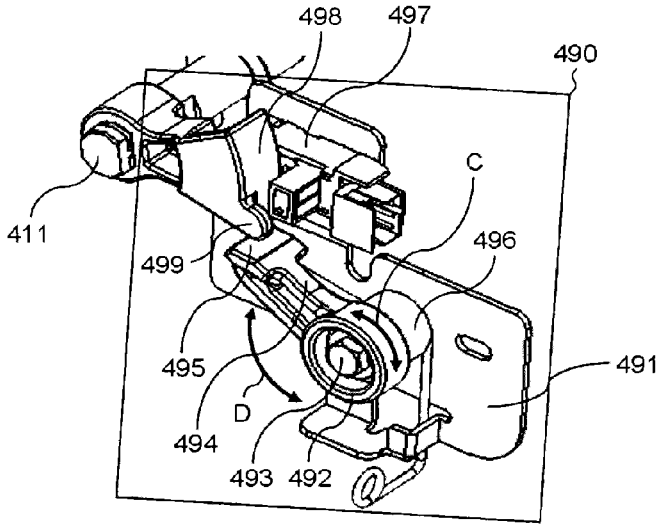
FIG. 31 is a perspective view illustrating a stop device according to the present embodiment.
Figure 32:
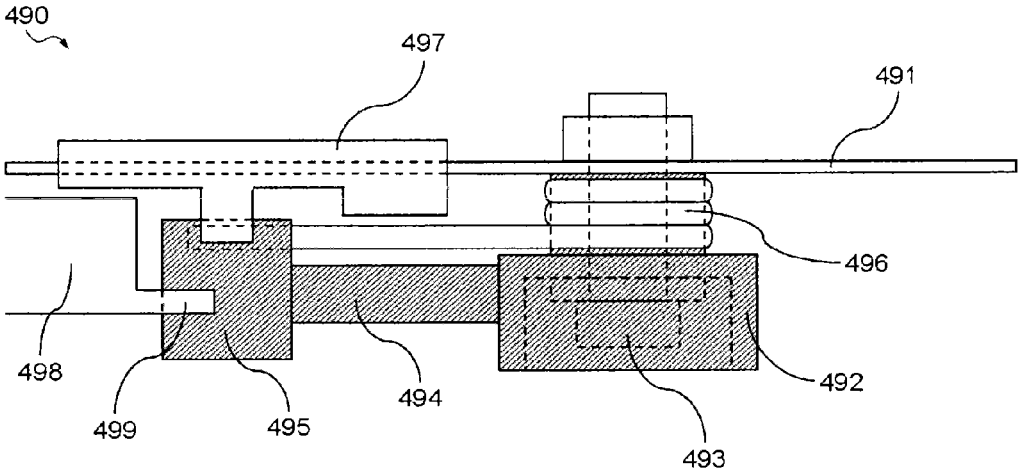
FIG. 32 is a transparent view illustrating a stop device according to the present embodiment, viewed in a direction perpendicular to a plane formed by a direction perpendicular to a sheet conveying direction and a sheet conveying direction.
Figure 33:
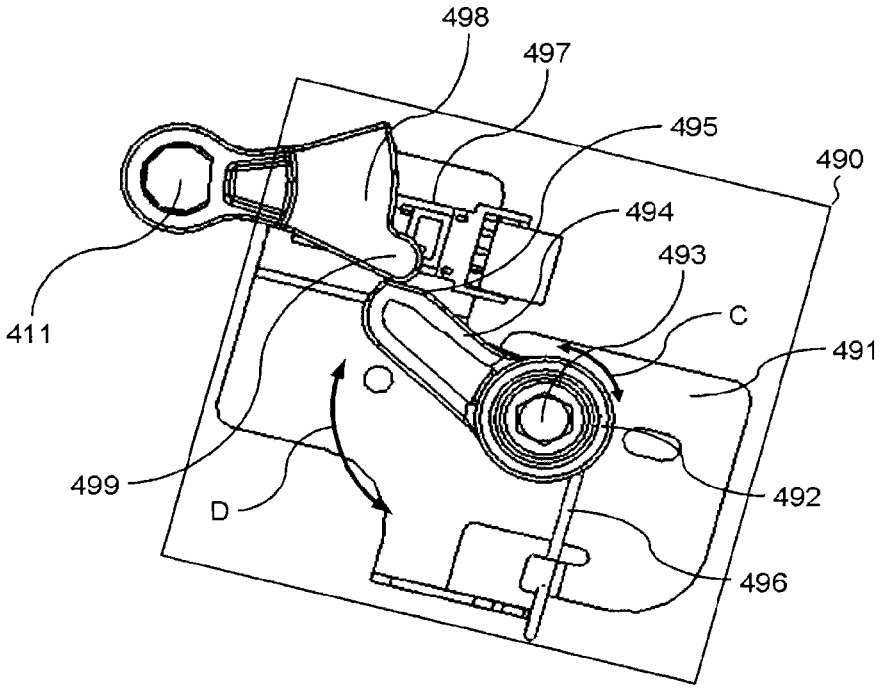
FIG. 33 is a diagram illustrating a stop device according to the present embodiment, viewed in a direction perpendicular to a sheet conveying direction.

Here, a structure of the stop device 490 according to the present embodiment will be described with reference to FIGS. 31 to 33. FIG. 31 is a perspective view illustrating the stop device 490 according to the present embodiment. FIG. 32 is a transparent view illustrating the stop device 490 according to the present embodiment, viewed in a direction perpendicular to a plane formed by a direction perpendicular to the sheet conveying direction and the sheet conveying direction. FIG. 33 is a diagram illustrating the stop device 490 according to the present embodiment, viewed in a direction perpendicular to the sheet conveying direction.

As illustrated in FIGS. 31 to 33, the stop device 490 according to the present embodiment is provided on a side of the additional folding roller 410 opposite to the additional folding roller-driving device 470 in a direction perpendicular to the sheet conveying direction, and includes a stop device fixing portion 491, a rotation portion 492, a rotation screw 493, a coupling portion 494, a rotation stop portion 495, a torsion spring 496, a sensor 497, a sensor blocking portion 498, and a rotation stop action portion 499.

The stop device fixing portion 491 is a fixing portion for fixing the stop device 490 to the additional folding unit 4. The rotation portion 492 is fixed to the stop device fixing portion 491 with the rotation screw 493 so as to be rotated about the rotation screw 493 as a rotation axis, in a direction indicated by an arrow C of FIGS. 31 and 33. The rotation screw 493 is fixed to the stop device fixing portion 491 so that the rotation screw 493 itself serves as the rotation axis of the rotation portion 492, and so that the rotation portion 492 is rotated in the direction indicated by the arrow C of FIGS. 31 and 33. The coupling portion 494 couples the rotation portion 492 and the rotation stop portion 495. The rotation stop portion 495 is coupled to the rotation portion 492 by the coupling portion 494, and is rotated about the rotation screw 493 as a rotation axis, in a direction indicated by an arrow D of FIGS. 31 and 33.

The torsion spring 496 is a torsion spring fixed around a part of the rotation portion 492 mounted to the stop device fixing portion 491 with the rotation screw 493, and has one end fixed to the stop device fixing portion 491 and the other end fixed to the rotation stop portion 495. Owing to such a configuration, the torsion spring 496 has a resilient force working to prevent the rotation of the rotation stop portion 495 about the rotation screw 493 as a rotation axis, and the rotation stop portion 495 can be returned to its original position. It is noted that the resilient force of the torsion spring 496 according to the present embodiment is larger than the inertial force of the additional folding roller 410.

The sensor 497 includes an infrared light-emitting unit for emitting infrared light, and an infrared light-receiving unit for receiving the infrared light. When the infrared light emitted from the infrared light-emitting unit to the infrared light-receiving unit is blocked by the sensor blocking portion 498, the blocking of the infrared light is reported to the engine control unit 102. The sensor blocking portion 498 is fixed to the additional folding roller rotation shaft 411, and is rotated with the additional folding roller 410. When the additional folding roller 410 is rotated by the predetermined angle θ, the infrared light emitted from the infrared light-emitting unit to the infrared light-receiving unit in the sensor 497 is blocked. Owing to such a configuration, in the additional folding unit 4 according to the present embodiment, the sensor 497 is blocked by the sensor blocking portion 498 as described above, and the rotation of the additional folding roller 410 by the predetermined angle θ can be detected, so that, upon the detection, control for stopping the additional folding roller 410, or control for stopping the rotation of the additional folding roller-driving motor 471 can be performed.

The rotation stop action portion 499 is provided at an end of the sensor blocking portion 498, and is configured to be brought into contact with the rotation stop portion 495, when the additional folding roller 410 is rotated by the predetermined angle θ.

The additional folding unit 4 according to the present embodiment includes the stop device 490 configured as described above, so that, when the rotation of the additional folding roller-driving motor 471 is stopped to stop the rotation of the additional folding roller 410 at the rotation angle θ after the additional folding roller 410 is rotated by the predetermined angle θ, the rotational moment of the inertial force of the additional folding roller 410 can be canceled from the opposite direction of the rotational moment.

Accordingly, even if the additional folding unit 4 according to the present embodiment has the additional folding roller-driving device 470 configured as illustrated in FIGS. 29 and 30, it is prevented that the additional folding roller 410 is continuously rotated in the same direction for a while after the rotation of the additional folding roller-driving motor 471 is stopped, when the additional folding roller 410 is rotated by the predetermined angle θ to be stopped at the rotation angle θ.

That is, in the additional folding unit 4 according to the present embodiment, it is prevented that the additional folding roller 410 is actually rotated beyond the predetermined rotation angle θ to be stopped, contrary to the expectation that the additional folding roller 410 is stopped at the rotation angle θ after rotating by the predetermined angle θ. Therefore, even if the additional folding unit 4 according to the present embodiment has the additional folding roller-driving device 470 configured as illustrated in FIGS. 29 and 30, the additional folding roller 410 can be accurately stopped at the rotation angle θ after rotating by the predetermined angle θ, so that the rotation angle of the additional folding roller 410 can be accurately grasped usually.

As described above, in the additional folding unit 4 according to the present embodiment, the additional folding roller 410 is configured so that the projection portion 412 formed on the surface of the additional folding roller 410 has an distal end abutting on the sheet 6 at first, and the distal end is provided with the impact absorbing member 414 for reducing impact upon collision with the sheet 6, as illustrated in FIGS. 16 to 18 or 19 to 22. As illustrated in FIGS. 16 to 18 or 19 to 22, the impact absorbing member 414 is provided to have an inclination angle at the distal end of the projection portion 412, and the inclination angle is configured to be gentle relative to the surface of the additional folding roller 410.

As described above, in the additional folding unit 4 according to the present embodiment, the impact absorbing member 414 provided on the additional folding roller 410 increases a contact area with the sheet supporting plate 420 upon collision with the sheet supporting plate 420, compared with the additional folding roller 410 not provided with the impact absorbing member 414, so that the impact upon collision is widely dispersed. Accordingly, the additional folding unit 4 according to the present embodiment can reduce the impact sound generated upon abutment of the additional folding roller 410 on the sheet 6.

Therefore, in the additional folding unit 4 according to the present embodiment, the fold line formed in the sheet 6 can be efficiently pressed at low cost, and the noise generated upon pressing the fold line can be reduced.

Figure 34A:
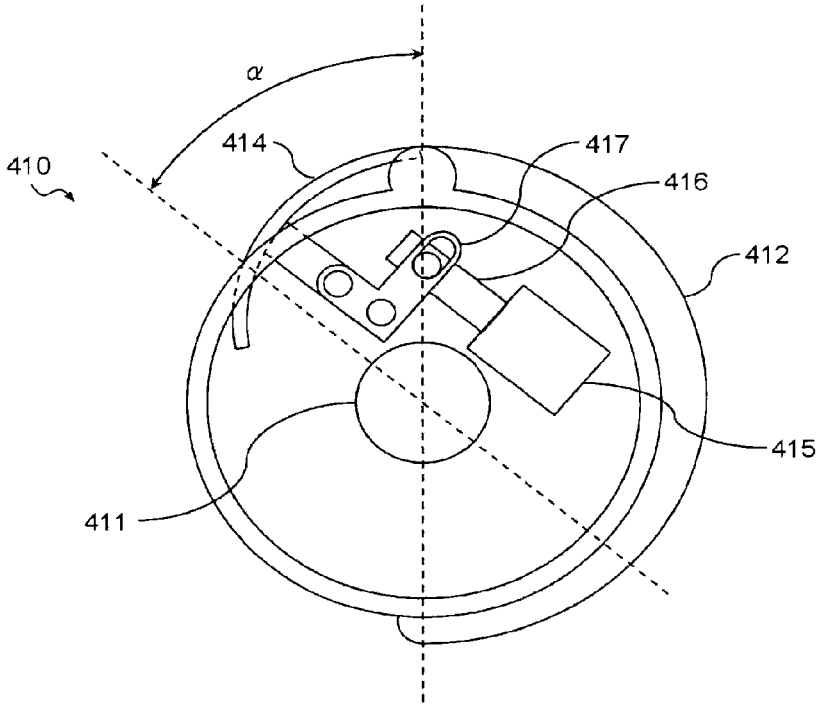
FIGS. 34A and 34B are cross-sectional views illustrating an additional folding roller according to the present embodiment, viewed in a direction perpendicular to a sheet conveying direction.
Figure 34B:
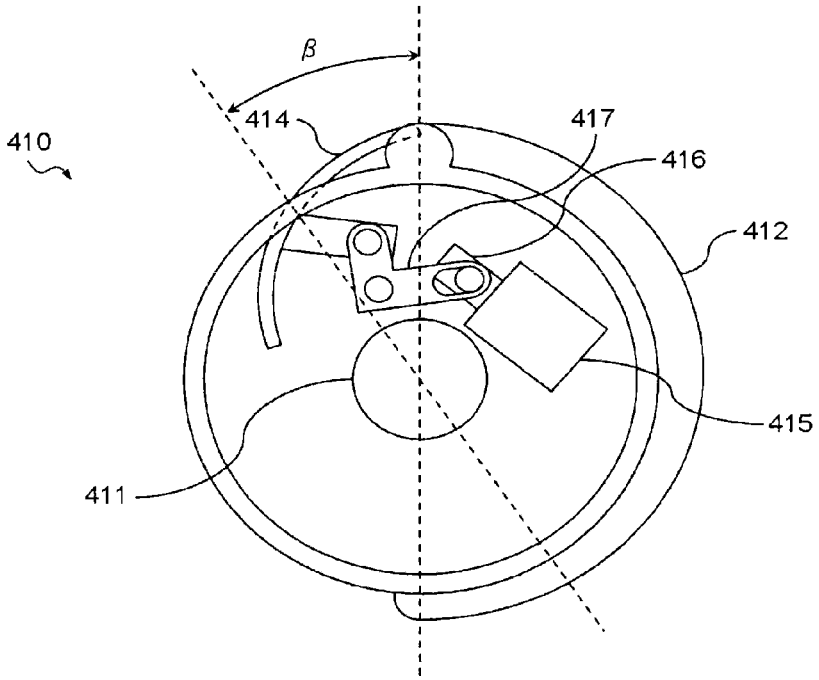

It is noted that, in the additional folding roller 410 according to the present embodiment, the impact absorbing member 414 may have an angle changeable relative to the surface of the additional folding roller 410. Here, effects of the additional folding roller 410 configured as described above according to the present embodiment will be described with reference to FIGS. 34A and 34B. FIGS. 34A and 34B are cross-sectional views illustrating an additional folding roller 410 according to the present embodiment, viewed in a direction perpendicular to a sheet conveying direction.

As illustrated in FIGS. 34A and 34B, the additional folding roller 410 according to the present embodiment is configured so that when a plunger 416 is protruded and retracted by a solenoid 415 as an actuator, the angle of the impact absorbing member 414 is changeable relative to the surface of the additional folding roller 410 through a link 417 coupling the impact absorbing member 414 and the plunger 416.

As illustrated in FIG. 34A, in the additional folding roller 410 configured as described above, when the plunger 416 is not attracted by the solenoid 415, and the impact absorbing member 414 has a gentle angle relative to the surface of the additional folding roller 410, the rotation angle of the impact absorbing member 414, from an end to the terminal end, is defined as α. While, as illustrated in FIG. 34B, when the plunger 416 is attracted by the solenoid 415, and the impact absorbing member 414 has a steep angle relative to the surface of the additional folding roller 410, the rotation angle of the impact absorbing member 414, from an end to the terminal end, is defined as β. In this case, the following relationship is satisfied: $\alpha > \beta$.

As described above, in the additional folding roller 410 according to the present embodiment, the angle of the impact absorbing member 414 is configured to be changeable relative to the surface of the additional folding roller 410, so that the rotation angle of the impact absorbing member 414, from an end to the terminal end, can be changed.

Accordingly, for improvement of the productivity, the additional folding unit 4 according to the present embodiment can be configured so that the solenoid 415 attracts the plunger 416 to provide a steep angle of the impact absorbing member 414 relative to the surface of the additional folding roller 410, so that the rotation angle of the impact absorbing member 414, from an end to the terminal end, can be reduced, and a time from conveyance to pressing of the sheet can be reduced.

However, in such a case, in the additional folding roller 410 according to the present embodiment, the impact absorbing member 414 has a steep angle relative to the surface of the additional folding roller 410, and when the end of the impact absorbing member 414 abuts on the sheet, the impact sound is generated.

Therefore, the additional folding unit 4 according to the present embodiment can have a configuration in which the solenoid 415 does not attract the plunger 416 to reduce the angle of the impact absorbing member 414 relative to the surface of the additional folding roller 410, and the impact sound generated upon abutment of the end of the impact absorbing member 414 on the sheet can be reduced. However, in such a case, the rotation angle of the impact absorbing member 414, from an end to the terminal end, is increased, so that the productivity is reduced.

As illustrated in FIGS. 34A and 34B, in the additional folding unit 4 according to the present embodiment, when the angle of the impact absorbing member 414 is configured to be changeable relative to the surface of the additional folding roller 410, improvement of the productivity and reduction of the impact sound have a trade-off relationship between them. Then, the additional folding unit 4 according to the present embodiment may be configured to be set by a user to give priority to the reduction of the impact sound or the improvement of the productivity. Further, the additional folding unit 4 according to the present embodiment may be configured so that the impact absorbing member 414 has an angle changeable stepwise relative to the surface of the additional folding roller 410 in order to have a well-balanced relationship between the reduction of the impact sound and the improvement of the productivity.

Further, the additional folding unit 4 according to the present embodiment may be configure so that the angle of the impact absorbing member 414 is changed according to the circumstances by giving priority to the reduction of the impact sound or the improvement of the productivity. For example, when it is expected that the impact sound is loud, or when cardboard is additional pressed, the angle of the impact absorbing member 414 is increased to have a gentle angle relative to the surface of the additional folding roller 410, giving priority to the reduction of the impact sound, and when a thin paper sheet is additional pressed, or when it is expected that the impact sound is soft, the angle of the impact absorbing member 414 is reduced to have a steep angle relative to the surface of the additional folding roller 410, giving priority to the improvement of the productivity.

Figure 35A:
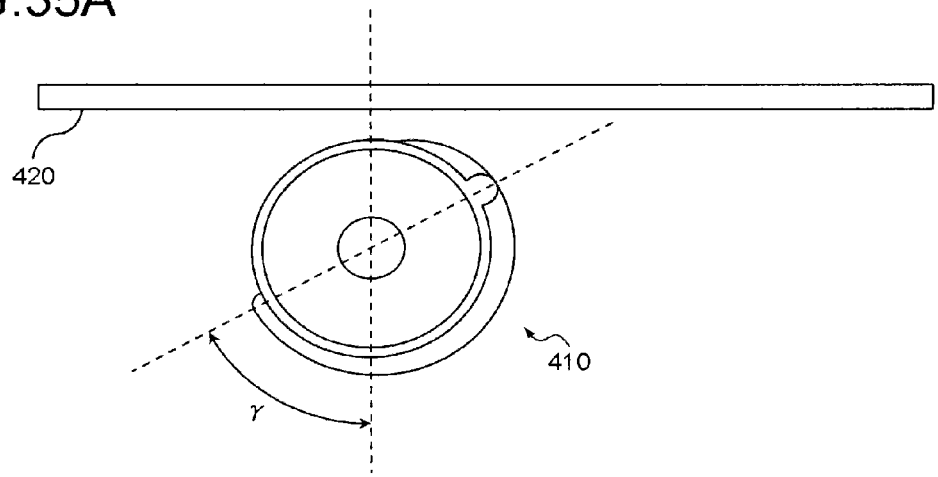
FIGS. 35A and 35B are cross-sectional views illustrating a sheet supporting plate and an additional folding roller according to the present embodiment, viewed in a direction perpendicular to a sheet conveying direction.
Figure 35B:
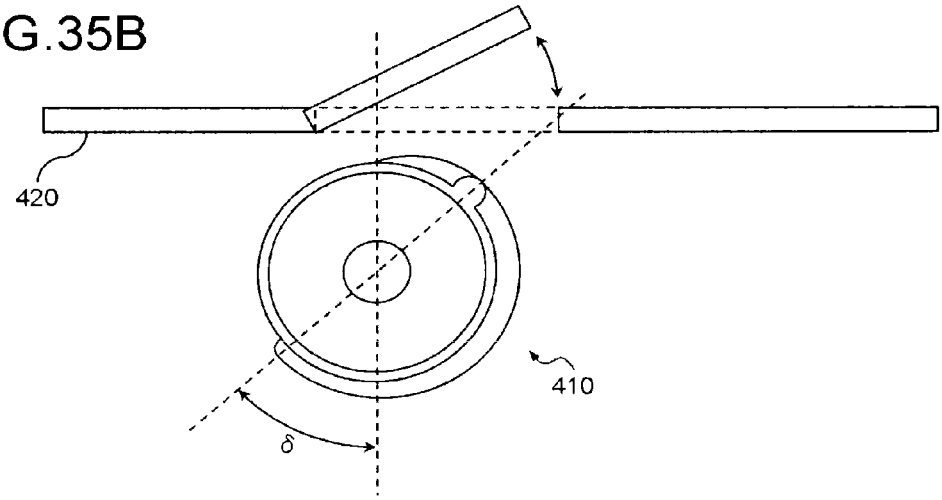

Further, in the additional folding unit 4 according to the present embodiment, the sheet supporting plate 420 may be configured so that a part facing the additional folding roller 410, is moved away from the additional folding roller 410 to increase the gap between the additional folding roller 410 and the sheet supporting plate 420. Here, effects of the sheet supporting plate 420 configured as described above according to the present embodiment will be described with reference to FIGS. 35A and 35B. FIGS. 35A and 35B are cross-sectional views illustrating the sheet supporting plate 420 and the additional folding roller 410 according to the present embodiment, viewed in a direction perpendicular to a sheet conveying direction.

It is noted that, in FIG. 35A, as an example of the movement of the part of the sheet supporting plate 420 facing the additional folding roller 410, away from the additional folding roller 410, the part configured to be turned about a rotation axis extending in a direction parallel to a direction perpendicular to the sheet conveying direction will be exemplified, but the part may be configured to be moved in parallel with the other parts of the sheet supporting plate 420. At this time, the sheet supporting plate 420 is driven by a drive source such as an actuator or a motor.

As illustrated in FIGS. 35A and 35B, in the additional folding unit 4 according to the present embodiment, the rotation angle of the additional folding roller 410 required from a standby position at which the sheet 6 is put on standby before conveyance to the pressing position before abutment of the projection portion 412 on the sheet 6 can be expressed by the following relationship: $\delta<\gamma$, wherein, $\delta$ is the rotation angle of the additional folding roller 410 upon movement of the sheet supporting plate 420, and $\gamma$ is the rotation angle of the additional folding roller 410 without movement of the sheet supporting plate 420, Here, the reason why the relationship $\delta<\gamma$ can be satisfied will be described. As illustrated in FIG. 35A, in the additional folding unit 4 according to the present embodiment, when the sheet supporting plate 420 is not moved, the gap between the additional folding roller 410 and the sheet supporting plate 420 is small, the impact absorbing member 414 tends to be conveyance resistance to the sheet 6, and a position on the additional folding roller 410 rotated away from an abutment position thereon needs to be defined as the standby position in order to increase a gap between the impact absorbing member 414 and the sheet 6.

Meanwhile, as illustrated in FIG. 35B, in the additional folding unit 4 according to the present embodiment, when the sheet supporting plate 420 is moved, the gap between the additional folding roller 410 and the sheet supporting plate 420 is increased, the impact absorbing member 414 is unlikely to be the conveyance resistance to the sheet 6, and the standby position and the abutment position on the additional folding roller 410 can be brought closer to each other.

Accordingly, the additional folding unit 4 according to the present embodiment is configured so that the sheet supporting plate 420 is moved as described above, and the rotation angle for rotating the additional folding roller 410 from the standby position to the abutment position can be reduced. Therefore, in the additional folding unit 4 according to the present embodiment, a time required from the conveyance to the pressing of the sheet 6 is reduced, and the productivity can be improved.

An exemplary operation during additional folding, when the additional folding unit 4 according to the present embodiment is configured as described above will be described in detail with reference to FIGS. 36A to 36D. FIGS. 36A to 36D are cross-sectional views of the additional folding roller 410 and the sheet supporting plate 420, viewed in a direction perpendicular to the sheet conveying direction, illustrating the additional folding roller 410 and the sheet supporting plate 420 during additional folding performed by an additional folding unit 4 according to the present embodiment.

Figure 36A:
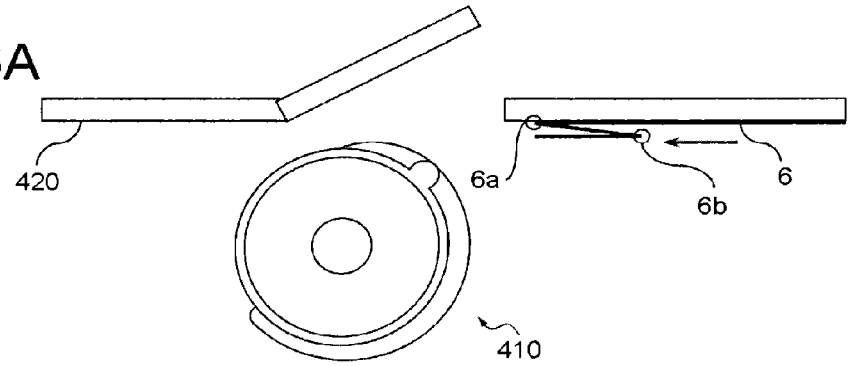
FIGS. 36A to 36D are cross-sectional views of an additional folding roller and a sheet supporting plate, viewed in a direction perpendicular to a sheet conveying direction, illustrating the additional folding roller and the sheet supporting plate during additional folding performed by an additional folding unit according to the present embodiment.
Figure 36B:
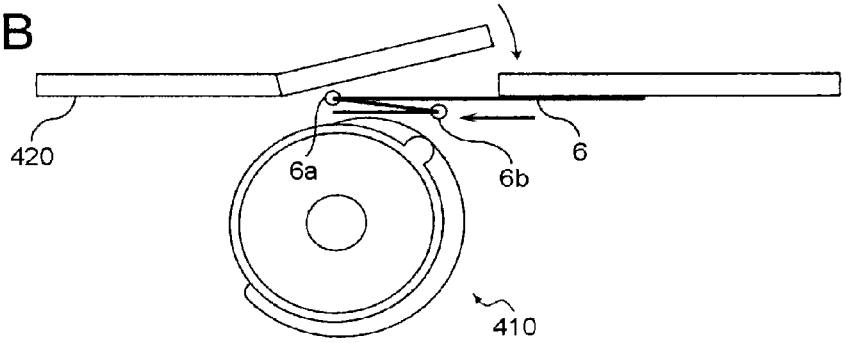
Figure 36C:
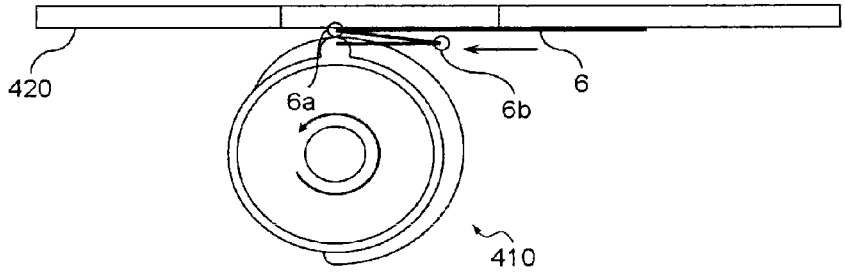

As illustrated in FIG. 36A, in the additional folding unit 4 according to the present embodiment, while the sheet supporting plate 420 is moved away from the additional folding roller 410, conveyance of the sheet 6 is started, and the additional folding roller 410 is put on standby at the standby position. As illustrated in FIGS. 36B and 36C, in the additional folding unit 4 according to the present embodiment, when the first fold line 6*a* is conveyed to the pressing position, the sheet supporting plate 420 is moved to be parallel with the additional folding roller 410, and then the pressing of the first fold line 6*a* is started.

Figure 36D:
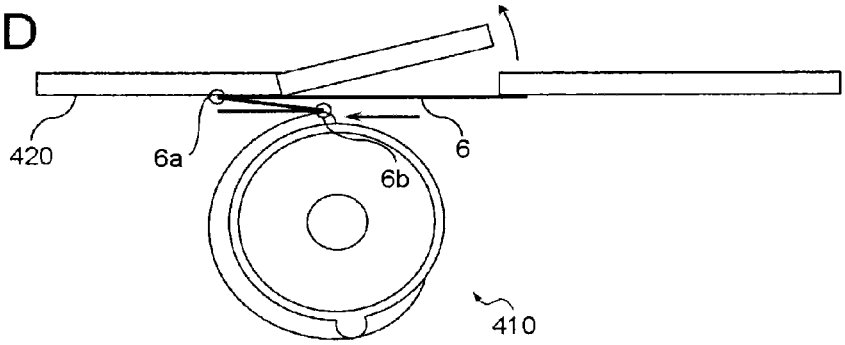

In the additional folding unit 4 according to the present embodiment, as illustrated in FIG. 36D, when the pressing of the first fold line 6*a* is finished, the sheet supporting plate 420 is moved again away from the additional folding roller 410 for conveyance of the sheet 6, and when the second fold line 6*b* is conveyed to the pressing position, the second fold line 6*b* is pressed, as similar to the first fold line 6*a*.

Figure 37:
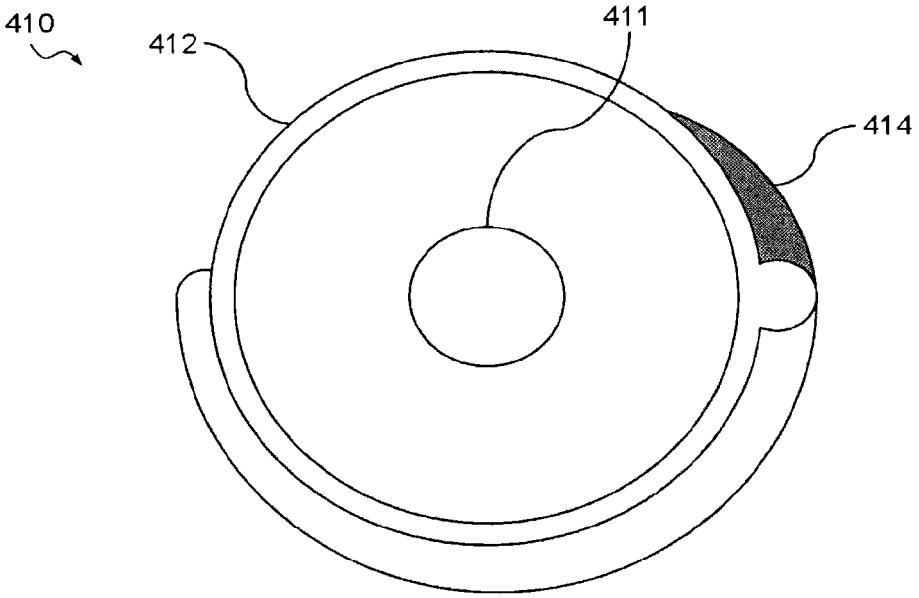
FIG. 37 is a side view illustrating an additional folding roller according to the present embodiment, viewed in a direction perpendicular to a sheet conveying direction.
Figure 38:
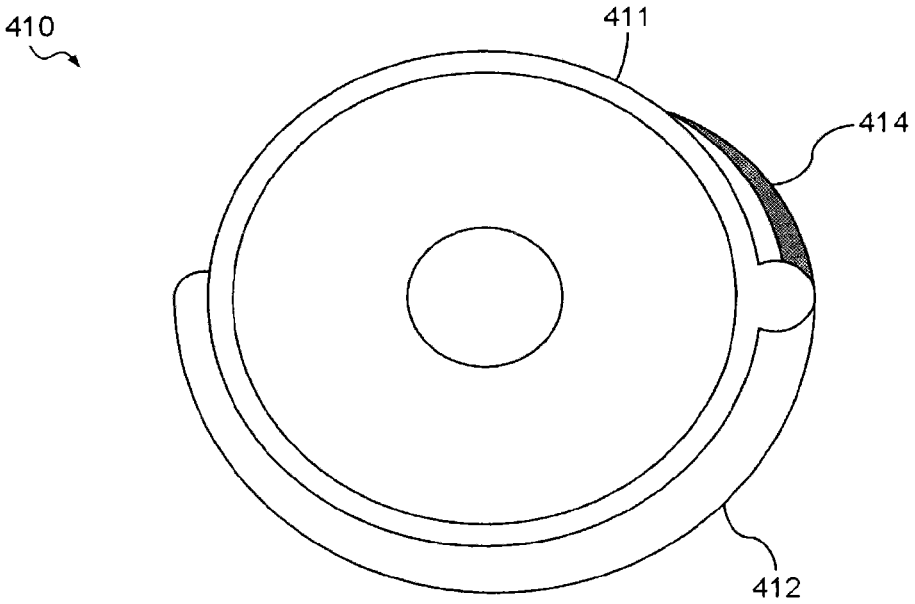
FIG. 38 is a side view illustrating an additional folding roller according to the present embodiment, viewed in a direction perpendicular to a sheet conveying direction.

Further, as illustrated in FIG. 37 or 38, whole of the impact absorbing member 414 according to the present embodiment, or only a part thereof making contact with the sheet 6 may include an elastic or resilient member as an elastic or resilient material such as rubber, sponge, or a plastic resin. FIGS. 37 and 38 are side views illustrating the additional folding roller 410 according to the present embodiment, viewed in a direction perpendicular to the sheet conveying direction.

The impact absorbing member 414 according to the present embodiment is configured as described above, so that the shape of the impact absorbing member 414 is deformed upon abutment on the sheet 6 to further reduce impact upon collision with the sheet 6, and the impact sound can be further reduced. The impact absorbing member 414 according to the present embodiment is configured as described above, so that the impact sound generated is absorbed by the elastic or resilient member itself, and the impact sound can be further reduced.

Further, the impact absorbing member 414 according to the present embodiment may be configured to be removably mounted with the elastic or resilient member. The impact absorbing member 414 according to the present embodiment is configured as described above, so that even if the elastic or resilient member is deteriorated, for example, worn or broken, the elastic or resilient member can be readily replaced.

Figure 39A:
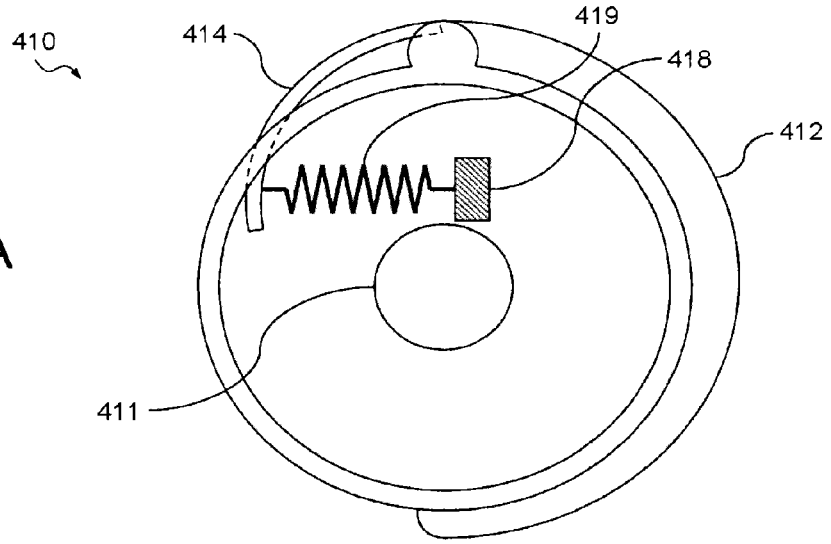
FIGS. 39A and 39B are side views illustrating an additional folding roller according to the present embodiment, viewed in a direction perpendicular to a sheet conveying direction.
Figure 39B:
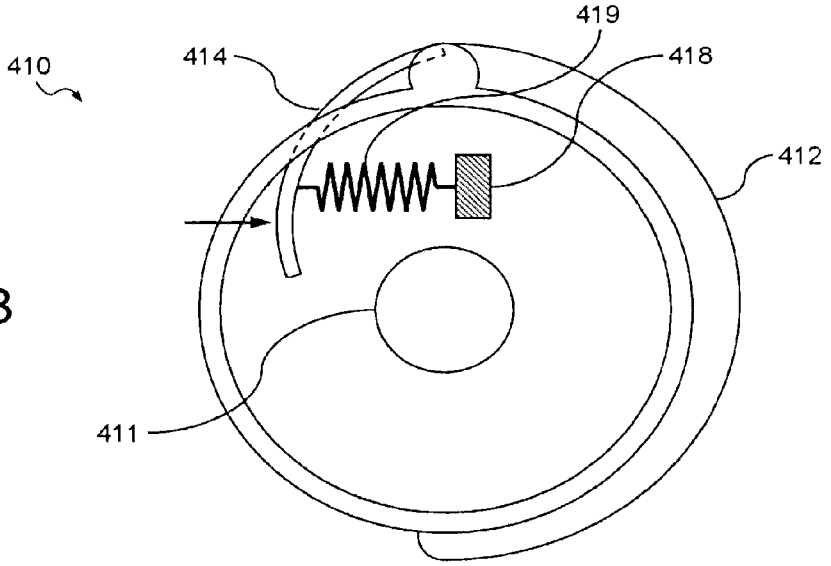
Figure 40:
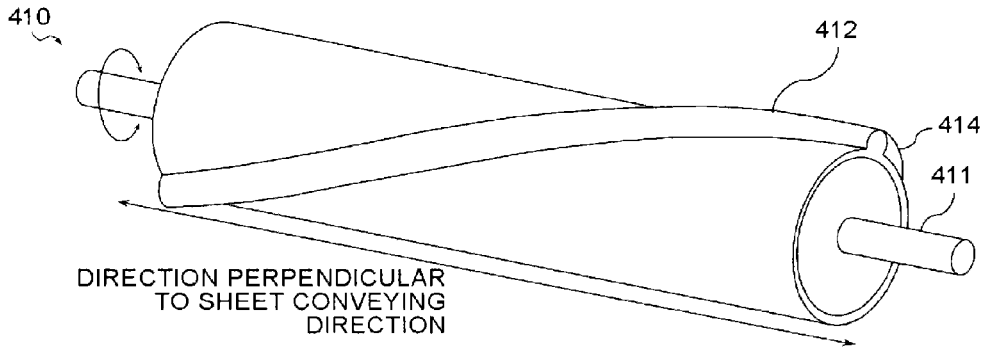
FIG. 40 is a perspective view illustrating an additional folding roller according to an embodiment of the present invention, viewed obliquely downward from a side in a direction perpendicular to a sheet conveying direction.
Figure 41:
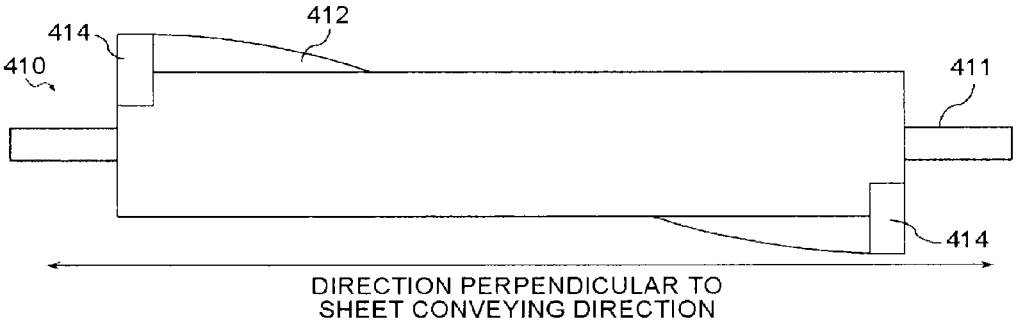
FIG. 41 is a front view illustrating an additional folding roller according to an embodiment of the present invention, viewed in a sheet conveying direction.
Figure 42:
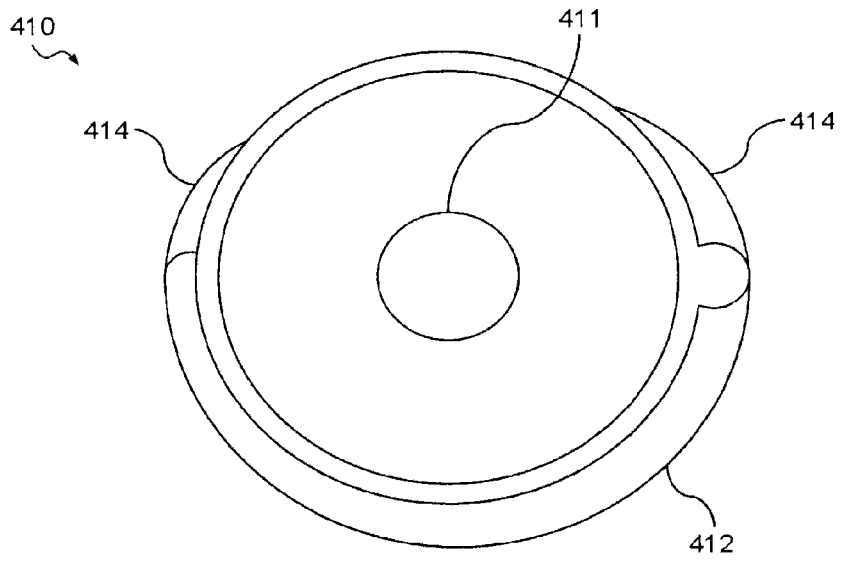
FIG. 42 is a side view illustrating an additional folding roller according to an embodiment of the present invention, viewed in a direction perpendicular to a sheet conveying direction.
Figure 43:
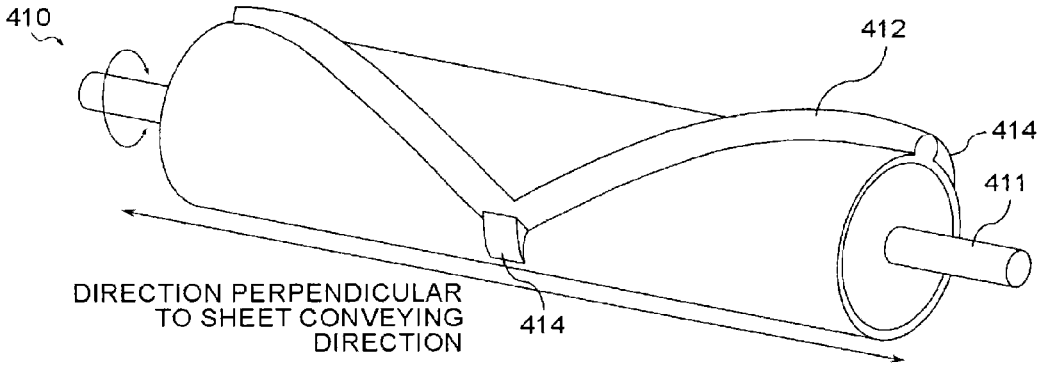
FIG. 43 is a perspective view illustrating an additional folding roller according to an embodiment of the present invention, viewed obliquely downward from a side in a direction perpendicular to a sheet conveying direction.
Figure 44:
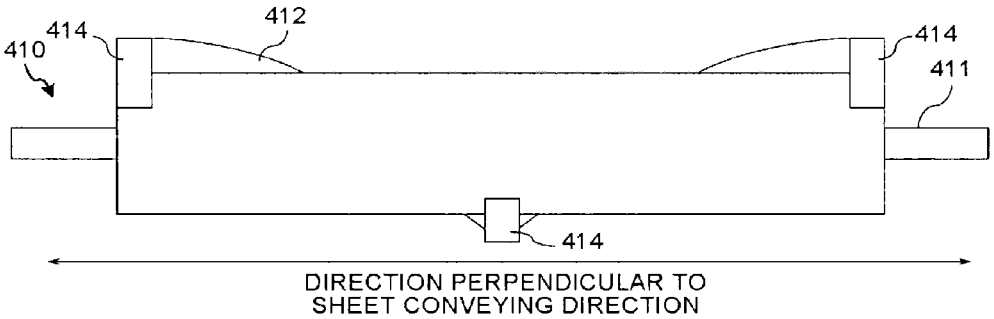
FIG. 44 is a front view illustrating an additional folding roller according to an embodiment of the present invention, viewed in a sheet conveying direction.
Figure 45:
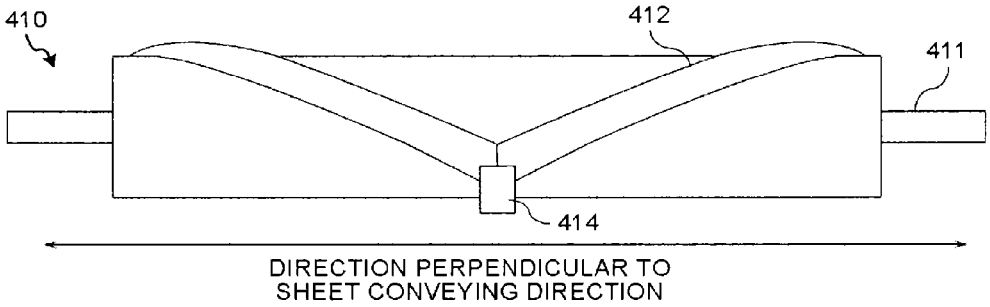
FIG. 45 is a front view illustrating an additional folding roller according to an embodiment of the present invention, viewed in a sheet conveying direction.
Figure 46:
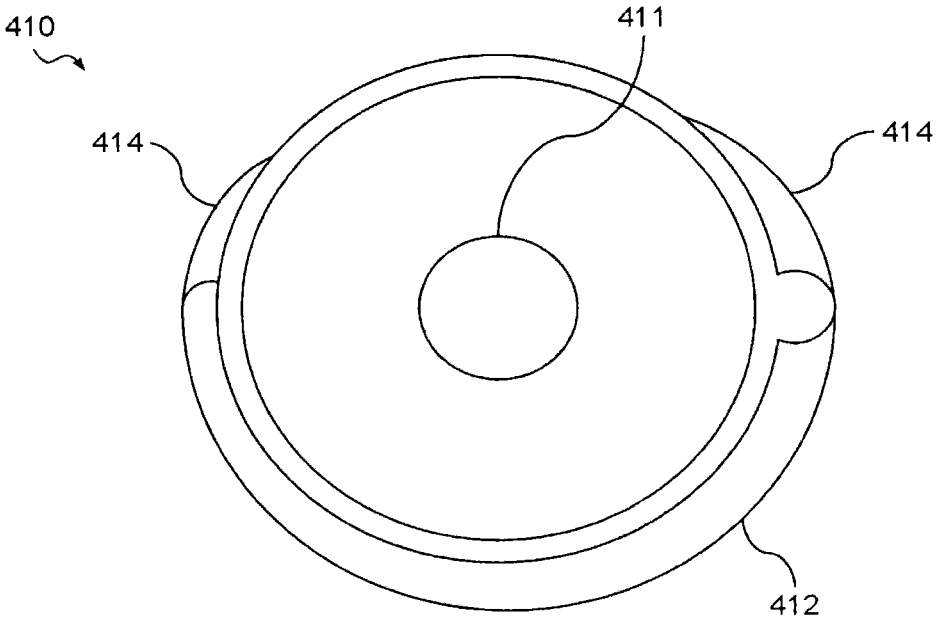
FIG. 46 is a side view illustrating an additional folding roller according to an embodiment of the present invention, viewed in a direction perpendicular to a sheet conveying direction.

Further, as illustrated in FIGS. 39A and 39B, the impact absorbing member 414 according to the present embodiment may be configured so that an elastic or resilient member 419 as the elastic or resilient material such as spring, rubber, sponge, or plastic resin is compressed or expanded by a fixed member 418 fixed in the additional folding roller 410 and the impact absorbing member 414, and the angle of the impact absorbing member 414 is changeable relative to the surface of the additional folding roller 410. FIGS. 39A and 39B are side views illustrating an additional folding roller 410 according to the present embodiment, viewed in a direction perpendicular to a sheet conveying direction. The impact absorbing member 414 according to the present embodiment is configured as described above, so that the elastic or resilient member 419 absorbs the impact upon collision with the sheet 6, and the impact sound can be further reduced.

Further, when the additional folding roller 410 according to the present embodiment can be rotated in both directions, the impact absorbing member 414 may be provided not only at the distal end of the projection portion 412, but also at both ends thereof, as illustrated in FIGS. 40 to 46. The additional folding roller 410 according to the present embodiment is configured as described above, so that even if the additional folding roller 410 rotates in either direction, the impact sound can be reduced regardless of the rotation direction thereof.

Further, in the present embodiment, description has been made of an example of the impact absorbing member 414 provided to have an inclination angle at the distal end of the projection portion 412 so that the inclination angle is gentle relative to the surface of the additional folding roller 410, but the impact absorbing member 414 may be provided over the entire range of the projection portion 412 in a direction perpendicular to the sheet conveying direction to have the gentle inclination angle.

Further, in the present embodiment, description has been made of an example of the impact absorbing member 414 provided at the distal end of the projection portion 412 to have the gentle inclination angle relative to the surface of the additional folding roller 410, but the inclination angle is not necessarily gentle and may have a magnitude equal to those of other parts, as long as the impact absorbing member 414 includes a material for reducing impact upon collision with the sheet 6, such as rubber, sponge, or plastic resin.

Further, in the present embodiment, description has been made of an example of the impact absorbing member 414 formed with the projection portion 412 having a projecting shape relative to the surface of the additional folding roller 410, as illustrated in FIGS. 16 to 22, but when the projection portion 412 has a rigidity higher than the rigidity of the surface of the additional folding roller 410, the projection portion 412 does not necessarily have the projecting shape, and the projection portion 412 and the surface of the additional folding roller 410 may be configured to be flush with each other.

Further, in the present embodiment, description has been made of the configuration in which the image forming apparatus 1 includes the image forming unit 2, the folding unit 3, the additional folding unit 4, and the scanner unit 5, but the units may be configured as different independent devices to be coupled to configure an image forming system.

Second Embodiment

In the first embodiment, description has been made of the additional folding unit 4 including the additional folding roller 410 having a surface formed with the projection portion 412, and provided with the impact absorbing member 414 at an distal end of the projection portion 412 abutting on the sheet 6 at first. The additional folding unit 4 according to the first embodiment is configured as described above, so that the fold line formed in the sheet can be efficiently pressed at low cost, and the noise generated upon pressing the fold line can be reduced.

Meanwhile, in the present embodiment, the additional folding unit 4 will be described which includes a plurality of paths (hereinafter, referred to as "additional folding path") for additional folding. The additional folding unit 4 according to the present embodiment is configured as described above, so that a following sheet can be conveyed before completion of the additional folding of a sheet previously conveyed, and the productivity in additional folding can be improved.

However, a conventional additional folding unit including a plurality of additional folding paths requires as many additional folding rollers as the number of the plurality of additional folding paths, so that the device is increased in size, and further, production cost, running cost, and power consumption are increased.

Therefore, according to one aspect of the present embodiment, the additional folding unit 4 according to the present embodiment is configured to include a common additional folding roller shared between the plurality of additional folding paths. The additional folding unit 4 according to the present embodiment is configured as described above, so that the additional folding unit 4 has a small size at a low cost, and productivity in additional folding can be improved and power consumption can be reduced.

Detailed description will be made below. It is noted that configurations denoted by the same reference signs as in first embodiment are intended to represent the same or equivalent configurations, and detailed description thereof will be omitted.

Figure 47:
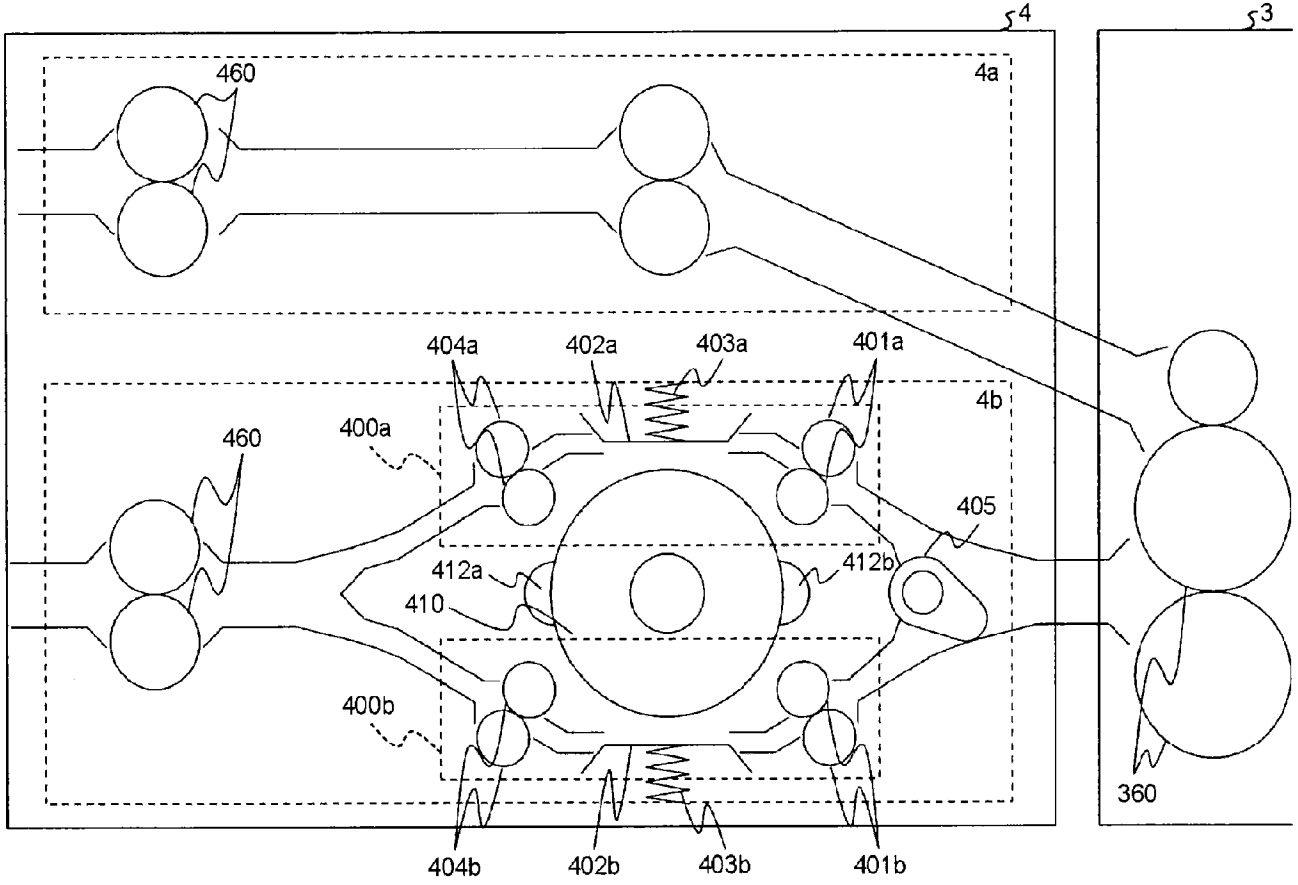
FIG. 47 is a cross-sectional view illustrating an additional folding unit according to an embodiment of the present invention, viewed in a direction perpendicular to a sheet conveying direction.

First, a configuration of the additional folding unit 4 according to the present embodiment will be described with reference to FIG. 47. FIG. 47 is a cross-sectional view illustrating the additional folding unit 4 according to the present embodiment, viewed in a direction perpendicular to a sheet conveying direction. As illustrated in FIG. 47, the additional folding unit 4 according to the present embodiment includes a straight conveying path 4*a*, and an additional folding portion 4*b*.

The straight conveying path 4*a* is a path for directly ejecting the sheet conveyed from the folding unit 3 (hereinafter referred to as "straight conveyance"), from the additional folding unit 4 by the post-processing conveying roller pair 460 without subjecting the sheet to the additional folding.

The additional folding portion 4*b* includes an additional folding path-switching claw 405, and the additional folding roller 410, and further the plurality of additional folding paths for additional folding, i.e., a first additional folding path 400*a*, and a second additional folding path 400*b*.

The first additional folding path 400*a* includes a first upstream sheet holding roller pair 401*a*, a first sheet supporting plate 402*a*, a first pressing member 403*a*, and a first downstream sheet holding roller pair 404*a*. The second additional folding path 400*b* includes a second upstream sheet holding roller pair 401*b*, a second sheet supporting plate 402*b*, a second pressing member 403*b*, and a second downstream sheet holding roller pair 404*b*. In the present embodiment, the first additional folding path 400*a* and the second additional folding path 400*b* function as sheet conveying paths.

The first upstream sheet holding roller pair 401*a* is a roller pair for conveying the sheet to be additionally pressed, and holding the position of the sheet during additional folding operation.

The first sheet supporting plate 402*a* supports the sheet to be additionally pressed, in a pressing direction of the additional folding roller 410, and the sheet to be additionally pressed is pressed against the additional folding roller 410 by a resilient force of the first pressing member 403*a*. It is noted that, in FIG. 47, an example of the first pressing member 403*a* including the spring has been described, but the first pressing member 403*a* may include an elastic or resilient material such as a leaf spring, rubber, sponge, or a plastic resin, in addition to the spring.

The first downstream sheet holding roller pair 404*a* is a roller pair for conveying the sheet to be additionally pressed, and holding the position of the sheet during the additional folding operation.

In the second additional folding path 400*b*, the second upstream sheet holding roller pair 401*b*, the second sheet supporting plate 402*b*, the second pressing member 403*b*, and the second downstream sheet holding roller pair 404*b* are configured similarly to the first upstream sheet holding roller pair 401*a*, the first sheet supporting plate 402*a*, the first pressing member 403*a*, and the first downstream sheet holding roller pair 404*a*, and detailed description thereof will be omitted.

The additional folding path-switching claw 405 switches a conveying destination of the sheet between the first additional folding path 400*a* and the second additional folding path 400*b*, and sheets conveyed from the folding unit 3 are distributed between the first additional folding path 400*a* and the second additional folding path 400*b*. That is, in the present embodiment, the additional folding path-switching claw 405 functions as a conveying destination switching unit.

The additional folding roller 410 has a surface including thereon a projection portion 412*a* and a projection portion 412*b*, each having a projecting shape, so as to abut on the first and second sheet supporting plates 402*a* and 402*b*, respectively. The additional folding roller 410 presses the sheet to be additionally pressed against the first and second sheet supporting plates 402*a* and 402*b* using the projection portions 412*a* and 412*b*, and the sheet is additional pressed. It is noted that, when the projection portion 412*a* and the projection portion 412*b* do not need to be particularly distinguished, the projection portion will be referred to as "projection portion 412".

Next, an exemplary operation during additional folding by the additional folding unit 4 according to the present embodiment will be described with reference to FIGS. 48A to 48C and 49A to 49C. FIGS. 48A to 48C and 49A to 49C are cross-sectional views of an additional folding unit 4 according to the present embodiment, viewed in a direction perpendicular to the sheet conveying direction, illustrating the additional folding unit 4 performing additional folding. It is noted that FIGS. 48A to 48C and 49A to 49C illustrate exemplary operation upon additionally pressing the fold line, assuming that a leading end of the sheet in the sheet conveying direction is formed with the fold line.

Figure 48A:
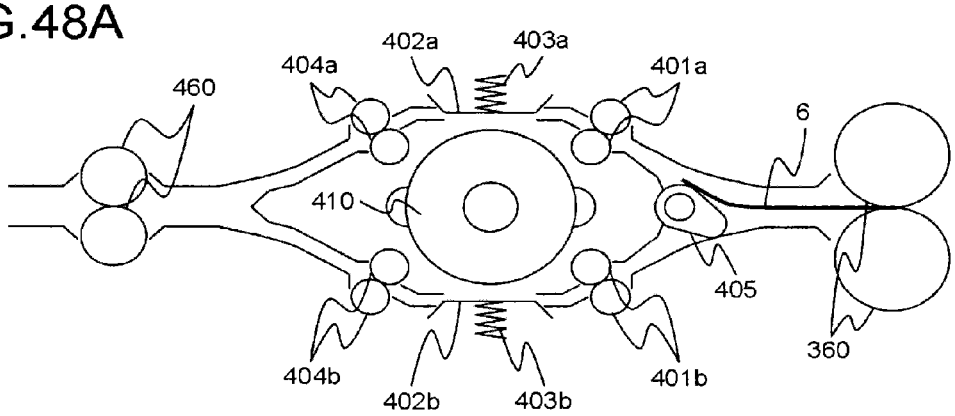
FIGS. 48A to 48C are cross-sectional views of an additional folding unit according to an embodiment of the present invention, viewed in a direction perpendicular to a sheet conveying direction, illustrating the additional folding unit performing additional folding.

As illustrated in FIG. 48A, in the additional folding unit 4, when the additional folding is performed, the sheet 6 conveyed from the folding unit 3 is guided to the first additional folding path 400*a* by the additional folding path-switching claw 405, first.

Figure 48B:
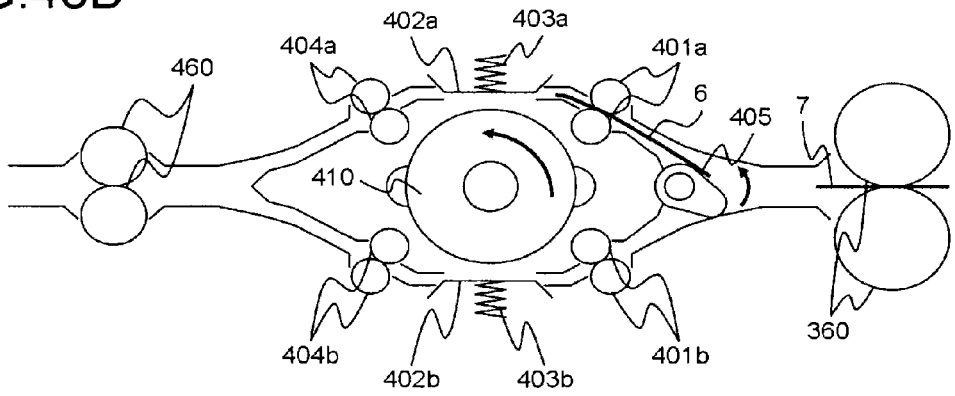

As illustrated in FIG. 48B, in the additional folding unit 4, when the sheet 6 is guided to the first additional folding path 400*a*, rotation of the additional folding roller 410 is started, with appropriate timing of conveyance of the fold line in the sheet 6 to an additional folding position by the first upstream sheet holding roller pair 401*a*.

At this time, as illustrated in FIG. 48B, in the additional folding unit 4, the additional folding path-switching claw 405 is switched toward the first additional folding path 400*a*, with appropriate timing of passage of a trailing end of the sheet 6 in the sheet conveying direction through the additional folding path-switching claw 405. It is note that, at this time, as illustrated in FIG. 48B, the following sheet 7 is already conveyed to the additional folding unit 4 from the folding unit 3.

Figure 48C:
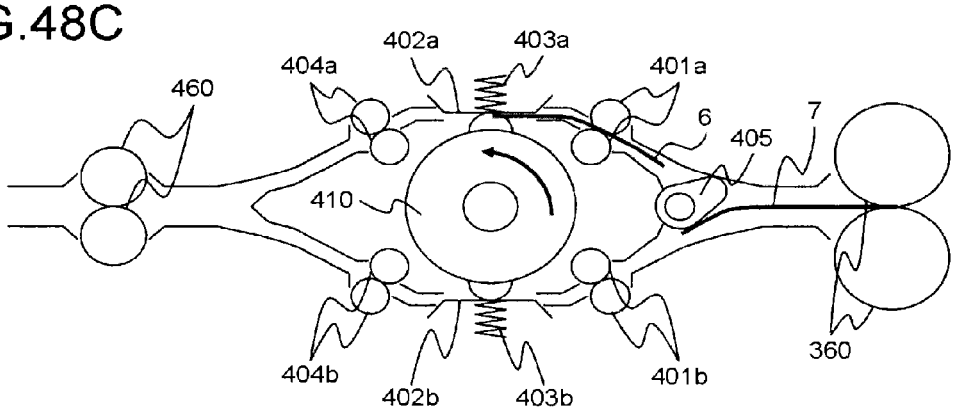

As illustrated in FIG. 48C, in the additional folding unit 4, when the first upstream sheet holding roller pair 401*a* further conveys the sheet 6 to convey the fold line in the sheet 6 to the additional folding position, the sheet 6 is held by the first upstream sheet holding roller pair 401*a*.

As illustrated in FIG. 48C, in the additional folding unit 4, the additional folding roller 410 is rotated to press the fold line in the sheet 6 held by the first upstream sheet holding roller pair 401*a*, by the projection portion 412, and the additional folding is performed. At this time, as illustrated in FIG. 48C, in the additional folding unit 4, the following sheet 7 conveyed from the folding unit 3 is guided to the second additional folding path 400*b* by the additional folding path-switching claw 405.

Figure 49A:
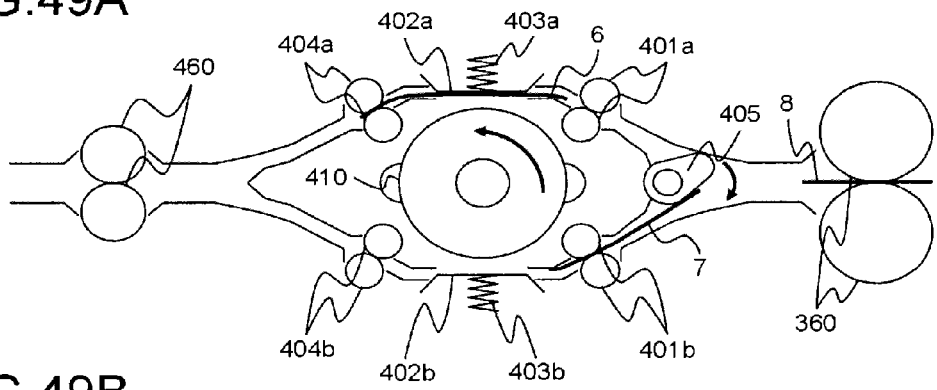
FIGS. 49A to 49C are cross-sectional views of an additional folding unit according to an embodiment of the present invention, viewed in a direction perpendicular to a sheet conveying direction, illustrating the additional folding unit performing additional folding.

As illustrated in FIG. 49A, in the additional folding unit 4, after the sheet 6 is additionally pressed, the sheet 6 is conveyed downstream the sheet conveying direction by the first upstream sheet holding roller pair 401*a* and the first downstream sheet holding roller pair 404*a*.

At this time, as illustrated in FIG. 49A, in the additional folding unit 4, the additional folding path-switching claw 405 is switched toward the second additional folding path 400*b*, with appropriate timing of passage of the trailing end of the sheet 7 in the sheet conveying direction through the additional folding path-switching claw 405. It is note that, at this time, as illustrated in FIG. 49A, a following sheet 8 is already conveyed to the additional folding unit 4 from the folding unit 3.

Figure 49B:
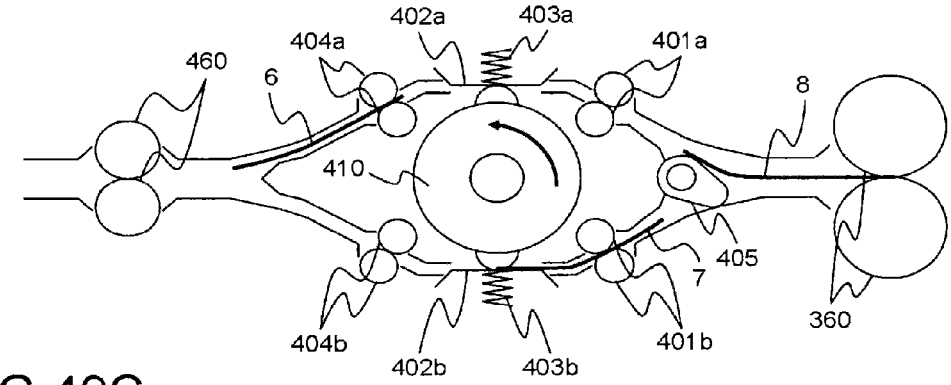
Figure 49C:
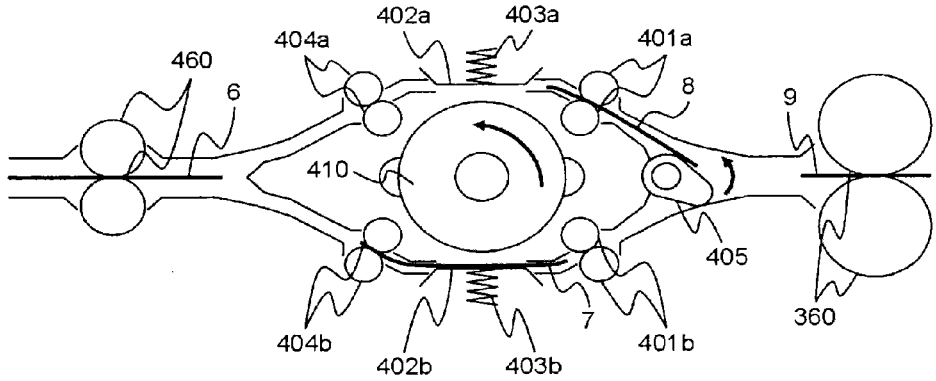

As illustrated in FIGS. 49B and 49C, in the additional folding unit 4, the sheet 6 additionally pressed is ejected from the additional folding unit 4 by the first downstream sheet holding roller pair 404*a* and the post-processing conveying roller pair 460. At this time, in the additional folding unit 4, the sheet 7 is also subjected to operation similar to the operation having been described with reference to FIGS. 48C and 49A, in the second additional folding path 400*b*.

The additional folding unit 4 according to the present embodiment repeats the operation having been described with reference to FIGS. 48A to 48C and 49A to 49C for the following sheets 8, 9, . . . , and a plurality of sheets is additionally pressed.

As described with reference to FIGS. 48A to 48C and 49A to 49C, the additional folding unit 4 according to the present embodiment includes the plurality of additional folding path, so that the following sheet can be conveyed before completion of the additional folding of the sheet previously conveyed, and the productivity in additional folding can be improved and the power consumption can be reduced.

Further, as described with reference to FIGS. 48A to 48C and 49A to 49C, the additional folding unit 4 according to the present embodiment includes the common additional folding roller 410 shared between the plurality of additional folding paths, so that a small and inexpensive device can be provided.

Next, another exemplary operation during additional folding by the additional folding unit 4 according to the present embodiment will be described with reference to FIGS. 50A to 50C and 51A to 51C. FIGS. 50A to 50C and 51A to 51C are cross-sectional views of the additional folding unit 4 according to the present embodiment, viewed in a direction perpendicular to the sheet conveying direction, illustrating the additional folding unit 4 performing additional folding. It is noted that FIGS. 50A to 50C and 51A to 51C illustrate exemplary operation upon additionally pressing the fold line, assuming that the leading end of the sheet in the sheet conveying direction is formed with the fold line.

Figure 50A:
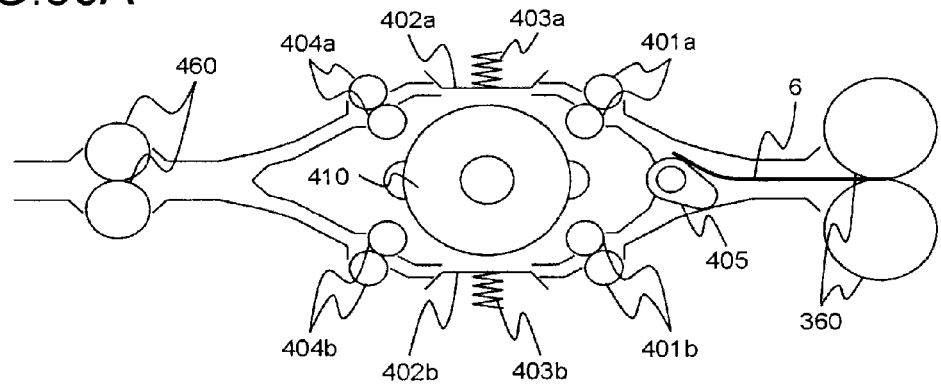
FIGS. 50A to 50C are cross-sectional views of an additional folding unit according to an embodiment of the present invention, viewed in a direction perpendicular to a sheet conveying direction, illustrating the additional folding unit performing additional folding.

As illustrated in FIG. 50A, in the additional folding unit 4, when the additional folding is performed, the sheet 6 conveyed from the folding unit 3 is guided to the first additional folding path 400*a* by the additional folding path-switching claw 405, first.

Figure 50B:
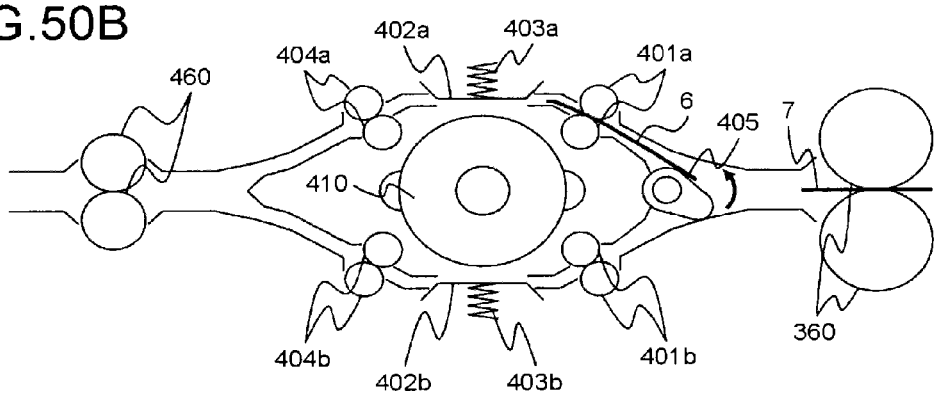

As illustrated in FIG. 50B, in the additional folding unit 4, when the sheet 6 is guided to the first additional folding path 400*a*, the first upstream sheet holding roller pair 401*a* conveys the sheet 6 downstream the sheet conveying direction.

At this time, as illustrated in FIG. 50B, in the additional folding unit 4, the additional folding path-switching claw 405 is switched toward the first additional folding path 400*a*, with appropriate timing of passage of the trailing end of the sheet 6 in the sheet conveying direction through the additional folding path-switching claw 405. It is note that, at this time, the following sheet 7 is already conveyed to the additional folding unit 4 from the folding unit 3.

Figure 50C:
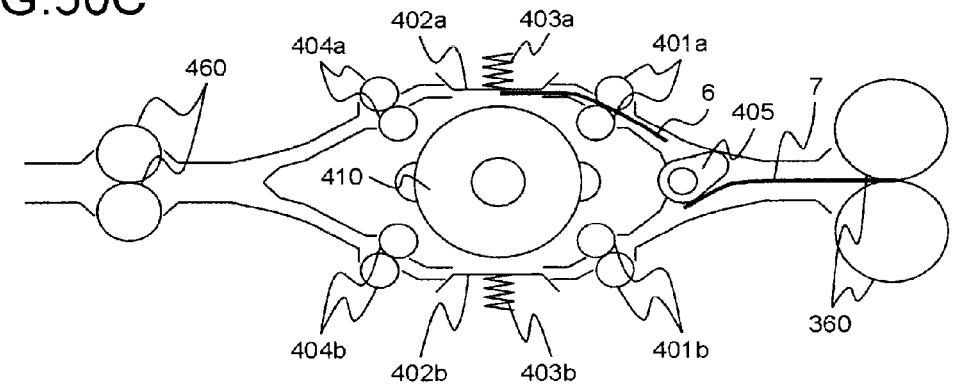

As illustrated in FIG. 50C, in the additional folding unit 4, when the first upstream sheet holding roller pair 401*a* further conveys the sheet 6 to convey the fold line in the sheet 6 to the additional folding position, the sheet 6 is held by the first upstream sheet holding roller pair 401*a*. At this time, as illustrated in FIG. 50C, in the additional folding unit 4, the following sheet 7 conveyed from the folding unit 3 is guided to the second additional folding path 400*b* by the additional folding path-switching claw 405.

Figure 51A:
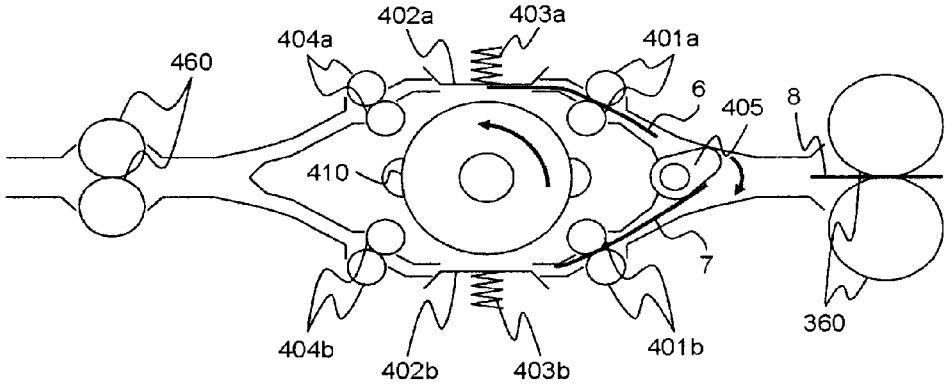
FIGS. 51A to 51C are cross-sectional views of an additional folding unit according to an embodiment of the present invention, viewed in a direction perpendicular to a sheet conveying direction, illustrating the additional folding unit performing additional folding.

As illustrated in FIG. 51A, in the additional folding unit 4, when the sheet 7 is guided to the second additional folding path 400*b*, rotation of the additional folding roller 410 is started, with appropriate timing of conveyance of the fold line in the sheet 6 to the additional folding position by the first upstream sheet holding roller pair 401*a*.

At this time, as illustrated in FIG. 51A, in the additional folding unit 4, the additional folding path-switching claw 405 is switched toward the second additional folding path 400*b*, with appropriate timing of passage of the trailing end of the sheet 7 in the sheet conveying direction through the additional folding path-switching claw 405. It is note that, at this time, as illustrated in FIG. 51A, the following sheet 8 is already conveyed to the additional folding unit 4 from the folding unit 3.

Figure 51B:
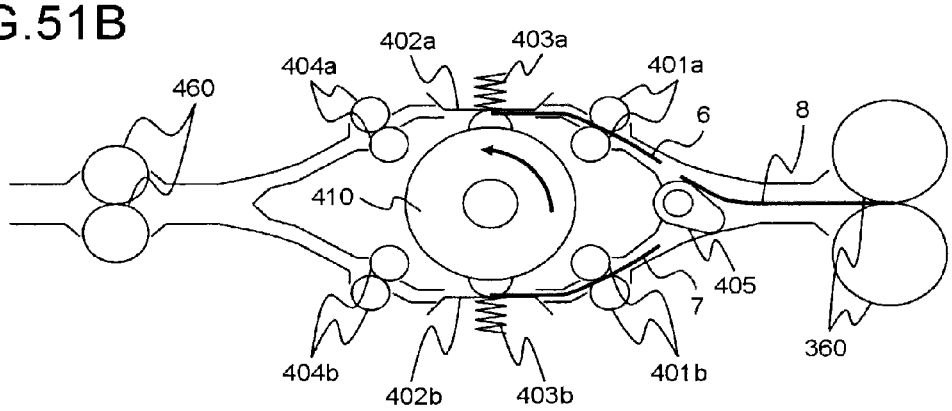

As illustrated in FIG. 51B, in the additional folding unit 4 when the first upstream sheet holding roller pair 401*a* further conveys the sheet 6 to convey the fold line in the sheet 6 to the additional folding position, the sheet 6 is held by the first upstream sheet holding roller pair 401*a*.

Then, as illustrated in FIG. 51B, in the additional folding unit 4, the additional folding roller 410 is rotated to simultaneously press the fold lines in the sheets 6 and 7 held by the first upstream sheet holding roller pair 401*a* and the second upstream sheet holding roller pair 401*b*, respectively, by the projection portions 412, and the additional folding is performed. At this time, as illustrated in FIG. 51B, in the additional folding unit 4, the following sheet 8 conveyed from the folding unit 3 is guided to the first additional folding path 400*a* by the additional folding path-switching claw 405.

Figure 51C:
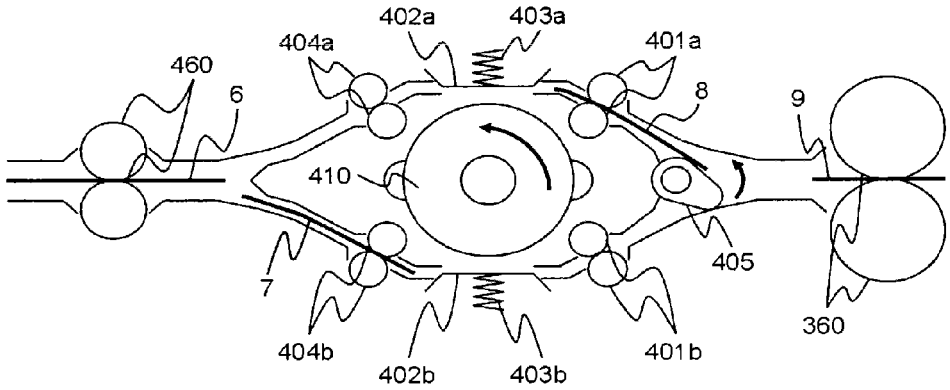

As illustrated in FIG. 51C, in the additional folding unit 4, when the sheets 6 and 7 are additionally pressed simultaneously, the sheets 6 and 7 are ejected from the additional folding unit 4 by the post-processing conveying roller pair 460 at different times so that the sheets are not superposed.

The additional folding unit 4 according to the present embodiment repeats the operation having been described with reference to FIGS. 50A to 50C and 51A to 51C for the following sheets 8, 9, . . . , and a plurality of sheets is additionally pressed.

As described with reference to FIGS. 50A to 50C and 51A to 51C, the additional folding unit 4 according to the present embodiment includes the plurality of additional folding paths, so that the sheet previously conveyed and the following sheet can be additionally pressed simultaneously, and the productivity in additional folding can be improved and the power consumption can be reduced.

Next, another exemplary operation during additional folding by the additional folding unit 4 according to the present embodiment will be described with reference to FIGS. 52A to 52D. FIGS. 52A to 52D are cross-sectional views of the additional folding unit 4 according to the present embodiment, viewed in a direction perpendicular to the sheet conveying direction, illustrating the additional folding unit 4 performing additional folding.

It is noted that FIG. 52A to 52D illustrate exemplary operation upon additionally pressing the fold line, assuming that two parts of the leading end of the sheet in the sheet conveying direction and the trailing end of the sheet in the sheet conveying direction are each formed with the fold line. Hereinafter, the fold line at the leading end of the sheet in the sheet conveying direction is defined as a first fold line, and the fold line at the trailing end of the sheet in the sheet conveying direction is defined as a second fold line.

Figure 52A:
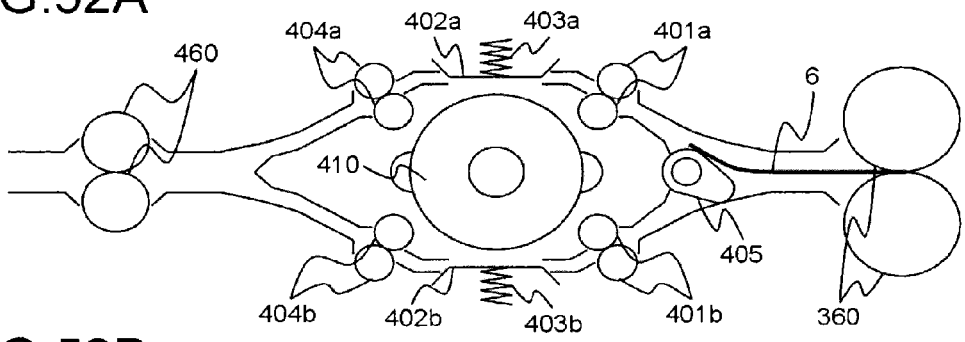
FIGS. 52A to 52D are cross-sectional views of an additional folding unit according to an embodiment of the present invention, viewed in a direction perpendicular to a sheet conveying direction, illustrating the additional folding unit performing additional folding.

As illustrated in FIG. 52A, in the additional folding unit 4, when the additional folding is performed, the sheet 6 conveyed from the folding unit 3 is guided to the first additional folding path 400*a* by the additional folding path-switching claw 405, first, and the first fold line in the sheet 6 is conveyed to the additional folding position.

Figure 52B:
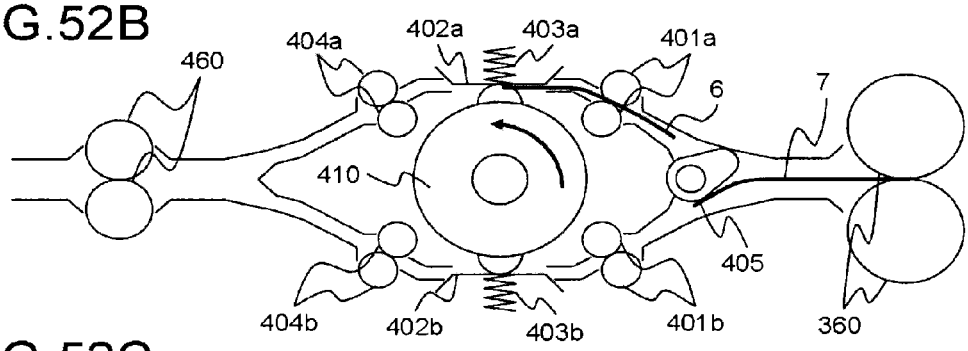

As illustrated in FIG. 52B, in the additional folding unit 4, when the first fold line in the sheet 6 is conveyed to the additional folding position, the first fold line in the sheet 6 is pressed by the projection portion 412, and the additional folding is performed. At this time, as illustrated in FIG. 52C, in the additional folding unit 4, the following sheet 7 conveyed from the folding unit 3 is guided to the second additional folding path 400*b* by the additional folding path-switching claw 405.

Figure 52C:
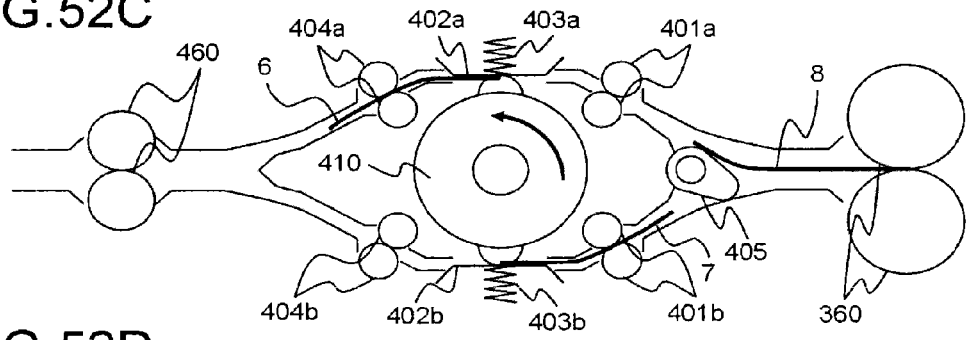

As illustrated in FIG. 52C, in the additional folding unit 4, after the first fold line in the sheet 6 is additionally pressed, the second fold line in the sheet 6 is conveyed to the additional folding position, and the first fold line in the sheet 7 is conveyed to the additional folding position. Then, as illustrated in FIG. 52C, in the additional folding unit 4, the second fold line in the sheet 6 and the first fold line in the sheet 7 are simultaneously pressed, and the additional folding is performed.

At this time, as illustrated in FIG. 52C, in the additional folding unit 4, the following sheet 8 conveyed from the folding unit 3 is guided to the second additional folding path 400*b* by the additional folding path-switching claw 405.

Figure 52D:
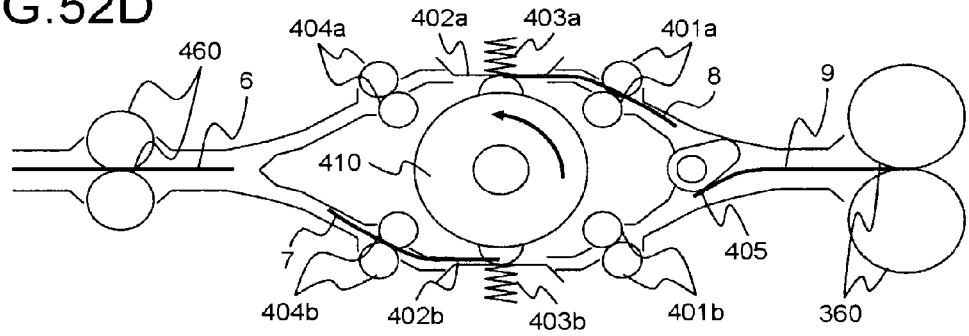
Figure 53A:
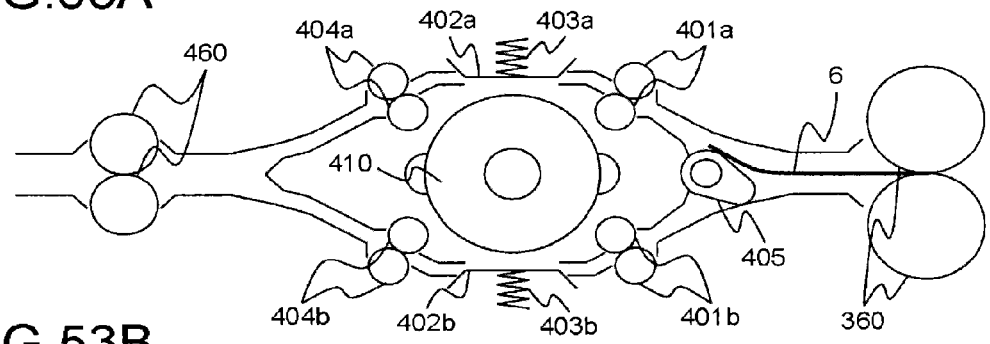
FIGS. 53A to 53D are cross-sectional views of an additional folding unit according to an embodiment of the present invention, viewed in a direction perpendicular to a sheet conveying direction, illustrating the additional folding unit performing straight conveyance of sheets in an additional folding portion.
Figure 53B:
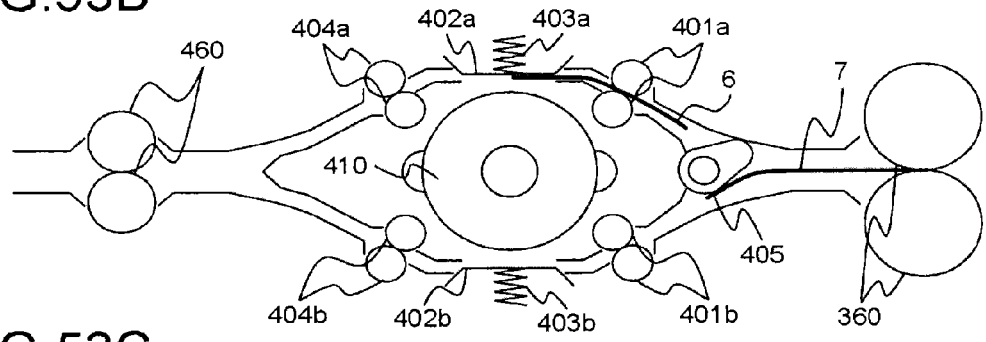
Figure 53C:
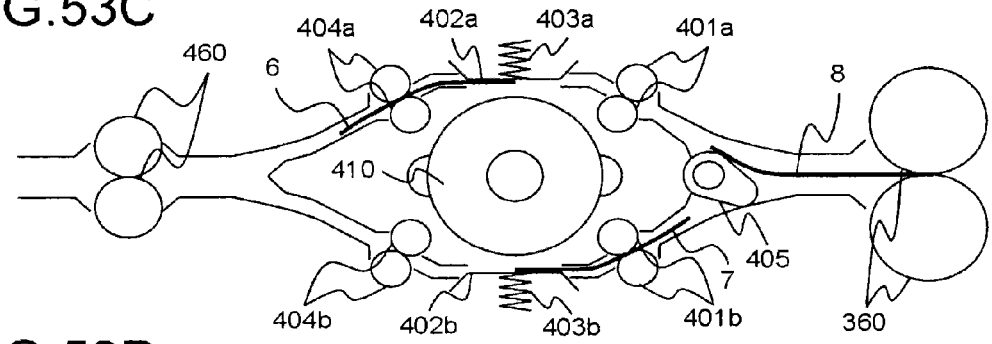
Figure 53D:
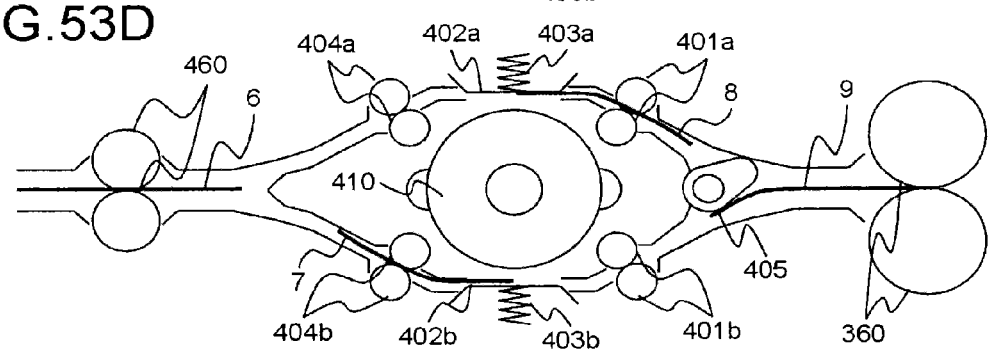

As illustrated in FIG. 52D, in the additional folding unit 4, when the second fold line in the sheet 6 and the first fold line in the sheet 7 are additionally pressed simultaneously, the sheet 6 having been additionally pressed is ejected from the additional folding unit 4 by the post-processing conveying roller pair 460.

At this time, as illustrated in FIG. 52D, in the additional folding unit 4, the second fold in the sheet 7 is conveyed to the additional folding position, and the first fold line in the sheet 8 is conveyed to the additional folding position. Then, as illustrated in FIG. 52D, in the additional folding unit 4, the second fold line in the sheet 6 and the first fold line in the sheet 7 are simultaneously pressed, and the additional folding is performed.

The additional folding unit 4 according to the present embodiment repeats the operation having been described with reference to FIGS. 52A to 52D for the following sheets 9, . . . , and a plurality of sheets is additionally pressed.

As described with reference to FIGS. 52A to 52D, the additional folding unit 4 according to the present embodiment includes the plurality of additional folding paths, so that the second fold line in the sheet previously conveyed and the following sheet can be additionally pressed simultaneously, and the productivity in additional folding can be improved and the power consumption can be reduced.

Next, an exemplary operation of the additional folding unit 4 according to the present embodiment during straight conveyance of the sheets in the additional folding portion 4*b* will be described with reference to FIGS. 53A to 53D. FIGS. 53A to 53D are cross-sectional views of an additional folding unit 4 according to the present embodiment, viewed in a direction perpendicular to the sheet conveying direction, illustrating the additional folding unit 4 performing the straight conveyance of the sheets in the additional folding portion 4*b*.

As illustrated in FIGS. 53A to 53D, when the additional folding unit 4 according to the present embodiment performs the straight conveyance of the sheets in the additional folding portion 4*b*, the sheets are alternately conveyed between the first additional folding path 400*a* and the second additional folding path 400*b*, while the projection portions 412 are retracted from the additional folding position without rotating the additional folding roller 410.

The additional folding unit 4 according to the present embodiment is configured as described above, so that the sheet can be subjected to the straight conveyance without the straight conveying path 4*a*. Accordingly, the additional folding unit 4 according to the present embodiment is configured as described above, so that the small and inexpensive device can be provided.

In FIGS. 53A to 53D, description has been made of an exemplary configuration of the additional folding unit 4 alternately conveying the sheets between the first additional folding path 400*a* and the second additional folding path 400*b* for straight conveyance of the sheets. Additionally, the additional folding unit 4 may be configured such that only either one of the first additional folding path 400*a* and the second additional folding path 400*b* is used for the straight conveyance.

Figure 54:
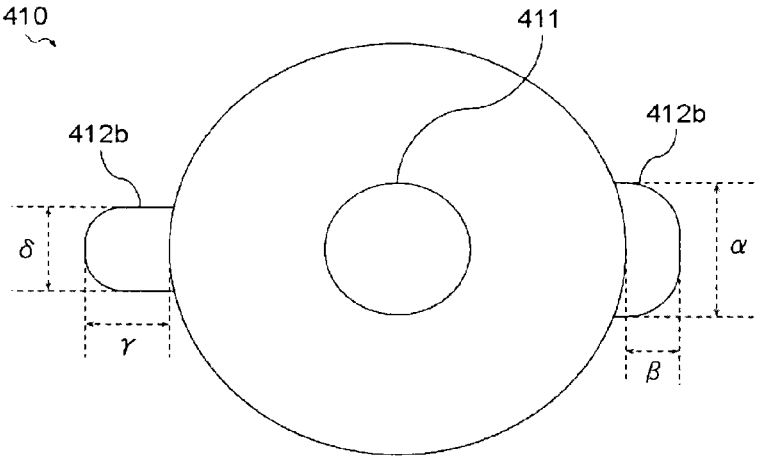
FIG. 54 is a cross-sectional view illustrating an additional folding roller according to an embodiment of the present invention, viewed in a direction perpendicular to a sheet conveying direction.

Next, a configuration of the projection portions 412*a* and 412*b* of the additional folding roller 410 according to the present embodiment will be described with reference to FIG. 54. FIG. 54 is a cross-sectional view illustrating the additional folding roller 410 according to the present embodiment, viewed in a direction perpendicular to the sheet conveying direction.

As illustrated in FIG. 54, a height of the projection portion 412*a* from the surface of the additional folding roller 410 is defined as $\beta$, and a width of the projection portion 412*a* is defined as $\alpha$. While, as illustrated in FIG. 54, a height of the projection portion 412*b* from the surface of the additional folding roller 410 is defined as $\gamma$, and a width of the projection portion 412*b* is defined as $\delta$.

In this configuration, the projection portions 412*a* and 412*b* in the additional folding roller 410 according to the present embodiment are configured to satisfy at least one of the following relationships: $\alpha>\delta$ and $\beta<\gamma$. The additional folding roller 410 according to the present embodiment is configured as described above, so that the projection portion 412*b* can have an increased pressing force compared with the projection portion 412*a*.

Accordingly, when the sheet to be additionally pressed is cardboard, a multi-folded sheet, a strong sheet, or a hard sheet, the additional folding unit 4 according to the present embodiment performs the additional folding using the projection portion 412*b* having a large pressing force. While, when the sheet to be additionally pressed is thin paper, a sheet having reduced fold lines, a weak sheet, or a soft sheet, the additional folding unit 4 according to the present embodiment performs the additional folding using the projection portion 412*a* having a small pressing force.

As described above, with the additional folding unit 4 according to the present embodiment, the pressing force can be changed according to the sheet information such as the thickness, folds, strength, hardness, or the like of the sheet to be additionally pressed in order to effectively perform the additional folding.

Further, with the additional folding unit 4 according to the present embodiment, the pressing force can be changed according to the sheet information of the sheet to be additionally pressed in order to reduce damage on the sheet, and therefore the quality of the sheet after the additional folding can be improved.

In the present embodiment, description has been made of an example of the additional folding unit 4 having the projection portion 412*a* and the projection portion 412*b*, which have different shapes or sizes, to change the pressing force, but the projection portion 412*a* and the projection portion 412*b* may be configured to use different materials to change the pressing force.

Figure 55:
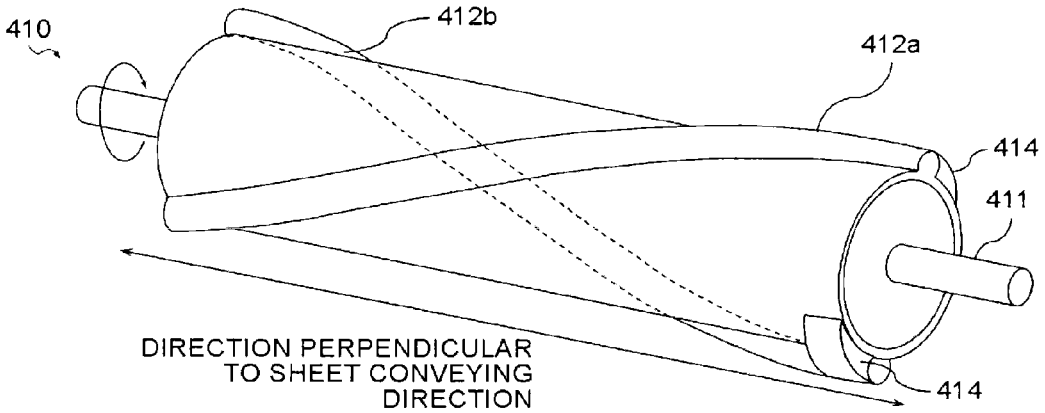
FIG. 55 is a perspective view illustrating an additional folding roller according to an embodiment of the present invention, viewed obliquely downward from a side in a direction perpendicular to a sheet conveying direction.
Figure 56:
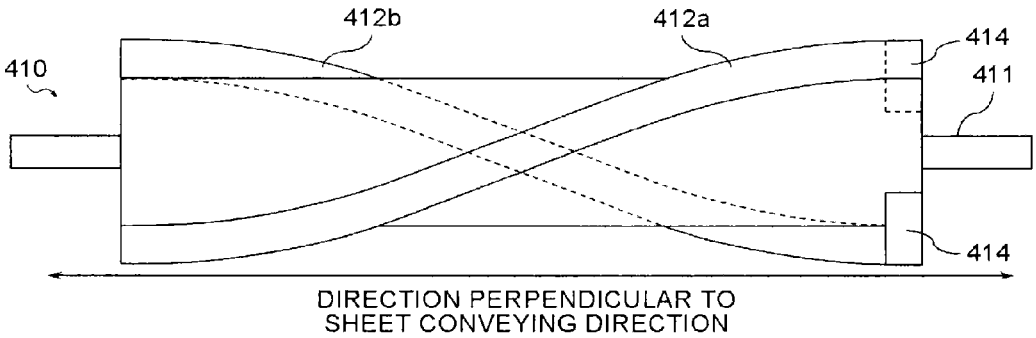
FIG. 56 is a front view illustrating an additional folding roller according to an embodiment of the present invention, viewed in a sheet conveying direction.
Figure 57:
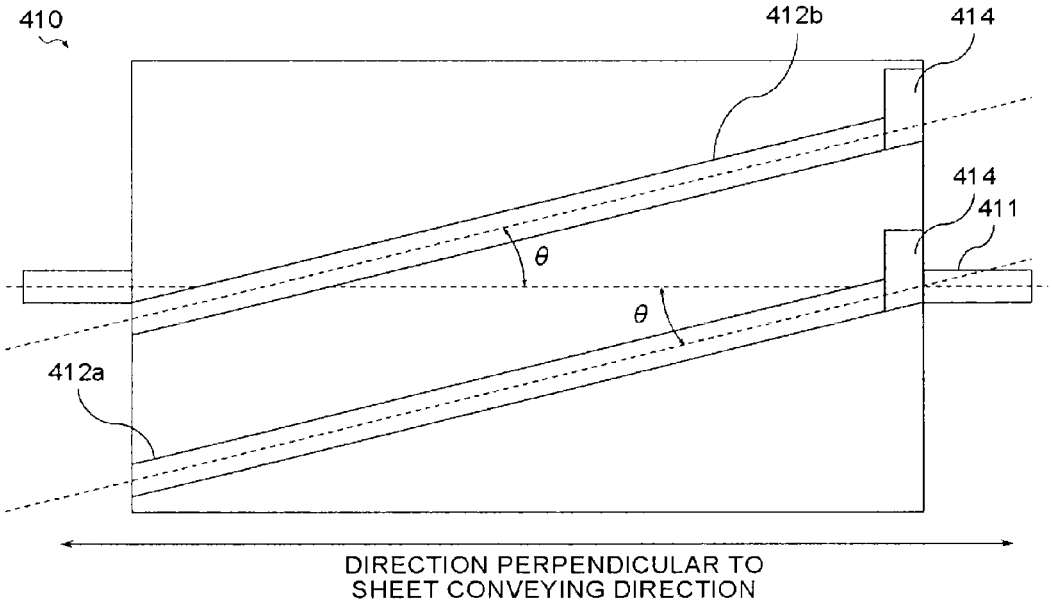
FIG. 57 is a development view illustrating an additional folding roller according to an embodiment of the present invention.

Next, an exemplary structure of the additional folding roller 410 according to the present embodiment will be described with reference to FIGS. 55 to 57. FIG. 55 is a perspective view illustrating the additional folding roller 410 according to the present embodiment, viewed obliquely downward from a side in a direction perpendicular to the sheet conveying direction. FIG. 56 is a front view illustrating the additional folding roller 410 according to the present embodiment, viewed in the sheet conveying direction. FIG. 57 is a development view illustrating the additional folding roller 410 according to the present embodiment.

As illustrated in FIGS. 55 to 57, the additional folding roller 410 according to the present embodiment is configured so that the additional folding roller rotation shaft 411 rotates about the axis penetrating in a direction perpendicular to the sheet conveying direction, the additional folding roller rotation shaft 411 is defined as the rotation axis, the additional folding roller 410 has a surface on which projection portions 412*a* and 412*b* having a projecting shape are disposed to have a helical shape about the rotation axis with a fixed angular difference θ between the projection portions 412*a* and 412*b* and the additional folding roller rotation shaft 411.

Further, the additional folding roller 410 according to the present embodiment is configured so that the projection portion 412 formed on the surface of the additional folding roller 410 has an distal end abutting on the sheet at first, and the distal end is provided with the impact absorbing member 414 for reducing impact upon collision with the sheet, as illustrated in FIGS. 55 to 57. As described in the first embodiment, the impact absorbing member 414 is provided to have an inclination angle at the distal end of the projection portion 412, and the inclination angle is configured to be reduced, or gentle, relative to the surface of the additional folding roller 410.

As described above, according to one aspect of the present embodiment, the additional folding unit 4 according to the present embodiment is configured to include a common additional folding roller shared between the plurality of additional folding paths. The additional folding unit 4 according to the present embodiment is configured as described above, so that the additional folding unit 4 has a small size at a low cost, and productivity in additional folding can be improved and power consumption can be reduced.

In the present embodiment, description has been made of an example of the additional folding unit 4 configured to include two projection portions 412 (412*a*, 412*b*). Additionally, the additional folding unit 4 according to the present embodiment may be configured to include only one projection portion 412 or include a larger number of projection portions 412.

However, in the additional folding unit 4 according to the present embodiment the larger number of projection portions 412 can further improve the productivity in additional folding and further reduce the power consumption. It is because, when the additional folding unit 4 according to the present embodiment employs the larger number of projection portions 412, a distance between the projection portions 412 are reduced, and the rotation of the additional folding roller 410 is reduced upon additional folding.

Further, description has been made of an example of the additional folding unit 4 according to the present embodiment having the projection portions 412 disposed at equal intervals in the rotation direction of the additional folding roller 410. However, the configuration of the projection portions 412 is not limited to this, and the projection portions 412 may be disposed at any interval.

In the present embodiment, description has been made of an example of the additional folding unit 4 configured to guide the sheet 6 conveyed from the folding unit 3 to the first additional folding path 400*a*, first. However, the additional folding unit 4 may be configured to guide the sheet 6 to the second additional folding path 400*b*, first.

According to the present invention, the fold line formed in the sheet can be efficiently pressed at low cost, and the noise generated upon pressing the fold line can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device, comprising:

a conveyor to convey a folded sheet;

a support; and a roller including a projection that is disposed at an outer circumferential surface of the roller, the projection of the roller to press, as the roller is rotating about a rotation axis, a fold line of the folded sheet against the support, the projection extending along an entire width of the roller, and the projection extending less than 360 degrees circumferentially around the roller.

2. The sheet processing device according to claim 1, wherein:

the projection is continuous along the width of the roller.

3. The sheet processing device according to claim 2, wherein:

the projection includes a v-shape.

4. The sheet processing device according to claim 3, wherein:

the v-shape has two sections, and a point where the two sections of the v-shape join is a first point which contacts the folded sheet.

5. The sheet processing device according to claim 1, wherein:

the projection is a sole projection at the circumferential surface of the roller.

6. The sheet processing device according to claim 5, wherein:

the projection occupies less than 360 degrees of the roller.

7. The sheet processing device according to claim 1, wherein:

the projection includes a v-shape.

8. The sheet processing device according to claim 7, wherein:

the projection is symmetrical relative to the rotation axis of the roller.

9. The sheet processing device according to claim 1, wherein:

the projection is symmetrical relative to the rotation axis of the roller.

10. The sheet processing device according to claim 1, wherein:

the support includes a support plate.

11. The sheet processing device according to claim 1, wherein:

as the roller is rotated, a pressing point of the fold line between the projection of the roller and the support moves from a middle of the fold line to both end of the folded sheet.

12. The sheet processing device according to claim 1, further comprising:

an impact absorber contacting the projection.

13. The sheet processing device according to claim 12, wherein:

the roller includes therein a fixed member and an elastic or resilient member, and the elastic or resilient member is to be compressed or expanded by the fixed member and the impact absorber so that an angle of the impact absorber is changeable relative to the surface of the roller.

14. The sheet processing device according to claim 1, wherein:

the projection includes a v-shape, the v-shape has two sections, and a point where the two sections of the v-shape meet includes an impact absorber contacting the projection.

15. The sheet processing device according to claim 1, wherein:

when the roller is rotating, prior to the two parts of the projection simultaneously contacting the fold line, the one part of the projection contacts the fold line, or prior to the one part of the projection contacting the fold line, the two part of the projection simultaneously contact the fold line.

16. The sheet processing device according to claim 1, wherein:

the one part of the projection makes contact with the fold line of the folded sheet, as the roller is rotating.

17. The sheet processing device according to claim 1, wherein:

the projection extends less than 270 degrees circumferentially around the roller.

18. The sheet processing device according to claim 17, wherein:

the projection extends 180 degrees circumferentially around the roller.

19. The sheet processing device according to claim 1, wherein:

the projection consists of a single v-shape.

20. The sheet processing device according to claim 1, wherein:

the projection includes at least a first end and a second end, the first end and the second end being circumferentially opposite from one another, one of the first end and the second end includes an impact absorber which contacts the projection and includes a curved inclination.

21. An image forming apparatus that forms an image on the sheet, the image forming apparatus comprising the sheet processing device according to claim 1.

* * * * *